US005089368A

United States Patent [19]

Kato et al.

[11] Patent Number: 5,089,368

[45] Date of Patent: Feb. 18, 1992

[54] ELECTROPHOTOGRAPHIC LIGHT-SENSITIVE MATERIAL

[75] Inventors: Eiichi Kato; Kazuo Ishii, both of Shizuoka, Japan

[73] Assignee: Fuji Photo Film Co., Ltd., Kanagawa, Japan

[21] Appl. No.: 642,955

[22] Filed: Jan. 18, 1991

[30] Foreign Application Priority Data

| | | | |
|---|---|---|---|
| Jan. 19, 1990 | [JP] | Japan | 2-8494 |
| Jan. 30, 1990 | [JP] | Japan | 2-17974 |
| Jun. 12, 1990 | [JP] | Japan | 2-151725 |

[51] Int. Cl.[5] ..... G03G 5/00

[52] U.S. Cl. ..... 430/96; 430/127

[58] Field of Search ..... 430/96, 127

[56] References Cited

U.S. PATENT DOCUMENTS

| | | | |
|---|---|---|---|
| 3,776,724 | 12/1973 | Usmani | 430/96 |
| 3,912,506 | 10/1975 | Merrill | 430/96 |
| 3,932,181 | 1/1976 | Ray-Chaudhuri et al. | 430/96 |
| 4,673,627 | 6/1987 | Kunishika et al. | 430/127 |
| 4,871,638 | 10/1989 | Kato et al. | 430/96 |
| 5,021,311 | 6/1991 | Kato et al. | 430/96 |
| 5,030,534 | 7/1991 | Kato et al. | 430/96 |

*Primary Examiner*—Marion E. McCamish
*Assistant Examiner*—Christopher D. RoDee
*Attorney, Agent, or Firm*—Sughrue, Mion, Zinn, Macpeak & Seas

[57] ABSTRACT

An electrophotographic light-sensitive material comprising a support having provided thereon a photoconductive layer containing an inorganic photoconductive substance and a binder resin, wherein the binder resin contains at least one graft type copolymer containing, as a copolymerizable component, at least one monofunctional macromonomer (M) having a weight average molecular weight of from $1\times10^3$ to $2\times10^4$ and comprising an AB block copolymer being composed of an A block comprising at least one polymerizable component containing at least one acidic group selected from $-PO_3H_2$, $-COOH$, $-SO_3H$, a phenolic hydroxyl group, (wherein R represents a hydrocarbon group or —OR′ (where R′ represents a hydrocarbon group)) and a cyclic acid anhydride-containing group, and a B block containing at least one polymerizable component represented by general formula (I) and having a polymerizable double bond group bonded to the terminal of the main chain of the B block polymer (I)

wherein $a_1$ and $a_2$ each represents a hydrogen atom, a halogen atoms, a cyano group, a hydrocarbon group, $-COOZ_2$ or $-COOZ_2$ bonded via a hydrocarbon group (wherein $Z_2$ represents a hydrogen atom or a hydrocarbon group); $V_1$ represents —COO—, —OCO—, $-CH_2)_{l1}OCO-$, $-CH_2)_{l2}COO-$ (wherein $l_1$ and $l_2$ each represents an integer of from 1 to 3), —O—, $-SO_2-$, —CO—, (wherein $Z_1$ represent a hydrogen atom or a hydrocarbon group), —CONHCOO—, —CONHCONH—, or and $R_1$ represents a hydrocarbon group, provided that when $V_1$ represents $R_1$ represents a hydrogen atom or a hydrocarbon group.

11 Claims, No Drawings

ELECTROPHOTOGRAPHIC LIGHT-SENSITIVE MATERIAL

FIELD OF THE INVENTION

The present invention relates to an electrophotographic light-sensitive material, and more particularly to an electrophotographic light-sensitive material which is excellent in electrostatic characteristics and moisture resistance, and further in durability.

BACKGROUND OF THE INVENTION

An electrophotographic light-sensitive material may have various structures depending upon the characteristics required or an electrophotographic process to be employed.

An electrophotographic system in which the light-sensitive material comprises a support having thereon at least one photoconductive layer and, if necessary, an insulating layer on the surface thereof is widely employed. The electrophotographic light-sensitive material comprising a support and at least one photoconductive layer formed thereon is used for the image formation by an ordinary electrophotographic process including electrostatic charging imagewise exposure, development, and, if desired, transfer.

Furthermore, a process using an electrophotographic light-sensitive material as an offset master plate precursor for direct plate making is widely practiced. Particularly, a printing system using a direct electrophotographic printing plate has recently become important for providing high quality prints of from several hundreds to several thousands.

Binders which are used for forming the photoconductive layer of an electrophotographic light-sensitive material are required to be excellent in the film-forming properties by themselves and the capability of dispersing photoconductive powder therein. Also, the photoconductive layer formed using the binder is required to have satisfactory adhesion to a base material or support. Further, the photoconductive layer formed by using the binder is required to have various excellent electrostatic characteristics such as high charging capacity, small dark decay, large light decay, and less fatigue due to prior light-exposure and also have an excellent image forming properties, and the photoconductive layer stably maintains these electrostatic properties to change of humidity at the time of image formation.

Further, extensive investigations have been made on lithographic printing plate precursors using an electrophotographic light-sensitive material, and for such a purpose, binder resins for a photoconductive layer which satisfy both the electrostatic characteristics as an electrophotographic light-sensitive material and printing properties as a printing plate precursor are required.

However, conventional binder resins used for electrophotographic light-sensitive materials have various problems particularly in electrostatic characteristics such as a charging property, dark charge retention, and photo-sensitivity, and smoothness of the photoconductive layer.

In order to overcome these problems, JP-A-63-217354 and JP-A-1-70761 (the term "JP-A" as used herein means an "unexamined Japanese patent application") disclose improvements in the smoothness of the photoconductive layer and electrostatic characteristics by using, as a binder resin, a resin having a weight average molecular weight of from $1\times10^3$ to $5\times10^5$) and containing an acidic group in a side chain of a copolymer or an acidic group bonded at the terminal of a polymer main chain thereby obtaining an image having no background stains.

Also, JP-A-1-100554 and JP-A-1-214865 disclose a technique using, as a binder resin, a resin containing an acidic group in a side chain of a copolymer or at the terminal of a polymer main chain, and containing a polymerizable component having a heat- and/or photo-curable functional group; JP-A-1-102573 and JP-A-2-874 disclose a technique using a resin containing an acidic group in a side chain of a copolymer or at the terminal of a polymer main chain, and a crosslinking agent in combination; JP-A-64-564, JP-A-63-220149, JP-A-63-220148, JP-A-1-280761, JP-A-1-116643 and JP-A-1-169455 disclose a technique using a resin having a low molecular weight (a weight average molecular weight of from $1\times10^3$ to $1\times10^4$) and a resin having a high molecular weight (a weight average molecular weight of $1\times10^4$ or more) in combination; JP-A-2-11766 and JP-A-2-34859 disclose a technique using the above described low molecular weight resin and a heat- and/or photo-curable resin in combination. These references disclose that, according to the proposed technique, the film strength of the photoconductive layer can be increased sufficiently and also the mechanical strength of the light-sensitive material can be increased without adversely affecting the above-described characteristics owing to the use of a resin containing an acidic group in a side chain or at the terminal of the polymer main chain.

However, it has been found that, even in the case of using these resins, it is yet insufficient to maintain the stable performance in the case of greatly changing the environmental conditions from high-temperature and high-humidity to low-temperature and low-humidity. In particular, in a scanning exposure system using a semiconductor laser beam, the exposure time becomes longer and also there is a restriction on the exposure intensity as compared to a conventional overall simultaneous exposure system using a visible light, and hence a higher performance has been required for the electrostatic characteristics, in particular, the dark charge retention characteristics and photosensitivity.

The present invention has been made for solving the problems of conventional electrophotographic light-sensitive materials as described above and meeting the requirement for the light-sensitive materials.

An object of the present invention is to provide an electrophotographic light-sensitive material having stable and excellent electrostatic characteristics and giving clear good images even when the environmental conditions during the formation of duplicated images are changed to a low-temperature and low-humidity or to high-temperature and high-humidity.

Another object of the present invention is to provide a CPC electrophotographic light-sensitive material having excellent electrostatic characteristics and showing less environmental dependency.

A further object of the present invention is to provide an electrophotographic light-sensitive material effective for a scanning exposure system using a semiconductor laser beam.

A still further object of this invention is to provide an electrophotographic lithographic printing plate precursor having excellent electrostatic characteristics (in particular, dark charge retention characteristics and photosensitivity), capable of reproducing faithful duplicated images to original, forming neither overall background stains nor dot-like background stains of prints, and showing excellent printing durability.

Other objects of the present invention will become apparent from the following description and examples.

It has been found that the above described objects of the present invention are accomplished by an electrophotographic light-sensitive material comprising a support having provided thereon a photoconductive layer containing an inorganic photoconductive substance and a binder resin, wherein the binder resin contains at least one graft type copolymer containing, as a copolymerizable component, at least one mono-functional macromonomer (M) having a weight average molecular weight of from $1\times10^3$ to $2\times10^4$ and comprising an AB block copolymer being composed of an A block comprising at least one polymerizable component containing at least one acidic group selected from $-PO_3H_2$, $-COOH$, $-SO_3H$, a phenolic hydroxyl group,

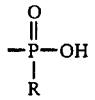

(wherein R represents a hydrocarbon group or —OR′ (wherein R′ represents a hydrocarbon group)) and a cyclic acid anhydride-containing group, and a B block containing at least one polymerizable component represented by the general formula (I) described below and having a polymerizable double bond group bonded to the terminal of the main chain of the B block polymer.

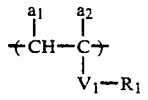

(I)

wherein $a_1$ and $a_2$ each represents a hydrogen atom, a halogen atom, a cyano group, a hydrocarbon group, $-COOZ_2$ or $-COOZ_2$ bonded bia a hydrocarbon group (wherein $Z_2$ represents a hydrogen atom or a hydrocarbon group); $V_1$ represents —COO—, —OCO—, $-CH_{2l_1}OCO-$, $-CH_{2l_2}COO-$ (wherein $l_1$ and $l_2$ each represents an integer of from 1 to 3), —O—, $-SO_2-$, —CO—,

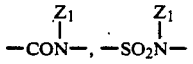

(wherein $Z_1$ represent a hydrogen atom or a hydrocarbon group), —CONHCOO—, —CONHCONH—, or

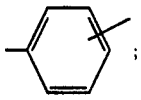

and $R_1$ represents a hydrocarbon group, provided that when $V_1$ represents

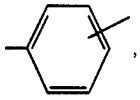

$R_1$ represents a hydrogen atom or a hydrocarbon group.

DETAILED DESCRIPTION OF THE INVENTION

The binder resin which can be used in the present invention is characterized by comprising at least one graft type copolymer (hereinafter sometime referred to as resin (A)) containing, as a copolymerizable component, at least one mono-functional macromonomer (M) having a weight average molecular weight of from $1\times10^3$ to $2\times10^4$, comprising an AB block copolymer being composed of an A block comprising at least one polymerizable component containing the specific acidic group (the term "acidic group" as used herein means and includes a cyclic acid anhydride-containing group, unless otherwise indicated) and a B block comprising a polymerizable component represented by the general formula (I), and having a polymerizable double bond group bonded to the terminal of the main chain of the B block polymer.

The graft type copolymer according to the present invention preferably has a weight average molecular weight of from $1\times10^3$ to $5\times10^5$.

In the graft type copolymer, a component copolymerizable with the macromonomer (M) is preferably a monomer represented by the following general formula (II):

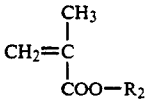

(II)

wherein $R_2$ represents a hydrocarbon group.

The polymerizable components of the macromonomer 9M) are composed of the A block and the B block as described above, and a ratio of the A block to the B block is preferably 0.5 to 70/99.5 to 30 by weight, and more preferably 1 to 50/99 to 50 by weight.

The ratio of the macromonomer (M) to other monomers in the graft type copolymer according to the present invention is preferably 0.5 to 50/99.5 to 50 by weight, and more preferably 1 to 30/99 to 70 by weight.

The content of the acidic group-containing component present in the macromonomer (M) of the graft type copolymer according to the present invention is preferably from 0.05 to 50 parts by weight, and more preferably from 0.1 to 30 parts by weight per 100 parts by weight of the copolymer.

The content of the acidic group present in the graft type copolymer described above can be adjusted to a preferred range by appropriately selecting the ratio of the A block present in the macromonomer (M) and the ratio of the macromonomer (M) in the graft type copolymer.

More preferably, the binder resin used in the present invention contains at least one of the above described graft type copolymer having a weight average molecular weight of from $5\times10^3$ to $1\times10^5$. In case of using such a graft type copolymer of a low molecular weight, the ratio of the macromonomer (M) to other monomers in the graft type copolymer is preferably 5 to 50/95 to 50 by weight. Further, the content of the acid group-containing component present in the macromonomer 9M) of such a low molecular weight graft type copolymer is preferably from 1 to 10 parts by weight per 100 parts by weight of the copolymer.

The low molecular weight resin in acidic group-containing binder resins which are known to improve the smoothness and the electrostatic characteristics of the photoconductive layer described above is a resin wherein acidic group-containing polymerizable components exist at random in the polymer main chain, or a resin wherein an acidic group is bonded to only one terminal of the polymer main chain.

On the other hand, the graft type copolymer used as the binder resin according to the present invention has a chemical structure of the polymer chain which is specified in such a manner that the acidic groups contained in the resin exist as a block (i.e., the A block) in the graft portion apart from the copolymer main chain.

It is presumed that, in the graft type copolymer used in the present invention, the acidic groups maldistributed at the terminal portion of the graft part of the polymer is sufficiently adsorbed on the stoichiometric defect of the inorganic photoconductive substance and other portions of the graft part of the polymer mildly but sufficiently cover the surface of the photoconductive substance. Also, it is presumed that, even when the stoichiometric defect portion of the inorganic photoconductive substance varies to some extents, it always keeps a stable interaction with the copolymer (resin (A)) used in the present invention since the resin has the above described sufficiently adsorbed domain by the function and mechanism of the sufficient adsorption onto the surface of the photoconductive substance and the mild covering as described above as compared with known resins. Thus, it has been found that, according to the present invention, the traps of the inorganic photoconductive substance are more effectively and sufficiently compensated and the humidity characteristics of the photoconductive substance are improved as compared with conventionally known acidic group-containing resins. Further, in the present invention, particles of the inorganic photoconductive substance are sufficiently dispersed in the binder to restrain the occurrence of the aggregation of the particles of the photoconductive substance as well as even when the environmental conditions are greatly changed from high temperature and high humidity to low temperature and low humidity, the electrophotographic characteristics of a high performance can be stably maintained.

Also, the present invention is particularly effective in case of a scanning exposure system using a semiconductor laser. Further, according to the present invention, the smoothness of the surface of the photoconductive layer can be further improved.

If an electrophotographic light-sensitive material having a photoconductive layer of a coarse surface is used as a lithographic printing plate precursor by an electrophotographic system, the photoconductive layer is formed in a state that the dispersion state of the particles of an inorganic photoconductive substance such as zinc oxide particles and a binder resin is improper and aggregates of the particles exist. When an oil-desensitizing treatment with an oil-desensitizing solution is applied thereto, the non-image areas are not uniformly and sufficiently rendered hydrophilic to cause attaching of a printing ink at printing, which results in the formation of background stains at the non-image areas of the prints obtained.

When the resin according to the present invention is used, the interaction of the inorganic photoconductive substance and the binder resin for adsorption and covering is adequately conducted and the good film strength of the photoconductive layer is maintained.

Furthermore, it has been found that good photosensitivity can be obtained as compared with a random copolymer resin having acidic groups at random in the side chain bonded to the main chain of the polymer.

Since spectral sensitizing dyes which are used for giving light sensitivity in the region of visible light to infrared light have a function of sufficiently providing the spectral sensitizing action by adsorbing on photoconductive substance, it can be assumed that the binder resin containing the copolymer according to the present invention makes suitable interaction with the photoconductive substance without hindering the adsorption of spectral sensitizing dyes onto the photoconductive substance. This effect is particularly remarkable on cyanine dyes or phthalocyanine dyes which are particularly effective as spectral sensitizing dyes for the region of near infrared to infrared light.

Among the graft type copolymer according to the present invention, a low molecular weight copolymer having a weight average molecular weight of from $1\times10^3$ to $2\times10^4$ can be employed alone for the binder resin according to the present invention. In such a case, the copolymer sufficiently adsorbs onto the photoconductive substance to cover the surface thereof, whereby the photoconductive layer formed is excellent in the surface smoothness and electrostatic characteristics, image quality having no background stains is obtained, and further the layer maintains a sufficient film strength for a CPC light-sensitive materials or for an offset printing plate precursor giving several thousands of prints.

According to a preferred embodiment of the present invention, the binder resin contains the graft type copolymer which has a weight average molecular weight of from $1\times10^3$ to $2\times10^4$ (hereinafter referred to sometime as resin (AL)) and contains from 1 to 30% by weight of the acidic group-containing component and the graft type copolymer which has a weight average molecular weight of from $3\times10^4$ to $5\times10^5$ (hereinafter referred to sometime as resin (AH)) and contains from 0.1 to 10% by weight of the acidic group-containing component. A ratio of the resin (AL) to the resin (AH) is preferably 5 to 50/95 to 50 by weight.

More preferably, the resin (AL) has a weight average molecular weight of from $3\times10^3$ to $1\times10^4$ and contains from 3 to 15% by weight of the acidic group-containing component, and the resin (AH) has a weight average molecular weight of from $5\times10^4$ to $3\times10^5$ and contains from 0.5 to 5% by weight of the acidic group-containing component.

It is further preferred that a content of the acidic group-containing component contained in the resin (AH) is not more than 80% of a content of the acid group-containing component present in the resin (AL) used in combination, or the acidic group contained in the resin (AH) has a pKa higher than a pKa of the acidic group present in the resin (AL) used in combination.

That is, in the case of using the resin (AL) and the resin (AH) in combination, the strength of interaction between each of the resins and an inorganic photoconductive substance is controlled by means of the difference in the content of the acidic group-containing component contained in each of the resins or the difference in the pKa due to the difference of a kind of the acidic group present in each of the resins.

The resins (AH) of a high molecular weight used according to the preferred embodiment of the present invention serves to sufficiently increase the mechanical strength of the photoconductive layer without damaging the excellent electrophotographic characteristics achieved by the use of the resin (AL). More specifically, it is presumed that the resin (AH) has the strength of interaction with the inorganic photoconductive substance is controlled to a degree which does not damage the electrophotographic characteristics due to the resin (AL), and the long main molecular chain and the molecular chains of the graft portion in the resin (AH) mutually interact whereby the mechanical strength of the photoconductive layer is increased without damaging the excellent electrophotographic characteristics and the good performance on the oil-desensitizing treatment for using as an offset printing plate precursor.

In the present invention, of the monomers represented by the general formula (II) which is a component copolymerizable with the macromonomer (M), a monomer represented by the following general formula (IIa) or (IIb) is preferred.

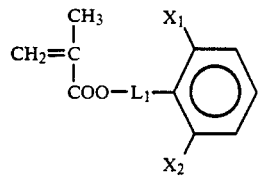
(IIa)

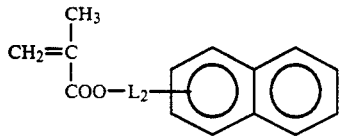
(IIb)

wherein $X_1$ and $X_2$ each, independently, represents a hydrogen atom, a hydrocarbon group having from 1 to 10 carbon atoms, a chlorine atom, a bromine atom, $-COZ_3$ or $-COOZ_3$ (wherein $Z_3$ represents a hydrocarbon group having from 1 to 10 carbon atoms); and $L_1$ and $L_2$ each represents a single bond or a linkage group having from 1 to 4 linking atoms, each connecting —COO— and the benzene ring.

The monomer represented by the general formula (IIa) or (IIb) is particularly preferably employed in the resin (AL) of a low molecular weight.

In case of using the resin (AL) containing the methacrylate monomer having a substituted benzene or naphthalene ring-containing substituent represented by the general formula (IIa) or (IIb), the electrophotographic characteristics, particularly, $V_{10}$, DRR and $E_{1/10}$ of the electrophotographic material can be furthermore improved. While the reason of this fact is not fully clear, it is believed that the polymer molecular chain of the resin (AL) suitably arranges on the surface of inorganic photoconductive substance such as zinc oxide in the layer depending on the plane effect of the benzene ring having a substituent at the ortho position or the naphthalen ring which is an ester component of the methacrylate whereby the above described improvement is achieved.

In the embodiment using the resin (AL) and the resin (AH) in combination, if the molecular weight of the resin (AL) is less than $1\times10^3$, the film-forming ability thereof is undesirably reduced, whereby the photoconductive layer formed cannot keep a sufficient film strength, while if the molecular weight thereof is larger than $2\times10^4$, the fluctuations of electrophotographic characteristics (in particular, initial potential and dark decay retention rate of the photoconductive layer become somewhat large and thus the effect for obtaining stable dupricate images according to the present invention is reduced under severe conditions of high temperature and high humidity or low temperature and low humidity.

If the molecular weight of the resin (AL) is less than $3\times10^4$, a sufficient film strength may not be maintained. On the other hand the molecular weight thereof is larger than $5\times10^5$, the dispersibility of the photoconductive substance is reduced, the smoothness of the photoconductive layer is deteriorated, and image quality of duplicated images (particularly reproducibility of fine lines and letters) is degraded. Further, the background stain increases in case of using as an offset master.

Further, if the content of the macromonomer in the resin (AL) or (AH) is less than 0.5% by weight, electrophotographic characteristics (particularly dark decay retention rate and photosensitivity) may be reduced and the fluctuations of electrophotographic characteristics of the photoconductive layer, particularly that containing a spectral sensitizing dye for the sensitization in the range of from near-infrared to infrared become large under severe conditions. The reason therefor is considered that the construction of the polymer becomes similar to that of a conventional homopolymer or random copolymer resulting from the slight amount of macromonomer portion present therein.

On the other hand, the content of the macromonomer in the resin is more than 50% by weight, the copolymerizability of the macromonomer with other monomers corresponding to other copolymerizable components may become insufficient, and the sufficient electrophotographic characteristics can not be obtained as the binder resin.

The mono-functional macromonomer (M) which can be employed in the graft type copolymer according to the present invention is described in greater detail below.

The acidic group contained in a component which constitutes the A block of the macromonomer (M) includes $-PO_3H_2$, —COOH, $-SO_3H$, a phenolic hydroxy group,

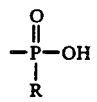

(R represents a hydrocarbon group or —OR′ (wherein R′ represents a hydrocarbon group)), and a cyclic acid anhydride-containing group, and the preferred acidic groups are —COOH, $-SO_3H$, a phenolic hydroxy group and

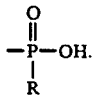

In the acidic group

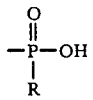

above, R represents a hydrocarbon group or OR', wherein R' represents a hydrocarbon group. The hydrocarbon group represented by R or R' preferably includes an aliphatic group having from 1 to 22 carbon atoms (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and a substituted or unsubstituted aryl group (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

The cyclic acid anhydride-containing group is a group containing at least one cyclic acid anhydride. The cyclic acid anhydride to be contained includes aliphatic dicarboxylic acid anhydrides and aromatic dicarboxylic acid anhydrides.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphthalene-dicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

Compounds containing the phenolic hydroxy group include methacrylic acid esters or amides each containing a hydroxyphenyl group as a substituent.

The polymerizable component containing the specific acidic group may be any of acidic group-containing vinyl compounds copolymerizable with a monomer corresponding to a copolymerizable component constituting the B block of the macromonomer (M), for example, the methacrylate component represented by the general formula (II). Examples of such vinyl compounds are described, e.g., in Kobunshi Gakkai (ed.), *Kobunshi Data Handbook (Kisohen),* Baihukan (1986). Specific examples of these vinyl monomers include acrylic acid, α and/or β-substituted acrylic acids (e.g., α-acetoxy, α-acetoxymethyl, α-(2-amino)ethyl, α-chloro, α-bromo, α-fluoro, α-tributylsilyl, α-cyano, β-chloro, β-bromo, α-chloro-β-methoxy, and α,β-dichloro compounds), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, dicarboxylic acid vinyl or allyl half esters, and ester or amide derivatives of these carboxylic acids or sulfonic acids containing the acidic group in the substituent thereof.

Specific examples of the acidic group-containing copolymerizable components are set forth below, but the present invention should not be construed as being limited thereto. In the following examples, a represents —H, —$CH_3$, —Cl, —Br, —CN, —$CH_2COOCH_3$, or —$CH_2COOH$; b represents —H or —$CH_3$, n represents an integer of from 2 to 18; m represents an integer of from 1 to 12; and l represents an integer of from 1 to 4.

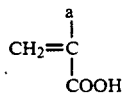

(a-1)

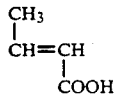

(a-2)

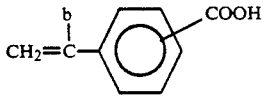

(a-3)

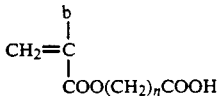

(a-4)

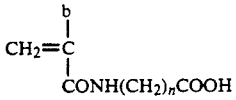

(a-5)

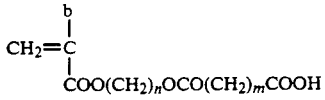

(a-6)

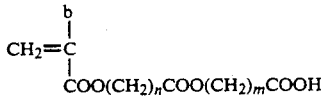

(a-7)

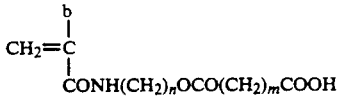

(a-8)

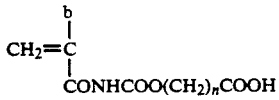

(a-9)

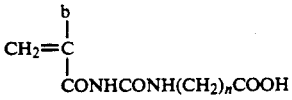

(a-10)

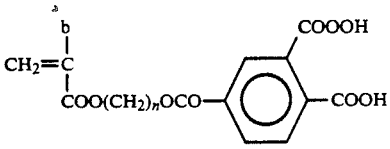

(a-11)

-continued
(a-12)
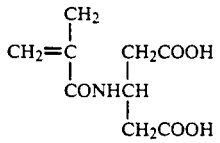
(a-13)
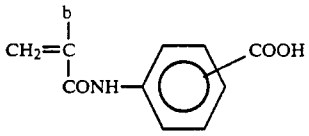
(a-14)
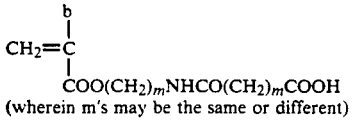
(wherein m's may be the same or different)
$CH_2=CH-CH_2OCO(CH_2)_mCOOH$ (a-15)
$CH_2=CH\text{-}(CH_2)_7COOH$ (a-16)
(a-17)
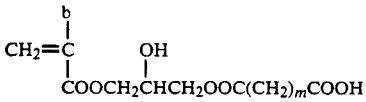
(a-18)
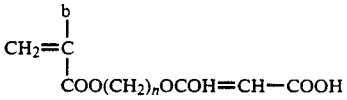
(a-19)
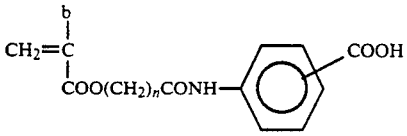
(a-20)
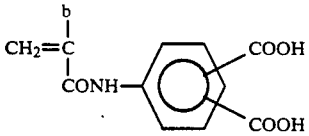
(a-21)
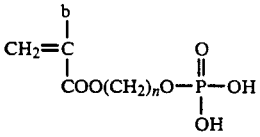
(a-22)
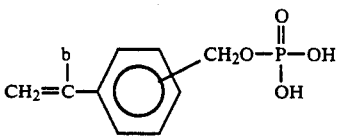
(a-23)
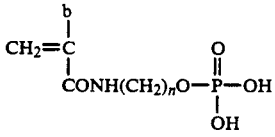
(a-24)
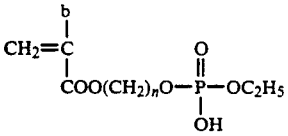
-continued
(a-25)
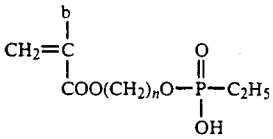
(a-26)
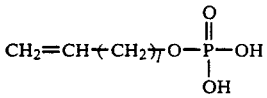
(a-27)
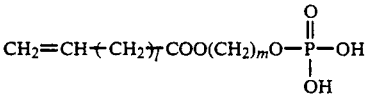
(a-28)
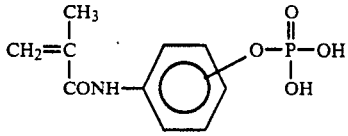
(a-29)
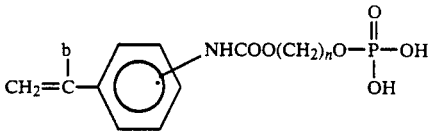
(a-30)
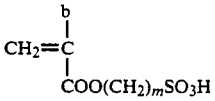
(a-31)
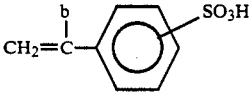
(a-32)
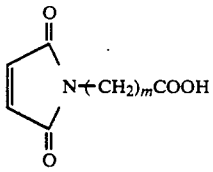
(a-33)
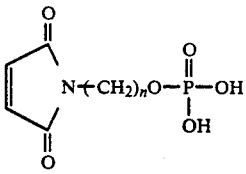
(a34)
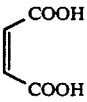
(a35)
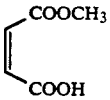
(a-36)
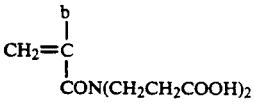

-continued (a-37)

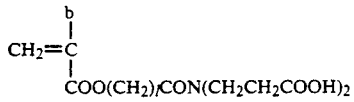

(a-38)

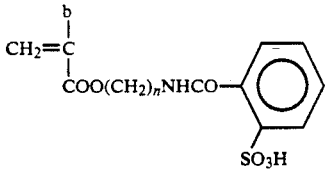

(a-39)

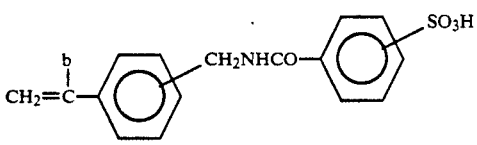

(a-40)

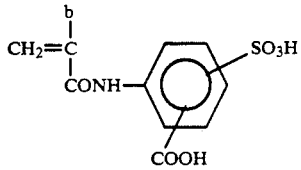

(a-41)

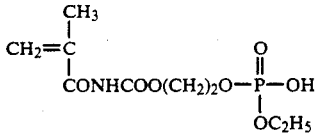

(a-42)

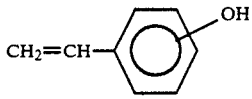

(a-43)

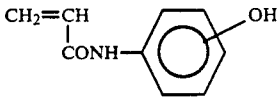

(a-44)

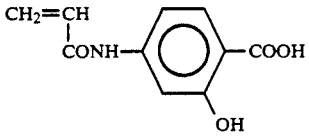

(a-45)

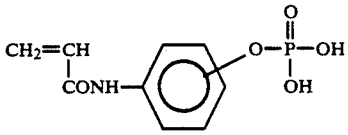

Two or more kinds of the above-described polymerizable components each containing the specific acidic group can be included in the A block. In such a case, two or more kinds of these acidic group-containing polymerizable components may be present in the form of a random copolymer or a block copolymer.

Also, other components having no acidic group may be contained in the A block, and examples of such components include the components represented by the general formula (I) described in detail below. The content of the component having the acidic group in the A block is preferably from 30 to 100% by weight.

Now, the polymerizable component represented by the general formula (I) constituting the B block in the mono-functional macromonomer of the graft type copolymer used in the present invention will be explained in more detail below.

In the general formula (I), $V_1$ represents —COO—, —OCO—, $—CH_{2l_1}COO—$, $—CH_{2l_2}COO—$(wherein $l_1$ and $l_2$ each represents an integer of from 1 to 3), —O—, $SO_2$—, —CO—,

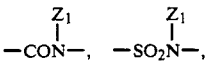

—CONHCOO—, —CONHCONH—, or

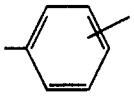

(wherein $Z_1$ represents a hydrogen atom or a hydrocarbon group).

Preferred examples of the hydrocarbon group represented by $Z_1$ include an alkyl group having from 1 to 18 carbon atoms which may be substituted (e.g., methyl, ethyl, propyl, butyl, pentyl, hexyl, heptyl octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-porpenyl, 2-butenyl, 2-pentenyl, 3-methyl-2-pentenyl, 1-pentenyl, 1-hexenyl, 2-hexenyl, and 4-methyl-2-hexcenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

In the general formula (I), $R_1$ represents a hydrocarbon group, and preferred examples thereof include those described for $Z_1$. When $V_1$ represents

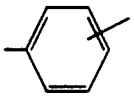

in the general formula (I), $R_1$ represents a hydrogen atom or a hydrocarbon group.

When $X_1$ represents

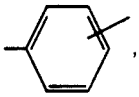

the benzene ring may be further substituted. Suitable examples of the substituents include a halogen atom (e.g., chlorine, and bromine), an alkyl group (e.g., methyl, ethyl, propyl, butyl, chloromethyl, and methoxymethyl), and an alkoxy group (e.g., methoxy, ethoxy, propoxy, and butoxy).

In the general formula (I), $a_1$ and $a_2$, which may be the same or different, each preferably represents a hydrogen atom, a halogen atom (e.g., chlorine, and bromine), a cyano group, an alkyl group having from 1 to carbon atoms (e.g., methyl, ethyl, propyl, and butyl), —COO—$Z_2$ or —COO—$Z_2$ bonded via a hydrocarbon group, wherein $Z_2$ represents a hydrogen atom or a hydrocarbon group (preferably an alkyl group, an alkenyl group, an aralkyl group, an alicyclic group or an aryl group, each of which may be substituted). More specifically, the examples of the hydrocarbon groups for $Z_2$ are those described for $Z_1$ above. The hydrocarbon group via which —COO—$Z_2$ is bonded includes, for example, a methylene group, an ethylene group, and a propylene group.

More preferably, in the general formula (I), $V_1$ represents —COO—, —OCO—, —$CH_2$OCO—, —$CH_2$COO—, —O—, —CONH—, —$SO_2$HN— or

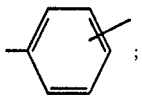

;

and $a_1$ and $a_2$, which may be the same or different, each represents a hydrogen atom, a methyl group, —$COOZ_2$, or —$CH_2COOZ_2$, wherein $Z_2$ represents a hydrogen atom or an alkyl group having from 1 to 6 carbon atoms (e.g., methyl, ethyl, propyl, butyl, and hexyl) Most preferably, either one of $a_1$ and $a_2$ represents a hydrogen atom.

Further, the B block may contain polymerizable components other than those represented by the general formula (I).

Suitable examples of monomer corresponding to the repeating unit copolymerizable with the polymerizable component represented by the general formula (I), as a polymerizable component in the B block include acrylonitrile, methacrylonitrile and heterocyclic vinyl compounds (e.g., vinylpyridine, vinylimidazole, vinylpyrrolidone, vinylthiophene, vinylpyrazole, vinyldioxane, and vinyloxazine). Such other monomers are employed in a range of not more than 20 parts by weight per 100 parts by weight of the total polymerizable components in the B block.

Further, it is preferred that the B block does not contain the polymerizable component containing an acidic group which is a component constituting the A block.

When the B block contains two or more kinds of the polymerizable components, these polymerizable components may be contained in the B block in the form of a random copolymer or a block copolymer, but are preferably contained at random therein in view of the simple synthesis thereof.

As described above, the macromonomer (M) to be used in the present invention has a structure of the AB block copolymer in which a polymerizable double bond-containing group is bonded to one of the terminals of the B block composed of the polymerizable component represented by the general formula (I) and the other terminal thereof is connected to the A block composed of the polymerizable component containing the acidic group. The polymerizable double bond-containing group will be described in detail below.

Suitable examples of the polymerizable double bond-containing group include those represented by the following general formula (III):

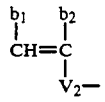

(III)

wherein $V_2$ has the same meaning as $V_1$ defined in the general formula (I), and $b_1$ and $b_2$, which may be the same or different, each has the same meaning as $a_1$ and $a_2$ defined in the general formula (I).

Specific examples of the polymerizable double bond-containing group represented by the general formula (III) include

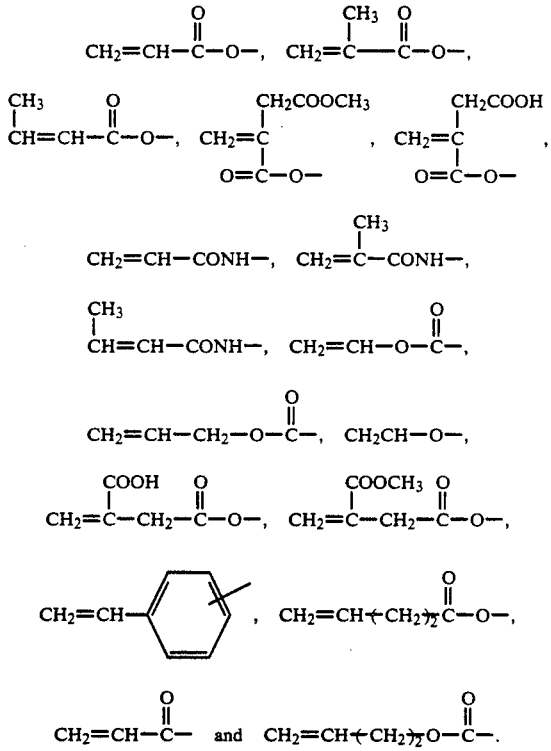

The macromonomer (M) used in the present invention has a structure in which a polymerizable double bond-containing group preferably represented by the general formula (III) is bonded to one of the terminals of the B block either directly or through an appropriate linking group.

The linking group which can be used includes a carbon-carbon bond (either single bond or double bond), a carbon-hetero atom bond (the hetero atom includes, for example, an oxygen atom, a sulfur atom, a nitrogen atom, and a silicon atom), a hetero atom-hetero atom bond, and an appropriate combination thereof.

More specifically, the linkage between the polymerizable double bond-containing group and the terminal of the B block include a mere bond and a linking group selected from

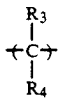

(wherein $R_3$ and $R_4$ each represents a hydrogen atom, a halogen atom (e.g., fluorine, chlorine, and bromine), a cyano group, a hydroxyl group, or an alkyl group (e.g., methyl, ethyl, and propyl),

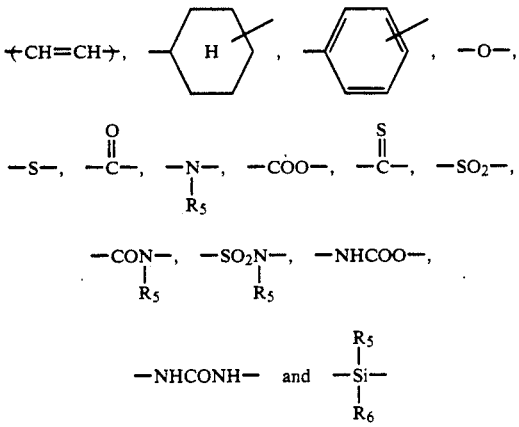

(wherein $R_5$ and $R_6$ each represents a hydrogen atom or a hydrocarbon group having the same meaning as defined for $R_1$ in the general formula (I) described above), and an appropriate combination thereof.

If the weight average molecular weight of the macromonomer (M) exceeds $2\times10^4$, copolymerizability with other monomers, for example, those represented by the general formula (II) is undesirably reduced. If, on the other hand, it is too small, the effect of improving electrophotographic characteristics of the light-sensitive layer would be small. Accordingly, the macromonomer (M) preferably has a weight average molecular weight of at least $1\times10^3$.

The macromonomer (M) used in the present invention can be produced by a conventionally known synthesis method. More specifically, it can be produced by the method comprising previously protecting the acidic group of a monomer corresponding to the polymerizable component having the specific acidic group to form a functional group, synthesizing an AB block copolymer by a so-called known living polymerization reaction, for example, an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a group transfer polymerization reaction, introducing a polymerizable double bond-containing group into the terminal of the resulting living polymer by a reaction with a various kind of reagent, and then conducting a protection-removing reaction of the functional group which has been formed by protecting the acidic group by a hydrolysis reaction, a hydrogenolysis reaction, an oxidative decomposition reaction, or a photodecomposition reaction to form the acidic group.

An example thereof is shown by the following reaction scheme (1)

Reaction Scheme (1)

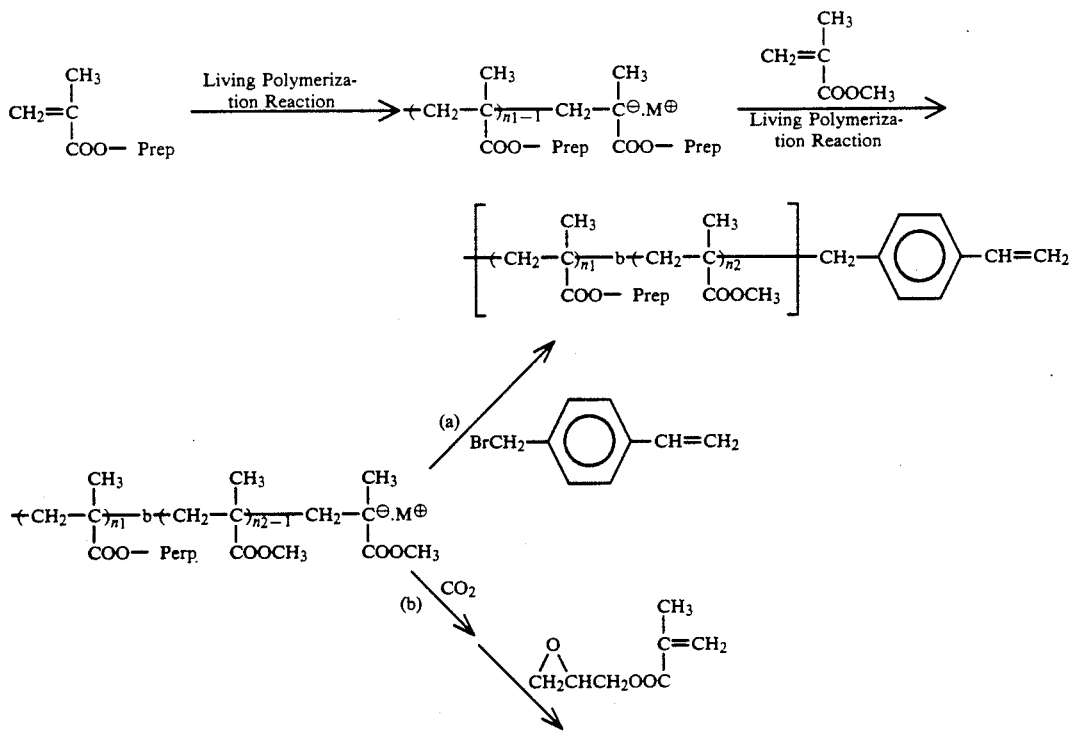

-continued

Reaction Scheme (1)

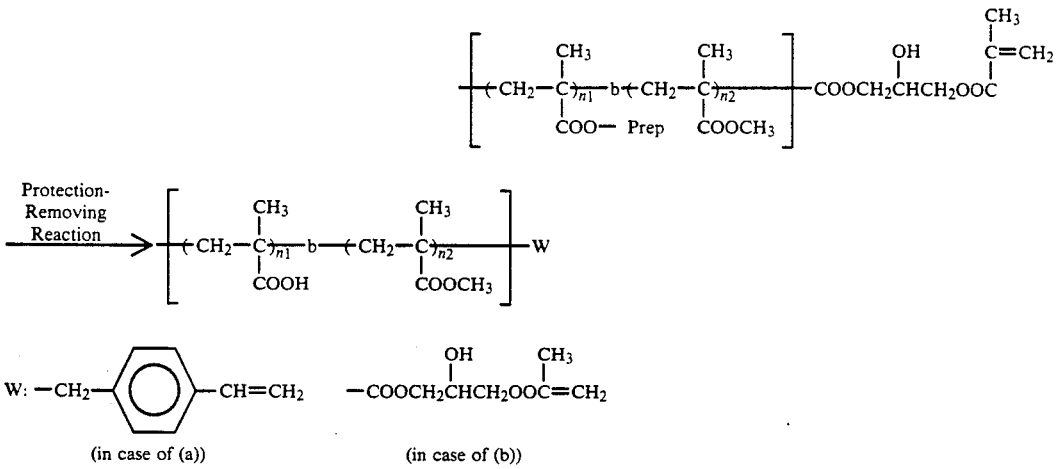

Prep : Protective group for —COOH,

—b—: "—b" represents that each of the repeating units bonded to —b— is present in the form of a block polymer component (hereinafter the same).

$n_1$, $n_2$: repeating unit

The living polymer can be easily synthesized according to synthesis methods as described, e.g., in P. Lutz, P. Masson et al, *Polym. Bull.*, 12, 79 (1984), B.C. Anderson, G. D. Andrews et al, *Macromolecules*, 14, 1601 (1981), K. Hatada, K. Ute et al, *Polym. J.*, 17, 977 (1985), ibid., 18, 1037 (1986), Koichi Migite and Koichi Hatada, *Kobunshi Kako* (*Polymer Processing*), 36, 366 (1987), Toshinobu Higashimura and Mitsuo Sawamoto, *Kobunshi Ronbun Shu* (*Polymer Treatises*), 46, 189 (1989), M. Kuroki and T. Aida, *J. Am. Chem. Soc.*, 109, 4737 (1987), Teizo Aida and Shohei Inoue, Yuki Gosei Kagaku (*Organic Synthesis Chemistry*), 43, 300 (1985), and D. Y. Sogoh, W. R. Hertler et al, *Macromolecules*, 20, 1473 (1987)

In order to introduce a polymerizable double bond-containing group into the terminal of the living polymer, a conventionally known synthesis method for macromonomer can be employed.

For details, reference can be made, for example, to P. Dreyfuss and R. P. Quirk, *Encycl. Polym. Sci. Eng.*, 7, 551 (1987), P. F. Rempp and E. Franta, *Adv. Polym. Sci.*, 58, 1 (1984), V. Percec, *Appl. Polym. Sci.*, 285, 95 (1984), R. Asami and M. Takari, *Makromol. Chem. Suppl.*, 12, 163 (1985), P. Rempp et al., *Makromol. Chem. Suppl*, 8, 3 (1984), Yushi Kawakami, *Kogaku Kogyo*, 38, 56 (1987), Yuya Yamashita, *Kobunshi*, 31, 988 (1982), Shiro Kobayashi, *Kobunshi*, 30, 625 (1981), Toshinobu Higashimura, *Nippon Secchaku Kyokaishi*, 18, 536 (1982), Koichi Itoh, *Kobunshi Kako*, 35, 262 (1986), Kishiro Higashi and Takashi Tsuda, *Kino Zairyo*, 1987, No. 10, 5, and references cited in these literatures.

Also, the protection of the specific acidic group of the present invention and the release of the protective group (a reaction for removing a protective group) can be easily conducted by utilizing conventionally known knowledges. More specifically, they can be preformed by appropriately selecting methods as described, e.g., in Yoshio Iwakura and Keisuke Kurita, *Hannosei Kobunshi* (*Reactive Polymer*), published by Kodansha (1977), T. W. Greene, *Protective Groups in Organic Synthesis*, published by John Wiley & Sons (1981), and J. F. W. McOmie, *Protective Groups in Organic Chemistry*, Plenum Press (1973), as well as methods as described in the above references.

Furthermore, the AB block copolymer can be also synthesized by a photoiniferter polymerization method using a dithiocarbamate compound as an initiator. For example, the block copolymer can be synthesized according to synthesis methods as described, e.g., in Takayuki Otsu, *Kobunshi* (*Polymer*), 37, 248 (1988), Shunichi Himori and Ryuichi Ohtsu, *Poly, Rep. Jap.*, 37, 3508 (1988), JP-A-64-111, and JP-A-64-26619.

The macromonomer (M) according to the present invention can be obtained by applying the above described synthesis method for macromonomer to the AB block copolymer.

Specific examples of the macromonomer (M) which can be used in the present invention are set forth below, but the present invention should not be construed as being limited thereto. In the following formulae, c, d and e each represents —H, —$CH_3$ or —$CH_2COOCH_3$; f represents —H or —$CH_3$; $R_{11}$ represents —$C_pH_{pn+1}$ (wherein p represents an integer of from 1 to 18),

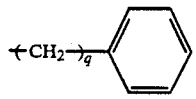

(wherein q represents an integer of from 1 to 3),

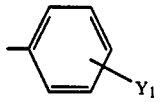

(wherein $Y_1$ represents —H, —Cl, —Br, —$CH_3$, —$OCH_3$ or —$COCH_3$) or

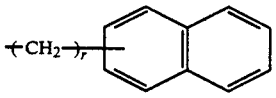

(wherein r represents an integer of from 0 to 3); $R_{12}$ represents $-C_2H_{2s+1}$ (wherein s represents an integer of from 1 to 8) or
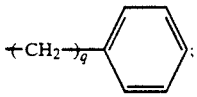
$Y_2$ represents —OH, —COOH, $-SO_3H$,
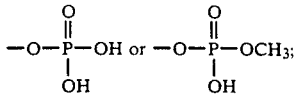
$Y_2$ represents —COOH, $-SO_3H$,
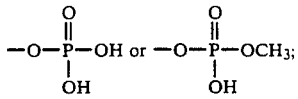
represents an integer of from 2 to 12; and u represents an integer of from 2 to 6.
(M-1)
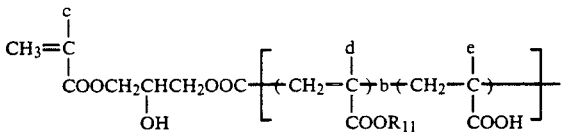
(M-2)
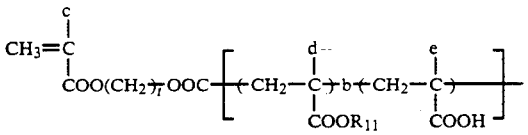
(M-3)
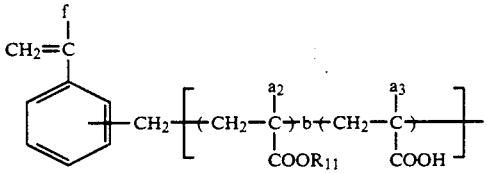
(M-4)
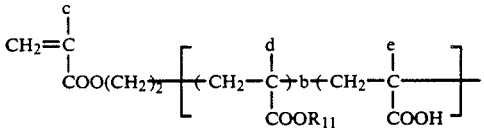
(M-5)
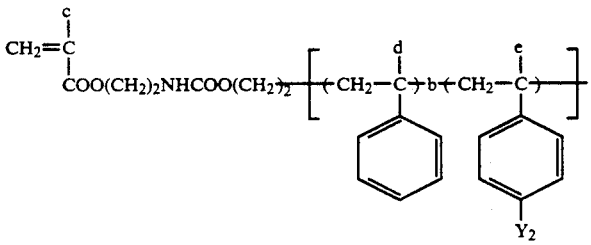
(M-6)
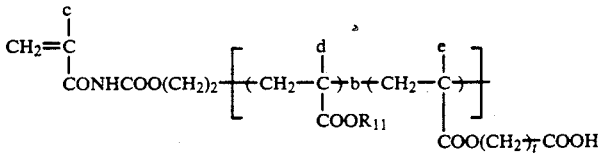

-continued
(M-7)
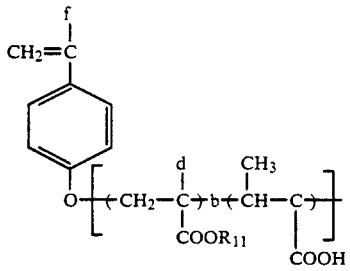
(M-8)
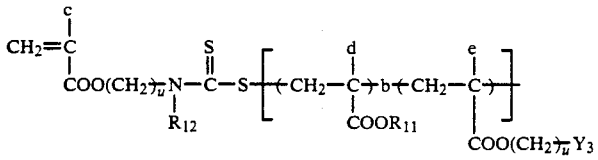
(M-9)
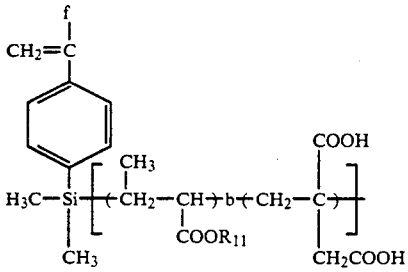
(M-10)
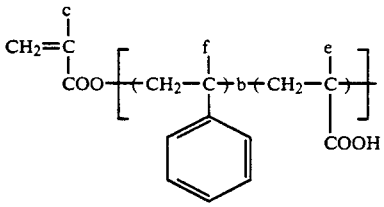
(M-11)
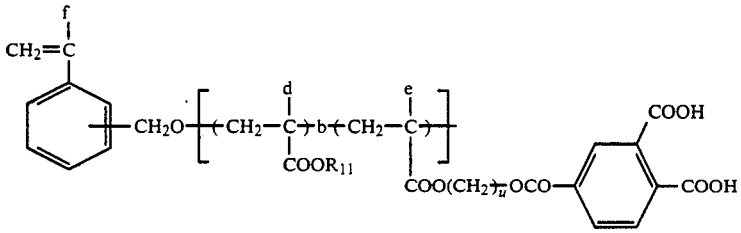
(M-12)
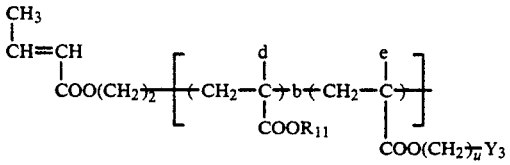
(M-13)
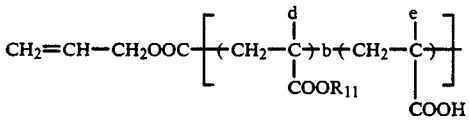
(M-14)
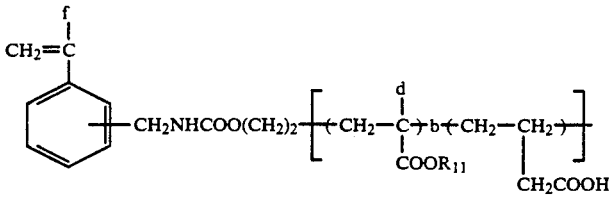

-continued

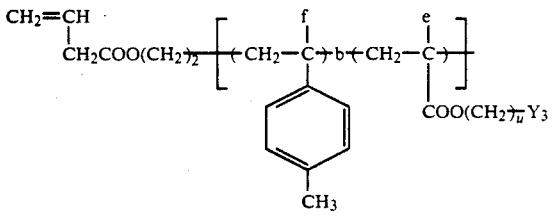

(M-15)

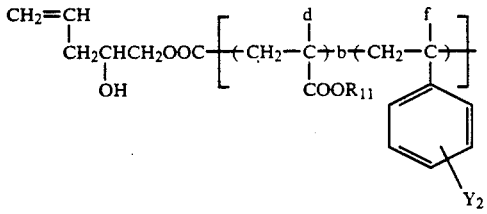

(M-16)

The monomer copolymerizable with the macromonomer (M) described above is preferably selected from those represented by the general formula (II). In the general formula (II), $R_2$ has the same meaning as defined for $R_1$ in the general formula (I) as described above.

As described above, the resin (AL) of a low molecular weight according to the present invention preferably contains, as a copolymerizable component, a methacrylate component having a specific substituent containing a benzene ring which has a specific substituent(s) at the 2-position or 2- and 6-positions thereof or a specific substituent containing an unsubstituted naphthalene ring represented by the general formula (IIa) or (IIb).

In the general formula (IIa), $X_1$ and $X_2$ each preferably represents a hydrogen atom, a chlorine atom, a bromine atom, an alkyl group having from 1 to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e.g., phenyl, tolyl, xylyl, bromophenyl, methoxyphenyl, chlorophenyl, and dichlorophenyl), or $—COZ_3$ or $—COOZ_3$, wherein $Z_3$ preferably represents any of the above-recited hydrocarbon groups.

In the general formula (IIa), $L_1$ is a mere bond or a linkage group containing from 1 to 4 linking atoms which connects between —COO— and the benzene ring, e.g., $CH_{2m1}$ (wherein $m_1$ represents an integer of 1, 2 or 3, $—CH_2CH_2OCO—$, $CH_2O_{m2}$ (wherein $m_2$ represents an integer of 1 or 2, and $—CH_2CH_2O—$.

In the general formula (IIb), $L_2$ has the same meaning as $L_1$ in the general formula (IIa).

Specific examples of monomer represented by the general formula (IIa) or (IIb) which are used in the present invention are set forth below, but the present invention is not to be construed as being limited thereto.

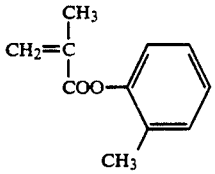

II-1)

-continued

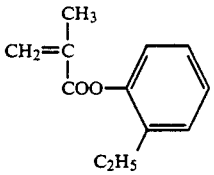

II-2)

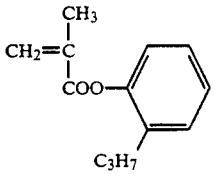

II-3)

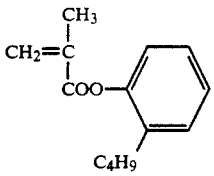

II-4)

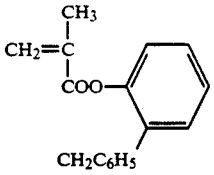

II-5)

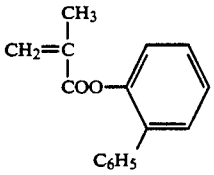

II-6)

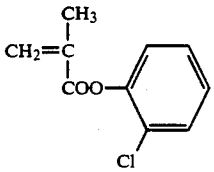

II-7)

-continued
II-8)
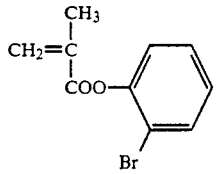
II-9)
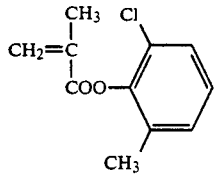
II-10)
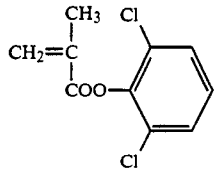
II-11)
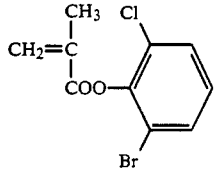
II-12)
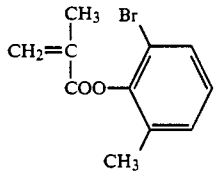
II-13)
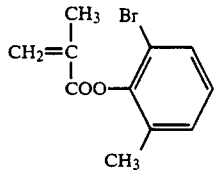
II-14)
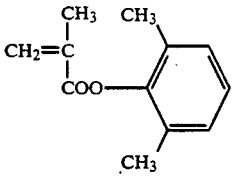
II-15)
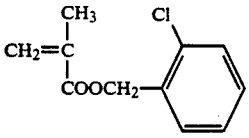
II-16)
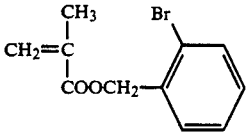
-continued
II-17)
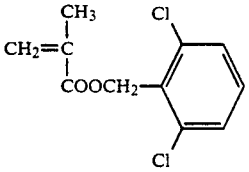
II-18)
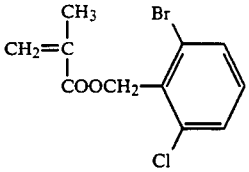
II-19)
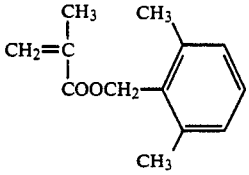
II-20)
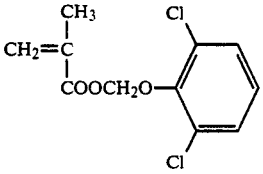
II-21)
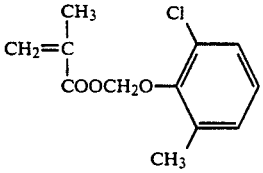
II-22)
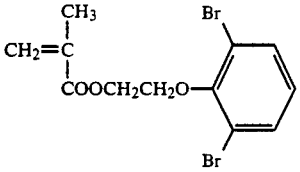
II-23)
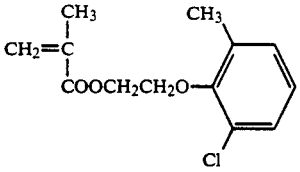
II-24)
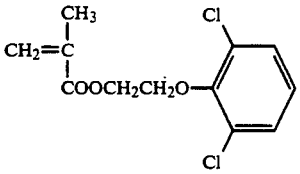
II-25)
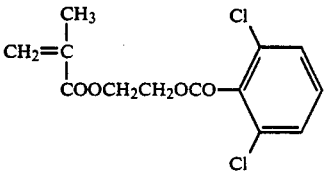

-continued
II-26)
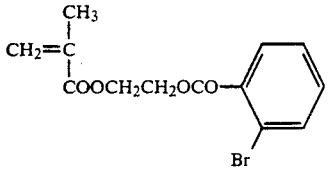
II-27)
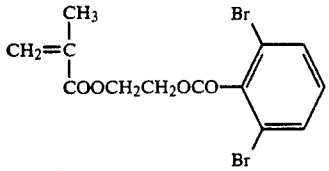
II-28)
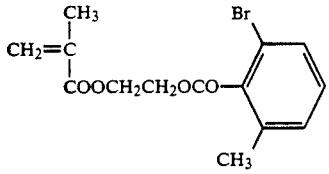
II-29)
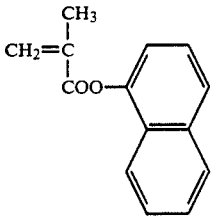
II-30)
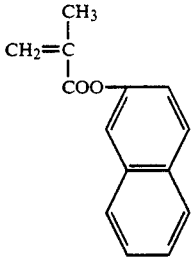
II-31)
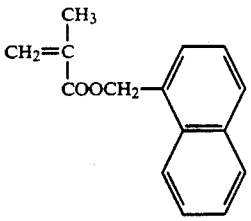
II-32)
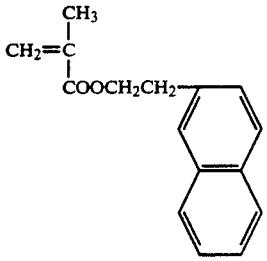
-continued
II-33)
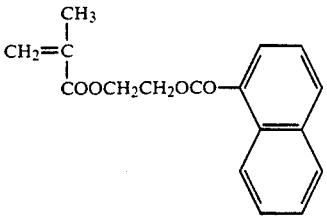
II-34)
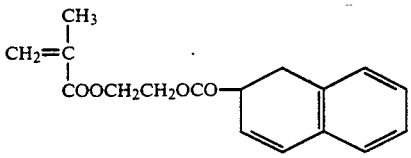
II-35)
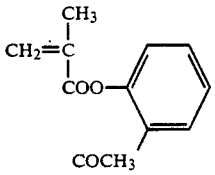
II-36)
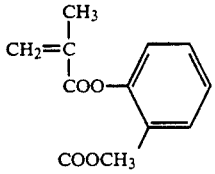
II-37)
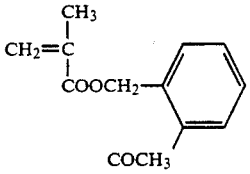
II-38)
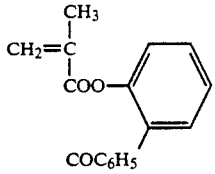
II-39)
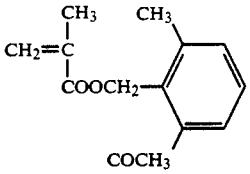
II-40)
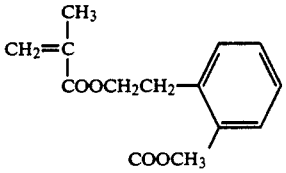
Monomers other than those represented by the general formula (II) (including those represented by the general formula (IIa) or (IIb)) may be employed as a component copolymerizable with the macromonomer (M) in the graft type copolymer according to the present invention. Examples of such monomers include, α-olefins, vinyl or allyl esters of alkanoic acids, acrylonitrile, methacrylonitrile, vinyl ethers, acrylamides, methacrylamides, styrenes, and heterocyclic vinyl compounds (for example, those containing a 5-membered to 7-membered heterocyclic ring containing from 1 to 3 non-metallic atoms other than a nitrogen atom (e.g., oxygen, and sulfur), specifically including vinylthiophene, vinyldioxane, and vinylfuran). Preferred examples thereof include vinyl or allyl esters of alkanoic acid having from 1 to 3 carbon atoms, acrylonitrile, methacrylonitrile, styrene and styrene derivatives (e.g., vinyltoluene, butylstyrene, methoxystyrene, chlorostyrene, dichlorostyrene, bromostyrene, and ethoxystyrene).

Further, the resin (AL) according to the present invention preferably contains a functional group capable of curing the resin by the action of at least one of heat and light, i.e., a heat- and/or photo-curable functional group. Specifically, it is preferred that the resin (AL) used in the present invention contains a copolymerizable component containing a heat- and/or photo-curable functional group, in addition to the copolymerizable components corresponding to the macromonomer (M) and other monomers (for example, those represented by the general formula (II), preferably those represented by the general formula (IIa) or (IIb) respectively, in order to improve the film strength and thereby to increase the mechanical strength of the electrophotographic light sensitive material.

The content of the above described copolymerizable component containing a heat- and/or photo-curable functional group in the resin (AL) of the present invention is preferably from 1 to 30% by weight, more preferably from 5 to 20% by weight. When the content is less than 1% by weight, any appreciable effect on improvement in the film strength of the photoconductive layer is not obtained due to insufficient curing reaction. On the other hand, when the content exceeds 30% by weight, the excellent electrophotographic characteristics are difficult to retain and are decreased near level to those obtained by conventional resin binders. Also, the offset master produced from the resin (AL) containing more than 30% by weight of the heat- and/or photo-curable functional group suffers from the occurrence of background stains in the non-image area in prints.

Specific examples of the photo-curable functional group include those used in conventional photosensitive resins known as photo-curable resins as described, for example, in Hideo Inui and Gentaro Nagamatsu, *Kankosei Kobunshi,* Kodansha (1977), Takahiro Tsunoda, *Shin-Kankosei Jushi,* Insatsu Gakkai Shuppanbu (1981), Kiyomi Sato, *Shigaisen Koka System,* Chs. 5 to 7, Sogo Gijutsu Center (1989), G. E. Green and B. P. Strark, *J. Macro. Sci. Reas. Macro. Chem.,* C 21(2), 187-273 (1981-1982), and C. G. Rattey, *Photopolymerization of Surface Coatings,* A. Wiley Interscience Pub. (1982).

The heat-curable functional group which can be used includes functional groups other than the above-specified acidic groups. Examples of the heat-curing functional groups are described, for example, Tsuyoshi Endo, *Netsukokasei Kobunshi no Seimitsuka,* C.M.C. (1986), Yuji Harasaki, *Saishin Binder Gijutsu Binran,* Ch. II-I, Sogo Gijutsu Center (1985), Takayuki Ohtsu, *Acryl Jushi no Gosei Sekkei to Shin-Yotokaihatsu,* Chubu Kei-ei Kaihatsu Center Shuppanbu (1985), and Eizo Ohmori, *Kinosei Acryl Jushi,* Techno System (1985).

Specific examples of the heat-curable functional groups which can be used includes —OH, —SH, $—NH_2$ $—NHR_7$ (wherein $R_7$ represents a hydrocarbon group, for example, an alkyl group having from 1 to 10 carbon atoms which may be substituted (e.g., methyl, ethyl, propyl, butyl, hexyl, octyl, decyl, 2-chloroethyl, 2-methoxyethyl, and 2-cyanoethyl), a cycloalkyl group having from 4 to 8 carbon atoms which may be substituted (e.g., cyclobutyl, and cyclohexyl), an aralkyl group having from 7 to 12 carbon atoms which may be substituted (e.g., benzyl, phenethyl, 3-phenylpropyl, chlorobenzyl, methylbenzyl, and methoxybenzyl and an aryl group which may be substituted (e.g., phenyl, tolyl, xylyl, chlorophenyl, bromo phenyl, methoxyphenyl, and naphthyl)),

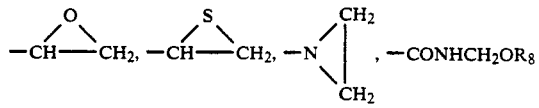

(wherein $R_8$ represents a hydrogen atom or an alkyl group having from 1 to 8 carbon atoms (e.g., methyl, ethyl, propyl, butyl, hexyl, and octyl), —N=C=O, and

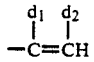

(wherein $d_1$ and $d_2$ each represents a hydrogen atom, a halogen atom (e.g., chlorine, and bromine) or an alkyl group having from 1 to 4 carbon atoms (e.g., methyl, and ethyl)). Also, specific examples of the groups containing a polymerizable double bond include

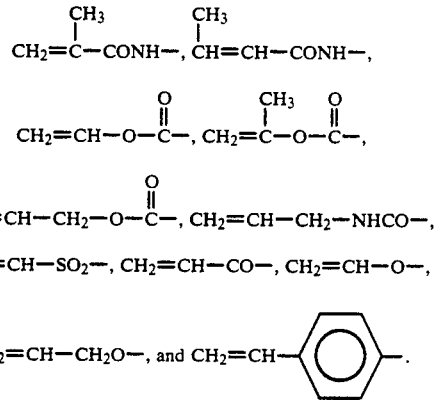

Examples of the repeating unit containing a heat- and/or photo-curable functional group are set forth below. In the examples, b represents —H or $—CH_3$, c represents —H, $—CH_3$ or $—CH_3COOCH_3$, $R_{21}$ represents $—CH=CH_2$ or $—CH_2CH=CH_2$, $R_{22}$ represents

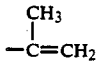

or $—CH=CHCH_3$, $R_{23}$ represents $—CH_2CH=CH_2$ or

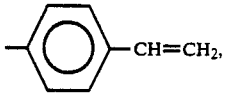

$R_{24}$ represents —CH=$CH_2$,

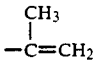

or —CH=$CHCH_3$, $R_{25}$ represents —CH=$CH_2$,

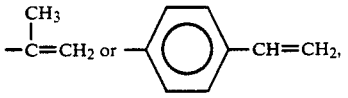

$R_{26}$ represents an alkyl group having from 1 to 4 carbon atoms, $Q_1$ represents —S— or —O—, and $Q_2$ represents —OH or —$NH_2$, v represents an integer of from 1 to 11, x represents an integer of from 1 to 10, y represents an integer of from 1 to 4, and z represents an integer of from 2 to 11.

ii-1)

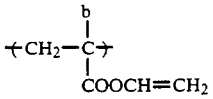

ii-2)

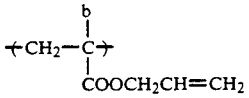

ii-3)

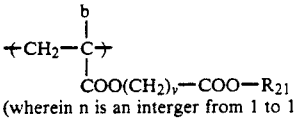

(wherein n is an interger from 1 to 11)

ii-4)

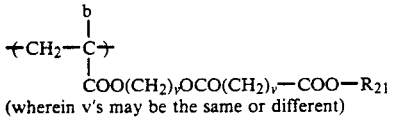

(wherein v's may be the same or different)

ii-5)

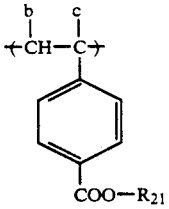

ii-6)

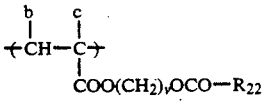

ii-7)

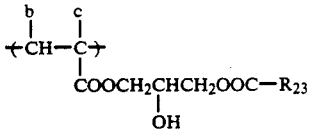

ii-8)

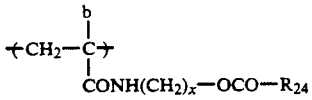

-continued ii-9)

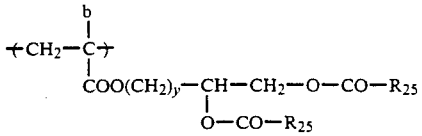

(wherein $R_{25}$'s may be the same or different)

ii-10)

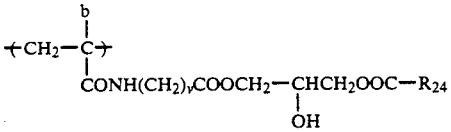

ii-11)

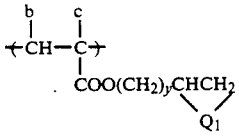

ii-12)

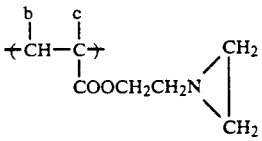

ii-13)

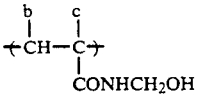

ii-14)

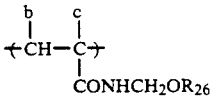

ii-15)

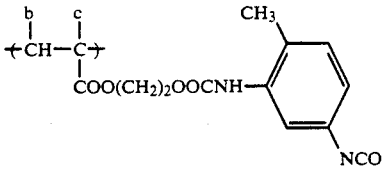

ii-16)

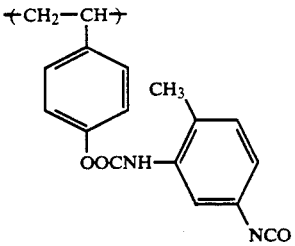

ii-17)

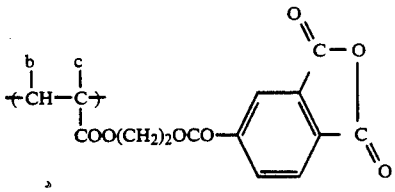

ii-18)

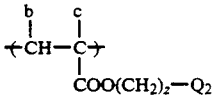

-continued ii-19) 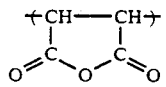

ii-20) 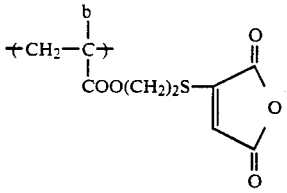

ii-21) 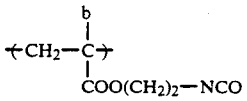

ii-22) 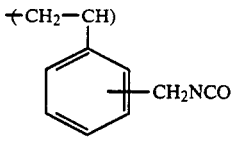

The binder resin according to the present invention can be produced by copolymerization of at least one compound each selected from the macromonomers (M) and other monomers (for example, those represented by the general formula (II)) in the desired ratio. The copolymerization can be performed using a known polymerization method, for example, solution polymerization, suspension polymerization, precipitation polymerization, and emulsion polymerization. More specifically, according to the solution polymerization monomers are added to a solvent such as benzene or toluene in the desired ratio and polymerization with an azobis compound, a peroxide compound or a radical polymerization initiator to prepare a copolymer solution. The solution is dried or added to a poor solvent whereby the desired copolymer can be obtained. In case of suspension polymerization, monomers are suspended in the presence of a dispersing agent such as polyvinyl alcohol or polyvinyl pyrrolidone and copolymerized with a radical polymerization initiator to obtain the desired copolymer.

In the production of the resin according to the present invention, the molecular weight thereof can be easily controlled by selecting a kind of initiator (a half-life thereof being varied depending on temperature), an amount of initiator, a starting temperature of the polymerization, and co-use of chain transfer agent, as conventionally known.

According to another preferred embodiment of the present invention, the binder resin contains at least one of a heat- and/or photo-curable resin (hereinafter referred to as resin (B)) and a crosslinking agent in addition to the resin (AL). In such an embodiment, a film strength of the electrophotographic light-sensitive material is further improved without damaging the excellent electrophotographic characteristics due to the resin (AL). The resin (B) and the crosslinking agent can be employed individually or as a combination thereof.

The resin (B) which can be used is a heat- and/or photo-curable resin having a crosslinking functional group, i.e., a functional group of forming a crosslinkage between polymers by causing a crosslinking reaction by the action of at least one of heat and light in a layer, and, preferably, a resin which is capable of forming a cross-linked structure by reacting with the above-described functional group which can be contained in the resin (AL).

That is, a reaction which causes bonding of molecules by a condensation reaction, an addition reaction, etc., or crosslinking by a polymerization reaction by the action of heat and/or light is utilized.

The heat-curable functional group include, specifically, a group composed of at least one combination of a functional group having a dissociating hydrogen atom (e.g., —OH, —SH, and —$NHR_{31}$ (wherein $R_{31}$ represents a hydrogen atom, an aliphatic group having from 1 to 12 carbon atoms, which may be substituted, and an aryl group which may be substituted) and a functional group selected from

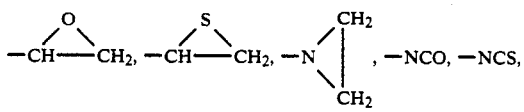

and a cyclic dicarboxylic acid anhydride; —$CONHCH_2OR_{32}$ ($R_{32}$ represents a hydrogen atom or an alkyl group having from 1 to 6 carbon atoms (e.g., methyl, ethyl, propyl, butyl, and hexyl)); and a polymerizable double bond group.

The functional group having a dissociating hydrogen atom include, preferably, —OH, —SH, and —$NHR_{31}$.

Specific examples of the polymerizable double bond group and the photo-curable functional group are those of the groups described for the heat- and/or photo-curable functional group which may be contained in the above-described resin (AL).

Polymers and copolymers each having the above described functional group are illustrated as examples of the resin (B) according to the present invention.

Specific examples of such polymers or copolymers are described in Tsuyoshi Endo, *Netsukokasei Kobunshi no Seimitsuka* (*Precising of Thermo-setting Macromolecule*, C.M.C. (1986), Yuji Harasaki, *Newest Binder Technology Handbook*, Chapter II-1, Sogo Gijutsu Center (1985), Takayuki Ohtsu, *Synthesis, Planning, and New Use Development of Acrylic Resins*, Chubu Keiei Kaihatsu Center Shuppan Bu (1985), and Eizo Ohmori, *Functional Acrylic Resins*, Techno System (1985). Specific examples thereof include polyester resins, unmodified epoxy resins, polycarbonate resins, vinyl alkanoate resins, modified polyamide resins, phenol resins, modified alkyd resins, melamine resins, acryl resins and styrene resin, and these resins have the above described functional group capable of causing a crosslinking reaction in the molecule. It is preferred that these resins which do not have the acidic group contained in the resin (AL) or those which have been modified are used.

Specific examples of the monomer corresponding to the copolymer component having the functional group are vinylic compounds having the functional group.

Examples thereof are described, for example, in *Macromolecular Data Handbook* (*foundation*), edited by Kobunshi Gakkai, Baifukan (1986). Specific examples thereof are acrylic acid, α- and/or β-substituted acrylic acids (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcar.boxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and vinyl compounds having the above described functional group in the substituent of the ester derivatives or amide derivatives of these carboxylic acids or sulfonic acids, or in the substituent of styrene derivatives.

More preferably, a specific example of the resin (B) is a (meth)acrylic copolymer containing a monomer represented by the above-described general formula (I) as a copolymerizable component in an amount of at least 30% by weight.

The content of the copolymerizable component having the crosslinkable (crosslinking) functional group in the resin (B) is preferably from 0.5 to 40 mole %.

The weight average molecular weight of the resin (B) is preferably from $1\times10^3$ to $1\times10^5$, and more preferably from $5\times10^3$ to $5\times10^4$.

The glass transition point of the resin (B) is preferably from −20° C. to 120° C., and more preferably from 0° C. to 100° C.

The ratio of the resin (AL) and the resin (B) varies depending upon the kind, particles sizes and surface state of the inorganic photoconductive substance used, but the ratio of the resin (A) to the resin (B) is suitable from 5 to 60/95 to 40 by weight, and preferably form 10 to 40/90 to 60 by weight.

As described above, in the present invention, a crosslinking agent can be used together with the resin (AL). In the case of using a crosslinking agent, it is preferred that the resin (AL) has a heat- and/or photo-curable functional group and/or is used together with the resin (B). By using the crosslinking agent, cross-linking in the film or layer can be accelerated. The crosslinking agent which can be used in the present invention include compounds which are usually used as crosslinking agents. Suitable compounds are described, for example, in Shinzo Yamashita and Tosuke Kaneko, *Crosslinking Agent Handbook,* Taisei Sha (1981), and *Macromolecular Data Handbook* (*Foundation*), edited by Kobunshi Gakkai, Baifukan (1986).

Specific examples thereof are organic silane series compounds (e.g., silane coupling agents such as vinyltrimethoxysilane, vniyltributoxysilane, γ-glycidoxypropyltrimethoxysilane, γ-mercaptopropyltriethoxysilane, and γ-aminopropytriethoxysilane), polyisocyanate series compounds (e.g., toluylene diisocyanate, o-toluylene diisocyanate, diphenylmethane diisocyanate, triphenylmethane triisocyanate, polyethylenepolyphenyl isocyanate, hexamethylene diisocyanate, isohorone diisocyanate, and macromolecular polyisocyanate), polyol series compounds (e.g., 1,4-butanediol, poyoxypropylene glycol, polyoxyalkylene glycol, and 1,1,1-trimethylolpropane), polyamine series compounds (e.g. ethylenediamine, γ-hydroxypropylated ethylenediamine, phenylenediamine, hexamethylenediamine, N-aminoethylpiperazine and modified aliphatic polyamines), polyepoxy group-containing compounds and epoxy resins (e.g., the compounds described, for example, in Hiroshi Kakiuchi, *New Epoxy Resin,* Shokodo (1985) and Kuniyuki Hashimoto, *Epoxy Resins,* Nikkan Kogyo Shinbun Sha (1969), melamine resins (e.g., the compounds described, for example, in Ichiro Miwa and Hideo Matsunage, *Urea.melamine Resins,* Nikkan Kogyo Shinbun Sha (1969)), and poly(meth)acrylate series compounds (e.g., the compounds described, for example, in Shin Ohgawara, Takeo Saegusa and Toshinobu Higashimura, *Oligomer,* Kodansha (1976), and Eizo Ohmori, *Functional Acrylic Resins,* Techno System (1985)). Specific examples thereof include polyethylene glycol diacrylate, neopentyl glycol diacrylate, 1,6-hexanediol acrylate, trimethylolpropane triacrylate, pentaerythritol polyacrylate, bisphenol A-diglycidyl ether diacrylate, oligoester acrylate, and their corresponding methacrylates).

The amount of the crosslinking agent used in the present invention is from 0.5 to 30% by weight, and preferably from 1 to 10% by weight, based on the amount of the binder resin.

In the present invention, the binder resin may, if necessary, contain a reaction accelerator for accelerating the crosslinking reaction of the photoconductive layer.

When the crosslinking reaction is of a reaction type for forming a chemical bond between the functional groups, an organic acid (e.g., acetic acid, propionic acid, butyric acid, benzenesulfonic acid, and p-toluenesulfonic acid) can be used.

When the crosslinking reaction is of a polymerization reaction type, a polymerization initiator (e.g. a peroxide, and an azobis type compound, preferably an azobis type polymerization initiator) or a monomer having a polyfunctional polymerizable group (e.g., vinyl methacrylate, allyl methacrylate, ethylene glycol diacrylate, polyethylene glycol diacrylate, divinylsuccinic acid esters, divinyladipic acid esters, diallylsuccinic acid esters, 2-methylvinyl methacrylate, and divinylbenzene) can be used.

The coating composition containing the resin (AL) and at least one of the Resin (B) and the crosslinking agent described above according to the present invention for forming a photoconductive layer is crosslinked or subjected to thermosetting after coating. For performing crosslinking or thermosetting, a severer drying condition than that used for producing conventional electrophotographic light-sensitive materials is employed. For example, the drying step is carried out at a higher temperature and/or for a longer time. Also, after removing the solvent in the coating composition by drying, the photoconductive layer may be further subjected to a heat treatment, for example, at from 60° to 120° C. for from 5 to 120 minutes. In the case of using the above described reaction accelerator, a milder drying condition can be employed.

When the resin (AL) is employed together with the resin (B) and/or the crosslinking agent as described above, the mechanical strength of the photoconductive layer is sufficiently increased. Accordingly, the electrophotographic light-sensitive material according to the present invention has excellent electrostatic characteristics even when environmental condition is changed and has a sufficient film strength. Further, when the light-sensitive material is used as an offset printing plate precursor, at least 6,000 good prints can be obtained under severe printing conditions (e.g., when a printing pressure is high due to the use of a large size printing machine).

In still another preferred embodiment of the present invention, the resin (AL) is employed in a combination with at least one of high molecular weight resins (C), (D) and (E) described below. Resin (C):

A resin having a weight average molecular weight of from $5\times10^4$ to $5\times10^5$ and not containing $-PO_3H_2$, $-COOH$, $-SO_3H$, $-OH$,

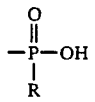

(wherein R is as defined above), a cyclic acid anhydride-containing group and a basic group.

Resin (D):

A resin having a weight average molecular weight of from $5\times10^4$ to $5\times10^5$ and containing from 0.1 to 15% by weight of a copolymerizable component containing at least one substituent selected from —OH and a basic group.

Resin (E):

A resin having a weight average molecular weight of from $5\times10^4$ to $5\times10^5$ and containing a copolymerizable component containing the acidic group at a content of not more than 50% of the content of the acidic group contained in the above-described graft type copolymer (resin (AL)), or a resin having a weight average molecular weight of from $5\times10^4$ to $5\times10^5$ and containing a copolymerizable component containing at least one acidic group which has a pKa higher than the pKa of the acidic group contained in the above-described graft type block copolymer (resin (AL)) and which is selected from $-PO_3H_2$, $-SO_3H$, $-COOH$, and

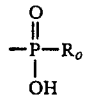

(wherein $R_o$ represents a hydrocarbon group or $-OR_o'$ wherein $R_o'$ represents a hydrocarbon group).

When the resin (AL) and at least one of the high molecular weight resins (C), (D), and (E) described above are employed, the mechanical strength of the electrophotographic light-sensitive material is further improved without damaging the excellent electrophotographic characteristics due to the resin (AL).

Now, the use of a combination of the resin (AL) of a low molecular weight and the resin (C) having neither acidic group nor basic group is described in detail below.

The resin (C) which can be used in the present invention is a resin having a weight average molecular weight of from $5\times10^4$ to $5\times10^5$ and having neither the above-described acidic group nor a basic group. The weight average molecular weight thereof is preferably from $8\times10^4$ to $3\times10^5$.

The glass transition point of the resin (C) is preferably from 0° C. to 120° C., and more preferably from 10° C. to 80° C.

Any of resins which is conventionally used as a binder resin for electrophotographic light-sensitive materials can be used as the resin (C) as far as they fulfill the conditions described above. They can be employed individually or as a combination thereof. Examples of these materials are described in Harumi Miyamoto and Hidehiko Takei, *Imaging*, Nos. 8 and 9 to 12 (1978) and Ryuji Kurita and Jiro Ishiwata, *Kobunshi* (*Macromolecule*), 17, 278-284 (1958).

Specific examples thereof include an olefin polymer and copolymer, a vinyl chloride copolymer, a vinylidene chloride copolymer, a vinyl alkanoate polymer and copolymer, an allyl alkanoate polymer and copolymer, a styrene or styrene derivative polymer and copolymer, a butadiene-styrene copolymer, an isoprene-styrene copolymer, a butadiene-unsaturated carboxylic acid ester copolymer, an acrylonitrile copolymer, a methacrylonitrile copolymer, an alkyl vinyl ether copolymer, an acrylic acid ester polymer and copolymer, a methacrylic acid ester polymer and copolymer, a styrene-acrylic acid ester copolymer, a styrene-methacrylic acid ester co-polymer, itaconic acid diester polymer and copolymer, a maleic anhydride copolymer, an acrylamide copolymer, a methacrylamide copolymer, a hydroxy group-modified silicone resin, a polycarbonate resin, a ketone resin, an amide resin, a hydroxy group- and carboxy group-modified polyester resin, a butyral resin, a polyvinyl acetal resin, a cyclized rubber-methacrylic acid ester copolymer, a cyclized rubber-acrylic acid ester co-polymer, a copolymer having a heterocyclic group containing no nitrogen atom (examples of the heterocyclic ring are a furan ring, a tetrahydrofuran ring, a thiophene ring, a dioxane ring, a dioxolan ring, a lactone ring, a benzofuran ring, a benzothiophene ring, and a 1,3-dioxetane ring), and an epoxy resin.

More specifically, examples of the resin (C) include (meth)acrylic copolymers or polymers each containing at least one monomer represented by the following general formula (IV) as a (co)polymerizable component in a total amount of at least 30% by weight;

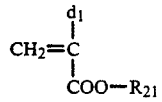

(IV)

wherein $d_1$ represents a hydrogen atom, a halogen atom (e.g., chlorine, and bromine), a cyano group, or an alkyl group having from 1 to 4 carbon atoms, and is preferably an alkyl group having from 1 to 4 carbon atoms; and $R_{2i}$ represents an alkyl group having from 1 to 18 carbon atoms which may be substituted (e.g., methyl, ethyl, propyl, butyl, pentyl, hexyl, octyl, decyl, dodecyl, tridecyl, tetradecyl, 2-methoxyethyl, and 2-ethoxyethyl), an alkenyl group having from 2 to 18 carbon atoms which may be substituted (e.g., vinyl, allyl, isopropenyl, butenyl, hexenyl, heptenyl, and octenyl), an aralkyl group having from 7 to 14 carbon atoms which may be substituted (e.g., benzyl, phenethyl, methoxybenzyl, ethoxybenzyl, and methylbenzyl), a cycloalkyl group having from 5 to 8 carbon atoms which may be substituted (e.g., cyclopentyl, cyclohexyl, and cycloheptyl), or an aryl group (e.g., phenyl, tolyl, xylyl, mesityl, naphthyl, methoxyphenyl, ethoxyphenyl, chlorophenyl, and dichlorophenyl. $R_{21}$ represents preferably an alkyl group having from 1 to 4 carbon atoms, an aralkyl group having from 7 to 14 carbon atoms which may be substituted (particularly preferred aralkyl includes benzyl, phenethyl, naphthylmethyl, and 2-naphthylethyl, each of which may be substituted), or a phenethyl group or a naphthyl group each of which may be substituted (examples of the substituent are chlorine, bromine, methyl, ethyl, propyl, acetyl, methoxycarbonyl, and ethoxycarbonyl, and two or three substituents may be present).

Furthermore, in the resin (C), a component which is copolymerized with the above-described (meth)acrylic acid ester may be a monomer other than the monomer represented by the general formula (IV), for example, α-olefins, alkanoic acid vinyl esters, alkanoic acid allyl esters, acrylonitrile, methacrylonitrile, vinyl ethers, acrylamides, methacrylamides, styrenes, and heterocyclic vinyls (e.g., 5-membered to 7-membered heterocyclic rings having from 1 to 3 non-metallic atoms other than nitrogen atom (e.g., an oxygen atom, and a sulfur atom), and specific compounds include vinylthiophene, vinyldioxane, and vinylfuran). Preferred examples of the monomer are vinyl esters or allyl esters of alkanoic acid having from 1 to 3 carbon atoms, acrylonitrile, methacrylonitrile, styrene, and styrene derivatives (e.g., vinyltoluene, butylstyrene, methoxystyrene, chlorostyrene, dichlorostyrene, bromostyrene, and ethoxystyrene).

The resin (C) used in the present invention does not contain a basic group, and examples of such basic groups include an amino group and a nitrogen atom-containing heterocyclic group, each of which may have a substituent.

Now, the use of a combination of the resin (AL) and the resin (D) containing at least one of —OH and a basic group is described hereinafter in detail.

In the resin (D), the ratio of the copolymerizable component containing a —OH group and/or a basic group is from 0.05 to 15% by weight, and preferably from 0.5 to 10% by weight of the resin (D). The weight average molecular weight of the resin (D) is from $5\times10^4$ to $5\times10^5$, and preferably from $8\times10^4$ to $1\times10^5$. The glass transition point of the resin (D) is preferably from 0° C. to 120° C., and more preferably from 10° C. to 80° C.

In the present invention, it is considered that the —OH group-containing component or the basic group-containing component in the resin (D) has a weak interaction with the surface of particles of the photoconductive substance and the resin (AL) to stabilize the dispersion of the photoconductive substance and improve the film strength of the photoconductive layer after being formed. However, if the content of the component in the resin (D) exceeds 15% by weight, the photoconductive layer formed tends to be influenced by moisture, and thus the moisture resistance of the photoconductive layer undesirably tends to decrease.

As the copolymerizable component containing a—OH group and/or a basic group contained in the resin (D), any vinylic compounds each having the substituent (i.e., the —OH group and/or the basic group) copolymerizable with the monomer represented by the above described general formula (IV) can be used. Examples of the OH group-containing compounds similar to those described for the resin (A) above as well as vinyl group- or allyl group-containing alcohols, such as compounds containing a hydroxyl group in an ester substituent or an N-substituent, for example, allyl alcohol, methacrylic acid esters, and acrylamide.

The above described basic group in the resin (D) includes, for example, an amino group represented by the following general formula (V) and a nitrogen-containing heterocyclic group.

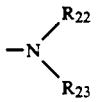

(V)

wherein $R_{22}$ and $R_{23}$, which may be the same or different each represents a hydrogen atom, an alkyl group which may be substituted (e.g., methyl, ethyl, propyl, butyl, hexyl, octyl, decyl, dodecyl, tertadecyl, octadecyl, 2-bromoethyl, 2-chloroethyl, 2-hydroxyethyl, 2-cyanoethyl, 2-methoxyethyl, and 3-ethoxypropyl), an alkenyl group which may be substituted (e.g., allyl, isopropenyl, and 4-butynyl), an aralkyl group which may be substituted (e.g., benzyl, phenethyl, chlorobenzyl, methylbenzyl, methoxybenzyl, and hydroxybenzyl), an alicyclic group (e.g., cyclopentyl, and cyclohexyl), or an aryl group (e.g., phenyl, tolyl, xylyl, mesityl, butylphenyl, methoxyphenyl, and chlorophenyl). Furthermore, $R_{22}$ and $R_{23}$ may be bonded by a hydrocarbon group through, if desired, a hetero atom.

The nitrogen-containing heterocyclic ring includes, for example, 5-membered to 7-membered heterocyclic rings each containing from 1 to 3 nitrogen atoms, and further the heterocyclic ring may form a condensed ring with a benzene ring, or a naphthalene ring. Furthermore, these heterocyclic rings may have a substituent. Specific examples of the heterocyclic ring are a pyrrole ring, an imidazole ring, a pyrazole ring, a pyridine ring, a piperazine ring, a pyrimidine ring, a pyridazine ring, an indolizine ring, an indole ring, a 2H-pyrrole ring, a 3H-indole ring, an indazole ring, a purine ring, a morpholine ring, an isoquinoline ring, a phthalazine ring, a naphthyridine ring, a quinoxaline ring, an acridine, a phenanthridine ring, a phenazine ring, a pyrrolidine ring, a pyrroline ring, an imidazolidine ring, an imidazoline ring, a pyrazolidine ring, a pyrazoline ring, piperidine ring, a piperazine ring, a quinacridine ring, an indoline ring, a 3,3-dimethylindolenine ring, a 3,3-dimethylnaphthindolenine ring, a thiazole ring, a benzothiazole ring, a naphthothiazole ring, an oxazole ring, a benzoxazole ring, a naphthoxazole ring, a selenazole ring, a benzoselenazole ring, a naphthoselenazole ring, an oxazoline ring, an isooxazoline ring, a benzoxazole ring, a morpholine ring, a pyrrolidone ring, a triazole ring, a benzotriazole ring, and a triazine ring.

The desired monomer is obtained by incorporating —OH and/or the basic group into the substituent of an ester derivative or amide derivative derived from a carboxylic acid or a sulfonic acid having a vinyl group as described, for example, in *Kobunshi (Macromolecular) Data Handbook (Foundation)*, edited by Kobunshi Gakkai, Baifukan (1986). Examples of such monomers include 2-hydroxyethyl methacrylate, 3-hydroxypropyl methacrylate, 3-hydroxy-2-chloromethacrylate, 4-hydroxybutyl methacrylate, 6-hydroxyhexyl methacrylate, 10-hydroxydecyl methacrylate, N-(2-hydroxyethyl)acrylamide, N-(3-hydroxypropyl)methacrylamide, N-(α,α-dihydroxymethyl)ethylmethacrylamide, N-(4-hydroxybutyl)methacrylamide, N,N-dimethylaminoethyl methacrylate, 2-(N,N-diethylaminoethyl)methacrylate, 3-(N,N-dimethylpropyl)methacrylate, 2-(N,N-dimethylethyl)methacrylamide, hydroxystyrene, hydroxymethylstyrene, N,N-dimethylaminomethylstyrene, N,N-diethylaminomethylstyrene, N-butyl—N-methylaminomethylstyrene, and N-(hydroxyphenyl)-methacrylamide. Examples of the vinyl compound having a nitrogen-containing heterocyclic ring are described, for example, in the above mentioned *Macromolecular Data Handbook (Foundation)*, pages 175 to 181, D. A. Tomalia, *Reactive Heterocyclic Monomers*, Chapter 1 of Functional Monomers, Vol. 2, Marcel DeRRer Inc., N.Y. (1974), and L. S. LusRin, *Basic Monomers*, Chapter 3 of Functional Monomers, Vol. 2, Marcel DeRRer Inc., N.Y. (1974).

As the resin (D), any conventional known resins can be used in the present invention as long as they have the above-described properties and, for example, the conventionally known resins described above for the resin (C) can be used.

More specifically, examples of the resin (D) are (meth)acrylic copolymers each containing the above-described described monomer shown by formula (IV) described above as the copolymerizable component which is copolymerizable with a component containing the —OH group and/or the basic group in a proportion of at least 30% by weight of the copolymer.

Furthermore, the resin (D) may contain monomers other than the above-described monomer containing the —OH group and/or the basic group in addition to the latter monomer as a copolymerizable component. Examples of such monomers are those illustrated above for the monomers which can be used as other copolymerizable components for the resin (C).

Now, the use of a combination of the resin (AL) and the resin (E) having an acidic group as the side chain of the copolymer component at a content of less than 50%, and preferably less than 30% of the content of the acidic group contained in the resin (AL) or an acidic group having a pKa value larger than that of the acidic group contained in the resin (AL) as the side chain of the copolymer component is described in detail below.

The weight average molecular weight of the resin (E) is from $5\times10^4$ to $5\times10^5$, and preferably from $7\times10^4$ to $4\times10^5$. The acidic group contained at the side chain of the copolymer in the resin (E) is preferably contained in the resin (E) at a proportion of from 0.05 to 3% by weight and more preferably from 0.1 to 1.5% by weight. Also, it is preferred that the acidic group is incorporated into the resin (E) in a combination with the acidic group present in the resin (AL) shown in Table A below.

TABLE A

| Acidic Group in Resin (AL) | Acidic Group in Resin (E) |
|---|---|
| $-SO_3H$ and/or $-PO_3H_2$ | $-COOH$ |
| $-SO_3H$, $-PO_3H_2$ and/or $-COOH$ | $-\overset{\overset{O}{\|}}{\underset{\underset{OH}{\|}}{P}}-R_o$ |

The glass transition point of the resin (E) is preferably from 0° C. to 120° C., more preferably from 0° C. to 100° C., and most preferably from 10° C. to 80° C..

The resin (E) shows a very weak interaction for particles of photoconductive substance as compared with the resin (AL), has a function of mildly coating the particles, and sufficiently increases the mechanical strength of the photoconductive layer, without damaging the function of the resin (AL).

If the content of the acidic group in the side chain of the resin (E) exceeds 3% by weight, the adsorption of the resin (E) onto the particles of photoconductive substance occurs to destroy the dispersion of the photoconductive substance and to form aggregates or precipitates, which results in causing a state of not forming a layer or greatly reducing the electrostatic characteristics of the photoconductive layer even if the layer is formed. Also, in such a case, the surface property of the photoconductive layer is roughened to reduce the strength to mechanical friction.

In the $$-\overset{\overset{O}{\|}}{\underset{\underset{OH}{\|}}{P}}-R_o$$

group of the resin (E), $R_o$ represents a hydrocarbon group or $-OR_o'$ wherein $R_o'$ represents a hydrocarbon group. Specific examples of $R_o$ or $R_o'$ include an alkyl group having from 1 to 12 carbon atoms which may be substituted (e.g., methyl, ethyl, propyl, butyl, hexyl, octyl, decyl, dodecyl, 2-chloroethyl, 2-methoxyethyl, 2-ethoxyethyl, and 3-methoxypropyl), an aralkyl group having from 7 to 12 carbon atoms which may be substituted (e.g., benzyl, phenethyl, chlorobenzyl, methoxybenzyl, and methylbenzyl), an alicyclic group having from 5 to 8 carbon atoms which may be substituted (e.g., cyclopentyl, and cyclohexyl), and an aryl group which may be substituted (e.g., phenyl, tolyl, xylyl, mesityl, naphthyl, chlorophenyl, and methoxyphenyl).

The copolymerizable component having the acidic group in the resin (E) used in the present invention include, for example, components similar to those described for the polymerizable components containing specific acidic group in the resin (AL) described above.

As the resin (E), any conventional known resins can be used in the present invention as long as they have the above-described properties and, for example, the conventionally known resins described above for the resin (C) can be used.

More specifically, examples of the resin (E) are (meth)acrylic copolymers each containing the aforesaid monomer shown by formula (IV) described above as the copolymerizable component in a proportion of at least 30% by weight of the copolymer.

Furthermore, the resin (E) of the present invention may further contain other components together with the above-described monomer represented by the general formula (IV) and the above-described monomer having an acidic group as other copolymerizable components. Specific examples of such monomers are those illustrated above for the monomers which can be used in the resin (C) as other copolymerizable components.

The ratio of the resin (AL) to any of the resins (C) to (E) varies depending upon the kind, particle size and surface state of the inorganic photoconductive substance to be used, but is suitably from 5 to 80/95 to 20 by weight, and preferably from 15 to 60/85 to 40 by weight.

The ratio of the weight average molecular weight of the resin (AL) to the resin (C) to (E) is preferably at least 1.2, and more preferably at least 2.0.

If the molecular weight of the resin (C), (D) or (E) is less than $5\times10^4$, a sufficient film strength may not be maintained. On the other hand the molecular weight thereof is larger than $5\times10^5$, the dispersibility of the photoconductive substance is reduced, the smoothness of the photoconductive layer is deteriorated, and image quality of duplicated images (particularly reproducibility of fine lines and letters) is degraded. Further, the background stain increases in case of using as an offset master.

It is presumed that in the above described embodiments the resins (C), (D) or (E) has the strength of interaction with the inorganic photoconductive substance is controlled to a low level which does not damage the electrophotographic characteristics achieved by the resin (AL), and the long main molecular chains thereof interact mutually whereby the mechanical strength of the photoconductive layer is increased without damaging the excellent electrophotographic characteristics and the good performance on the oil-desensitizing treatment for using as an offset printing plate precursor.

The inorganic photoconductive substance which can be used in the present invention includes zinc oxide, titanium oxide, zinc sulfide, cadmium sulfide, cadmium carbonate, zinc selenide, cadmium selenide, tellurium selenide, and lead sulfide. Among them, zinc oxide is preferred.

The resin binder is used in a total amount of from 10 to 100 parts by weight, preferably from 15 to 50 parts by weight, per 100 parts by weight of the inorganic photoconductive substance.

If desired, various dyes can be used as spectral sensitizer in the present invention. Examples of the spectral sensitizers include carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (including metallized dyes) as described, for example, in Harumi Miyamoto and Hidehiko Takei, *Imaging,* 1973, No. 8, 12, C. J. Young et al., *RCA Review,* 15, 469 (1954), Ko-hei Kiyota et al., *Denkitsushin Gakkai Ronbunshi,* J 63-C, No. 2, 97 (1980), Yuji Harasaki et al., Kogyo Kagaku *Zasshi,* 66, 78 and 188 (1963), and Tadaaki Tani, *Nihon Shashin Gakkaishi,* 35, 208 (1972).

Specific examples of the carbonium dyes, triphenylmethane dyes, xanthene dyes, and phthalein dyes are described, for example, in JP-B-51-452, JP-A-50-90334, JP-A-50-114227, JP-A-53-39130, JP-A-53-82353, U.S. Pat. Nos. 3,052,540 and 4,054,450, and JP-A-57-16456.

The polymethine dyes, such as oxonol dyes, merocyanine dyes, cyanine dyes, and rhodacyanine dyes, include those described, for example, in F. M. Hammer, *The Cyanine Dyes and Related Compounds.* Specific examples include those described, for example, in U.S. Pat. Nos. 3,047,384, 3,110,591, 3,121,008, 3,125,447, 3,128,179, 3,132,942, and 3,622,317, British Patents 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near infrared region to the infrared region, include those described, for example, in JP-A-47-840, JP-A-47-44180, JP-B-51-41061, JP-A-49-5034, JP-A-49-45122, JP-A-57-46245, JP-A-56-141, JP-A-57-157254, JP-A-61-26044, JP-A-61-27551, U.S Pat. Nos. 3,619,154 and 4,175,956, and *Research disclosure,* 216, 117 to 118 (1982).

The light-sensitive material of the present invention is particularly excellent in that the performance thereof is not liable to variation even when various kinds of sensitizing dyes are employed therein.

If desired, the photoconductive layer may further contain various additives commonly employed in conventional electrophotographic light-sensitive layer, such as chemical sensitizers. Examples of such additives include electron-accepting compounds (e.g., halogen, benzoquinone, chloranil, acid anhydrides, and organic carboxylic acids) as described, for example, in the above-mentioned *Imaging,* 1973, No. 8, 12; and polyarylalkane compounds, hindered phenol compounds, and p-phenylenediamine compounds as described in Hiroshi Kokado et al., *Saikin-no Kododen Zairyo to Kankotai no Kaihatsu Jitsuyoka,* Chaps. 4 to 6, Nippon Kagaku Joho K.K. (1986).

The amount of these additives is not particularly restricted and usually ranges from 0.0001 to 2.0 parts by weight per 100 parts by weight of the photoconductive substance.

The photoconductive layer suitably has a thickness of from 1 to 100 μm, preferably from 10 to 50 μm.

In cases where the photoconductive layer functions as a charge generating layer in a laminated light-sensitive material composed of a charge generating layer and a charge transporting layer, the thickness of the charge generating layer suitably ranges from 0.01 to 1 μm, particularly from 0.05 to 0.5 μm.

If desired, an insulating layer can be provided on the light-sensitive layer of the present invention. When the insulating layer is made to serve for the main purposes for protection and improvement of durability and dark decay characteristics of the light-sensitive material, its thickness is relatively small. When the insulating layer is formed to provide the light-sensitive material suitable for application to special electrophotographic processes, its thickness is relatively large, usually ranging from 5 to 70 μm, particularly from 10 to 50 μm.

Charge transporting materials used in the above-described laminated light-sensitive material include polyvinylcarbazole, oxazole dyes, pyrazoline dyes, and triphenylmethane dyes. The thickness of the charge transporting layer ranges from 5 to 40 μm, preferably from 10 to 30 μm.

Resins to be used in the insulating layer or charge transporting layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be provided on any known support. In general, a support for an electrophotographic light-sensitive layer is preferably electrically conductive. Any of conventionally employed conductive supports may be utilized in the present invention. Examples of usable conductive supports include a substrate (e.g., a metal sheet, paper, and a plastic sheet) having been rendered electrically conductive by, for example, impregnating with a low resistant substance; the above-described substrate with the back side thereof (opposite to the light-sensitive layer side) being rendered conductive and having further coated thereon at least one layer for the purpose of prevention of curling; the above-described substrate having provided thereon a water-resistant adhesive layer; the above-described substrate having provided thereon at least one precoat layer; and paper laminated with a conductive plastic film on which aluminum is vapor deposited.

Specific examples of conductive supports and materials for imparting conductivity are described, for example, in Yukio Sakamoto, *Denshishashin,* 14, No. 1, 2 to 11 (1975), Hiroyuki Moriga, *Nyumon Tokushushi no Kagaku,* Kobunshi Kankokai (1975), and M. F. Hoover, *J, Macromol. Sci. Chem.,* A-4(6), 1327 to 1417 (1970).

In accordance with the present invention, an electrophotographic light-sensitive material which exhibits excellent electrostatic characteristics and mechanical strength even under severe conditions. The electrophotographic light-sensitive material according to the present invention is also advantageously employed in the scanning exposure system using a semiconductor laser beam.

Also, the electrostatic characteristics are further improved when the polymerizable component represented by the general formula (IIa) or (IIb) is employed together with the macromonomer (M) in the graft type copolymer of a low molecular weight.

Moreover, the mechanical strength of the electrophotographic light-sensitive material can be further increased by incorporating the heat- and/or photo-curable functional group into the graft type copolymer of a low molecular weight or employing the heat- and/or photo-curable resin, crosslinking agent or resin having a weight average molecular weight of from $5 \times 10^4$ to $5 \times 10^5$.

The present invention will now be illustrated in greater detail with reference to the following examples, but it should be understood that the present invention is not to be construed as being limited thereto.

SYNTHESIS EXAMPLE M-1

Synthesis of Macromonomer (M-1)

A mixed solution of 30 g of triphenylmethyl methacrylate, and 100 g of toluene was sufficiently degassed in a nitrogen stream and cooled to −20° C. Then, 1.0 g of 1,1-diphenylbutyl lithium was added to the mixture, and the reaction was conducted for 10 hours. Separately, a mixed solution of 70 g of ethyl methacrylate and 100 g of toluene was sufficiently degassed in a nitrogen stream and the resulting mixed solution was added to the above described mixture, and the reaction was further conducted for 10 hours. The reaction mixture was adjusted to 0° C., and carbon dioxide gas was passed through the mixture in a flow rate of 60 ml/min for 30 minutes, then the polymerization reaction was terminated.

The temperature of the reaction solution obtained was raised to 25° C. under stirring, 6 g of 2-hydroxyethyl methacrylate was added thereto, then a mixed solution of 12 g of dicyclohexylcarbodiimide, 1.0 g of 4-N,N-dimethylaminopyridine and 20 g of methylene chloride was added dropwise thereto over a period of 30 minutes, and the mixture was stirred for 3 hours.

After removing the insoluble substances from the reaction mixture by filtration, 10 ml of an ethanol solution of 30 % by weight hydrogen chloride was added to the filtrate and the mixture was stirred for one hour. Then, the solvent of the reaction mixture was distilled off under reduced pressure until the whole volume was reduced to a half, and the mixture was reprecipitated from one liter of petroleum ether.

The precipitates thus formed were collected and dried under reduced pressure to obtain 56 g of Macromonomer (M-1) shown below having a weight average molecular weight (hereinafter simply referred to as Mw) of $6.5 \times 10^3$.

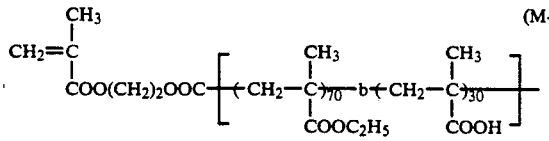

(M-1)

SYNTHESIS EXAMPLE M-2

Synthesis of Macromonomer (M-2)

A mixed solution of 5 g of benzyl methacrylate, 0.1 g of (tetraphenyl porphynate) aluminum methyl, and 60 g of methylene chloride was raised to a temperature of 30° C. in a nitrogen stream. The mixture was irradiated with light from a xenon lamp of 300 W at a distance of 25 cm through a glass filter to conduct a reaction for 12 hours. To the mixture was further added 45 g of butyl methacrylate, after similarly light-irradiating for 8 hours, 10 g of 4-bromomethylstyrene was added to the reaction mixture followed by stirring for 30 minutes, then the reaction was terminated. Then, Pd-C was added to the reaction mixture, and a catalytic reduction reaction was conducted for one hour at 25° C.

After removing insoluble substances from the reaction mixture by filtration, the reaction mixture was reprecipitated from 500 ml of petroleum ether and the precipitates thus formed were collected and dried to obtain 33 g of Macromonomer (M-2) shown below having an Mw of $7 \times 10^3$.

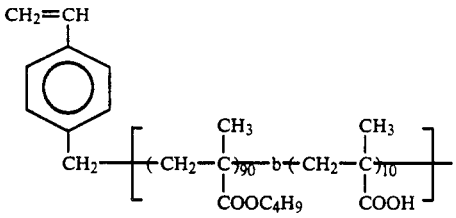

(M-3)

SYNTHESIS EXAMPLE M-3

Synthesis of Macromonomer (M-3)

A mixed solution of 20 g of 4-vinylphenyloxytrimethylsilane and 100 g of toluene was sufficiently degassed in a nitrogen stream and cooled to 0° C. Then, g of 1,1-diphenyl-3-methylpentyl lithium was added to the mixture followed by stirring for 6 hours. Separately, a mixed solution of 80 g of 2-chloro-6-methylphenyl methacrylate and 100 g of toluene was sufficiently degassed in a nitrogen stream and the resulting mixed solution was added to the above described mixture, and then reaction was further conducted for 8 hours. After introducing ethylene oxide in a flow rate of 30 ml/min into the reaction mixture for 30 minutes with vigorously stirring, the mixture was cooled to a temperature of 15° C., and 12 g of methacrylic chloride was added dropwise thereto over a period of 30 minutes, followed by stirring for 3 hours.

Then, to the reaction mixture was added 10 ml of an ethanol solution of 30% by weight hydrogen chloride and, after stirring the mixture for one hour at 25° C., the mixture was reprecipitated from one liter of petroleum ether. The precipitates thus formed were collected, washed twice with 300 ml of diethyl ether and dried to obtain 55 g of Macromonomer (M-3) shown below having an Mw of $7.8 \times 10^3$.

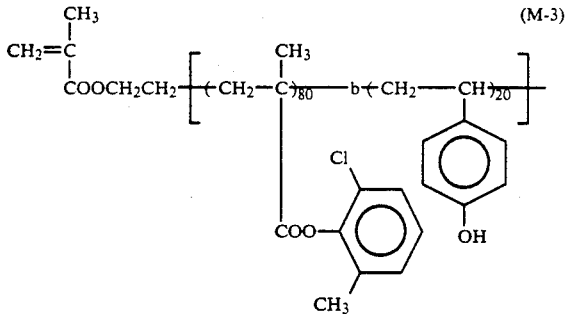

(M-3)

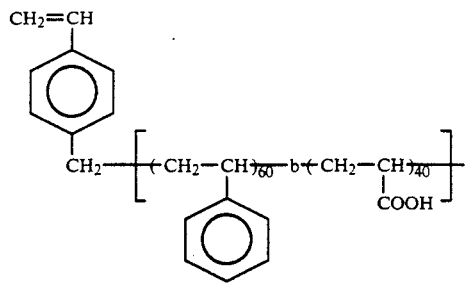

(M-4)

SYNTHESIS EXAMPLE M-4

Synthesis of Macromonomer (M-4)

A mixed solution of 40 g of triphenylmethyl acrylate and 100 g of toluene was sufficiently degassed in a nitrogen stream and cooled to −20° C. Then, 2 g of sec-butyl lithium was added to the mixture, and the reaction was conducted for 10 hours. Separately, a mixed solution of 60 g of styrene and 100 g of toluene was sufficiently degassed in a nitrogen stream and the resulting mixed solution was added to the above described mixture, and then reaction was further conducted for 12 hours. The reaction mixture was adjusted to 0° C., 11 g of benzyl bromide was added thereto, and the reaction was conducted for one hour, followed by reacting at 25° C. for 2 hours.

Then, to the reaction mixture was added 10 ml of an ethanol solution of 30% by weight hydrogen chloride, followed by stirring for 2 hours. After removing the insoluble substances from the reaction mixture by filtration, the mixture was reprecipitated from one liter of n-hexane. The precipitates thus formed were collected and dried under reduced pressure to obtain 58 g of Macromonomer (M-4) shown below having an Mw of $4.5 \times 10^3$.

SYNTHESIS EXAMPLE M-5

Synthesis of Macromonomer (M-5)

A mixed solution of 70 g of phenyl methacrylate and 4.8 g of benzyl N-hydroxyethyl-N-ethyldithiocarbamate was placed in a vessel in a nitrogen stream followed by closing the vessel and heated to 60° C. The mixture was irradiated with light from a high-pressure mercury lamp for 400 W at a distance of 10 cm through a glass filter for 10 hours to conduct a photopolymerization.

Then, 30 g of acrylic acid and 180 g of methyl ethyl ketone were added to the mixture and, after replacing the gas in the vessel with nitrogen, the mixture was light-irradiated again for 10 hours.

To the reaction mixture was added dropwise 12 g of 2-isocyanatoethyl methacrylate at 30° C. over a period of one hour and the mixture was stirred for 2 hours. The reaction mixture was reprecipitated from 1.5 liters of hexane, and the precipitates thus formed were collected and dried to obtain 68 g of Macromonomer (M-5) shown below having an Mw of $6.0 \times 10^3$.

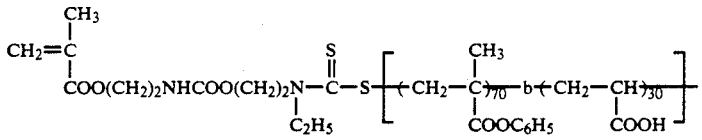

SYNTHESIS EXAMPLE AL-1

Synthesis of Resin (AL-1)

A mixed solution of 80 g of ethyl methacrylate, 20 g of Macromonomer (M-1) and 150 g of toluene was heated at 95° C. in a nitrogen stream, and 6 g of 2,2'-azobis(isobutyronitrile) (hereinafter simply referred to as AIBN) was added thereto to effect reaction for 3 hours. Then, 2 g of AIBN was further added thereto, followed by reacting for 2 hours, and thereafter 2 g of AIBN was added thereto, followed by reacting for 2 hours. The resulting copolymer shown below had an Mw of $9 \times 10^3$.

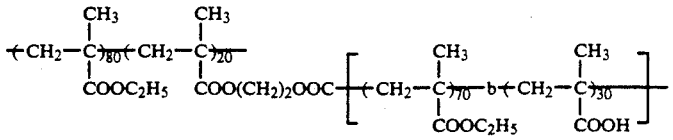

SYNTHESIS EXAMPLE AL-2

Synthesis of Resin (AL-2)

A mixed solution of 70 g of 2-chlorophenyl methacrylate, 30 g of Macromonomer (M-2), 2 g of n-dodecylmercaptan and 100 g of toluene was heated at 80° C. in a nitrogen stream, and 3 g of 2,2'-azobis(isovaleronitrile) (hereinafter simply referred to as AIVN) was added thereto to effect reaction for 3 hours. Then, 1 g of AIVN was further added, followed by reacting for 2 hours, and thereafter 1 g of AIBN was added thereto, followed by heating to 90° C. and reacting for 3 hours. The resulting copolymer shown below had an Mw of $7.6\times10^3$.

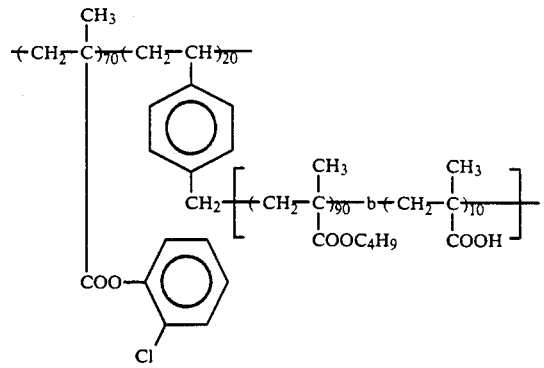

SYNTHESIS EXAMPLES B-3 TO B-9

Synthesis of Resins (B-3) to (B-9)

Resins (AL) shown in Table 1 below were synthesized under the same polymerization conditions as described in Synthesis Example AL-1 except for using the monomers shown in Table 1 in place of the ethyl methacrylate, respectively. Each of these resins had an Mw of from $5\times10^3$ to $9\times10^3$.

TABLE 1

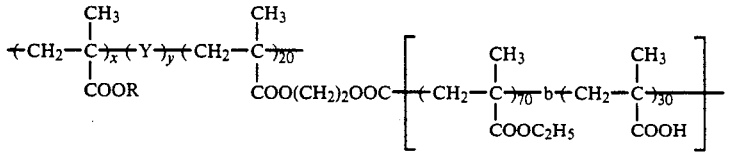

| Synthesis Example | Resin (AL) | —R | —Y— | x/y |
|---|---|---|---|---|
| AL-3 | (AL-3) | $-C_4H_9$ | — | 80/0 |
| AL-4 | (AL-4) | $-CH_2C_6H_5$ | — | 80/0 |
| AL-5 | (AL-5) | $-C_6H_5$ | — | 80/0 |
| AL-6 | (AL-6) | $-C_4H_9$ | $-CH_2-CH-$ 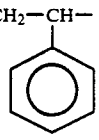 | 65/15 |
| AL-7 | (AL-7) | $-CH_2C_6H_5$ | $-CH_2-CH-$ (COOCH$_3$) | 70/10 |
| AL-8 | (AL-8) | 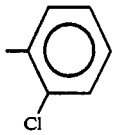 | — | 80/0 |
| AL-9 | (AL-9) | 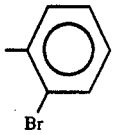 | — | 80/0 |
| AL-10 | (AL-10) | 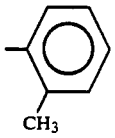 | — | 80/0 |

TABLE 1-continued

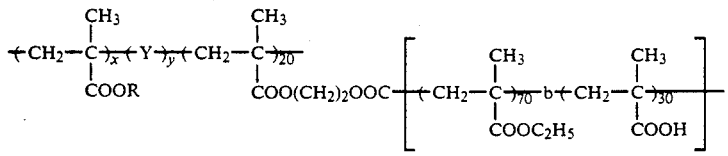

| Synthesis Example | Resin (AL) | —R | —Y— | x/y |
|---|---|---|---|---|
| AL-11 | (AL-11) | 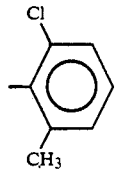 | — | 80/0 |
| AL-12 | (AL-12) | 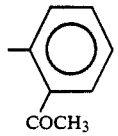 | — | 80/0 |
| AL-13 | (AL-13) | 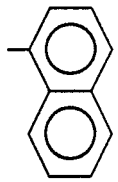 | $-CH_2-CH-$ (COOC$_2$H$_5$) | 70/0 |
| AL-14 | (AL-14) | 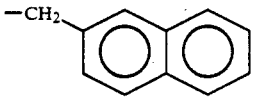 | — | 80/0 |
| AL-15 | (AL-15) | $-CH_3$ | $-CH_2-C-$ (CH$_3$, COOC$_4$H$_9$) | 40/40 |
| AL-16 | (AL-16) | $-CH_2C_6H_5$ | $-CH_2-C-$ (CH$_3$, COO(CH$_2$)$_2$CN) | 65/15 |
| AL-17 | (AL-17) | $-C_6H_5$ | $-CH_2-CH-$ (CONH$_2$) | 72/8 |
| AL-18 | (AL-18) | 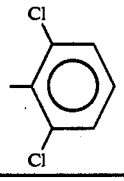 | — | 80/0 |

SYNTHESIS EXAMPLES AL-19 TO AL-35

Synthesis of Resins (AL-19) to (AL-35)

Resins (AL) shown in Table 2 below were synthesized under the same polymerization conditions as described in Synthesis Example AL-2 except for using the macromonomers (M) shown in Table 2 in place of Macromonomer (M-2), respectively. Each of these resins had an Mw of from $1\times10^3$ to $2\times10^4$.

TABLE 2

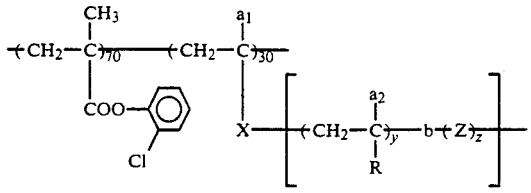

(weight ratio)

| Synthesis Example No. | Resin (AL) | —X— | $a_1/a_2$ | —R | —Z— | x/y |
|---|---|---|---|---|---|---|
| AL-19 | (AL-19) | $-COO(CH_2)_2OOC-$ | H/$-CH_3$ | $-COOCH_3$ | $-CH_2-CH(COOH)-$ | 70/30 |
| AL-20 | (AL-20) | $-COOCH_2CH(OH)CH_2OOC-$ | $-CH_3/-CH_3$ | $-COOCH_2C_6H_5$ | 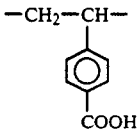 | 60/40 |
| AL-21 | (AL-21) | 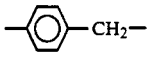 | —H/$-CH_3$ | $-COOC_6H_5$ | $-CH_2-C(CH_3)(COO(CH_2)_2COOH)-$ | 65/35 |
| AL-22 | (AL-22) | $-COO(CH_2)_2OCO(CH_2)_2-$ $-COO(CH_2)_2-$ | $-CH_3/-CH_3$ | $-COOCH_2$ | $-CH_2-C(CH_3)(COOH)-$ | 80/20 |
| AL-23 | (AL-23) | $-COOCH_2CH_2-$ | $-CH_3/-H$ | $-C_6H_5$ | 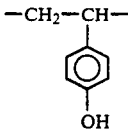 | 50/50 |
| AL-24 | (AL-24) | $-COOCH_2CH(OH)CH_2OOC-$ | $-CH_3/-CH_3$ | $-COOC_2H_5$ | $-CH_2-C(CH_3)(COO(CH_2)_3SO_3H)-$ | 90/10 |
| AL-25 | (AL-25) | 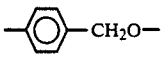 | —H/$-CH_3$ | $-COOC_3H_7$ | 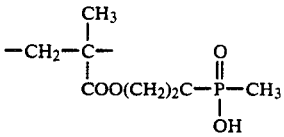 | 80/20 |
| AL-26 | (AL-26) | 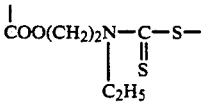 | $-CH_3/-CH_3$ | $-COOC_2H_5$ | 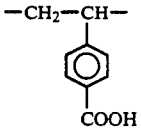 | 65/35 |
| AL-27 | (AL-27) | " | $-CH_3/-H$ | $-COOC_6H_5$ | $-CH(CH_3)-CH(COOH)-$ | 70/30 |
| AL-28 | (AL-28) | $-COO(CH_2)_2NHCOO-$ $-(CH_2)_2-$ | $-CH_3/-CH_3$ | " | $-CH_2-CH(COOH)-$ | 75/25 |

TABLE 2-continued

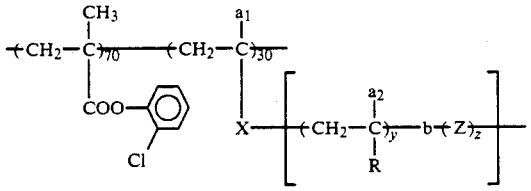

(weight ratio)

| Synthesis Example No. | Resin (AL) | —X— | $a_1/a_2$ | —R | —Z— | x/y |
|---|---|---|---|---|---|---|
| AL-29 | (AL-29) | $-COOCH_2CH_2-$ | $-CH_3/-H$ | $-C_6H_5$ | 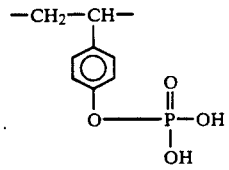 | 90/10 |
| AL-30 | (AL-30) | 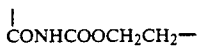 | $-CH_3/-CH_3$ | $-COOCH_2C_6H_5$ | 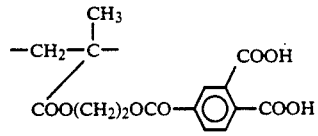 | 70/30 |
| AL-31 | (AL-31) | 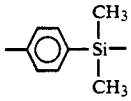 | $-H/-CH_3$ | $-COOC_4H_9$ | 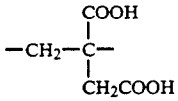 | 80/20 |
| AL-32 | (AL-32) | $-COO-$ | $-CH_3/-CH_3$ | $-COOCH_3$ |  | 70/30 |
| AL-33 | (AL-33) | $-COO(CH_2)_4OOC$ | $-CH_3/-CH_3$ | 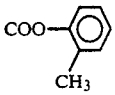 | 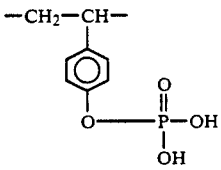 | 75/25 |
| AL-34 | (AL-34) | 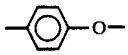 | $-H/-H$ | $-C_6H_5$ | 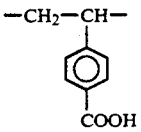 | 70/30 |
| AL-35 | (AL-35) | 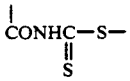 | $-H/-CH_3$ | $-COOCH_2C_6H_5$ | 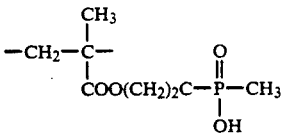 | 75/25 |

SYNTHESIS EXAMPLE AH-1

Synthesis of Resin (AH-1)

A mixed solution of 80 g of ethyl methacrylate, 20 g of Macromonomer (M-6) shown below and 150 g of toluene was heated at 85° C. in a nitrogen stream, and 0.8 g of 1,1-azobis(cyclohexane-1-carbonitrile) (hereinafter simply referred to as ABCC) to effect reaction for 5 hours. Then, 0.5 g of ABCC was further added thereto, followed by reacting from 5 hours. The resulting copolymer shown below had an Mw of $2.0\times10^5$.

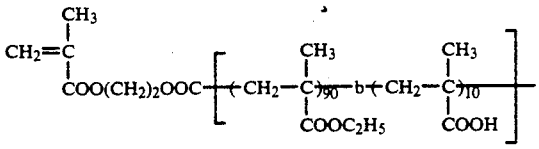

(M-6)

-continued

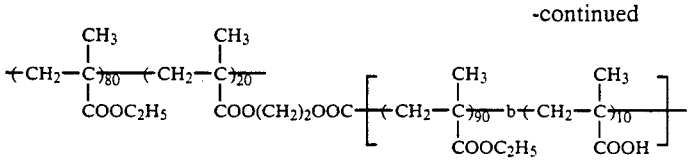

(AH-1)

SYNTHESIS EXAMPLE AH-2

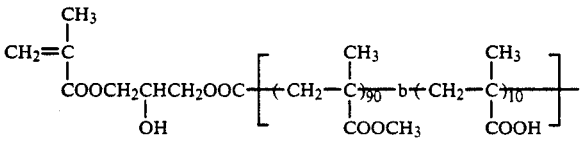

(M-7)

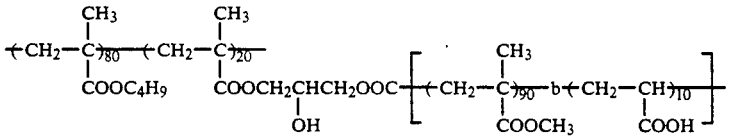

(AH-2)

Synthesis of Resin (AH-2)

A mixed solution of 80 g of ethyl methacrylate, 20 g of Macromonomer (M-7) shown below and 150 g of toluene was heated at 70° C. in a nitrogen stream, and 0.5 g of AIBN was added thereto to effect reaction for 6 hours. Then, 0.3 g of AIBN was further added, followed by reacting for 4 hours and thereafter 0.3 g of AIBN was further added, followed by reacting for 4 hours. The resulting copolymer shown below had an Mw of $8.5\times10^4$.

SYNTHESIS EXAMPLES AH-3 TO AH-9

Synthesis of Resins (AH-3) to (AH-9)

Resins (AH) shown in Table 2 below were synthesized under the same polymerization conditions as described in Synthesis Example AH-2. Each of these resins had an Mw of from $7\times10^4$ to $9\times10^4$.

TABLE 3

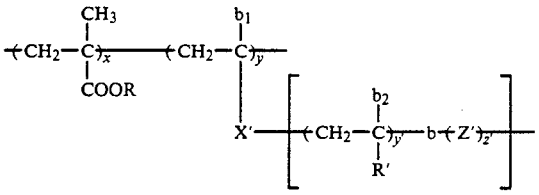

| Synthesis Example No. | Resin (B) | —R | —X'— | x/y | $b_1/b_2$ | —R' | —Z' | y'/z' |
|---|---|---|---|---|---|---|---|---|
| AH-3 | (AH-3) | $-CH_3$ | $-COO(CH_2)_2OOC-$ | 90/10 | $-CH_3/-CH_3$ | $-COOC_4H_9$ | 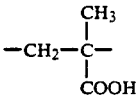 | 90/10 |
| AH-4 | (AH-4) | $-C_3H_7(n)$ | 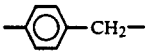 | 80/20 | $-H/-CH_3$ | $-COOC_2H_5$ | 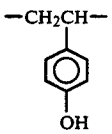 | 80/20 |
| AH-5 | (AH-5) | $-CH_2C_6H_5$ | $-COO(CH_2)_2-$ | 90/10 | $-H/-CH_3$ | $-OC_2H_5$ | 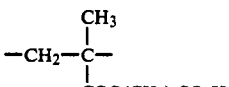 | 95/5 |
| AH-6 | 9AH-6) | $-C_2H_5$ | $-COO-$ | 90/10 | $-CH_3/-CH_3$ | $-COOC_2H_5$ | 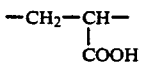 | 90/10 |
| AH-7 | (AH-7) | " | $-COO(CH_2)_2NHCOO-$ 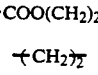 | 90/10 | $-CH_3/-H$ | $-COOC_3H_7$ | 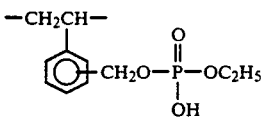 | 85/15 |

TABLE 3-continued

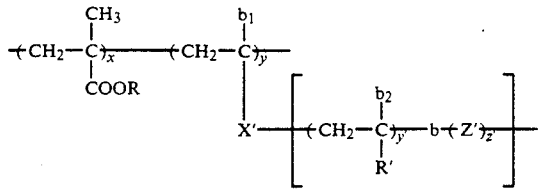

| Synthesis Example No. | Resin (B) | —R | —X'— | x/y | $b_1/b_2$ | —R' | —Z' | y'/z' |
|---|---|---|---|---|---|---|---|---|
| AH-8 | (AH-8) | $-CH_2C_6H_5$ | $-COO(CH_2)_2N(C_2H_5)-C(=S)-S-$ | 90/10 | —H/—$CH_3$ | $-COOC_2H_5$ | $-CH_2-C(CH_3)(COO(CH_2)_2O-P(=O)(OH)-OH)-$ | 92/8 |
| AH-9 | (AH-9) | $-C_2H_5$ | —COO— | 85/5 | —H/—H | 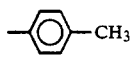 | 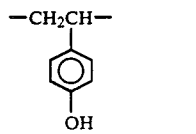 | 90/10 |

SYNTHESIS EXAMPLES AH-10 TO AH-20

Synthesis of Resins (AH-10) to (AH-20)

Resins (AH) shown in Table 3 below were synthesized under the same polymerization conditions as described in Synthesis Example AH-1. Each of these resins had an Mw of from $9\times10^4$ to $2\times10^5$.

TABLE 4

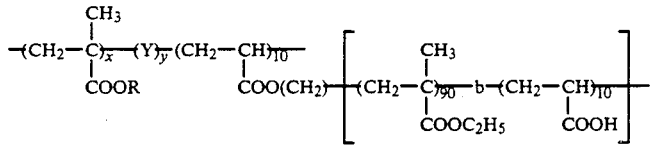

x + y + 10 = 100 (by weight)

| Synthesis Example No. | Resin (B) | —R | —Y— | x/y |
|---|---|---|---|---|
| AH-10 | (AH-10) | $-C_2H_5$ | $-CH_2-CH(COOCH_3)-$ | 70/20 |
| AH-11 | (AH-11) | $-CH_3$ | $-CH_2-CH(COOC_2H_5)-$ | 75/15 |
| AH-12 | (AH-12) | $-C_4H_9$ | 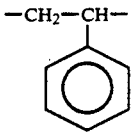 | 70/20 |
| AH-13 | (AH-13) | " | $-CH_2-CH(CN)-$ | 80/10 |
| AH-14 | (AH-14) | $-C_4H_9$ | $-CH_2-CH(COO(CH_2)_2CN)-$ | 75/15 |
| AH-15 | (AH-15) | $-CH_2C_6H_5$ | $-CH_2-C(CH_3)(COO(CH_2)_2OH)-$ | 80/10 |

TABLE 4-continued

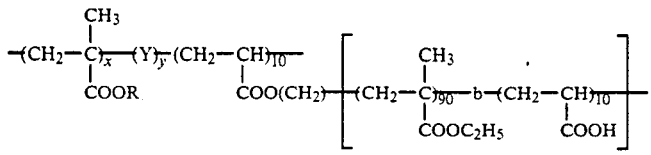

x + y + 10 = 100 (by weight)

| Synthesis Example No. | Resin (B) | —R | —Y— | x/y |
|---|---|---|---|---|
| AH-16 | (AH-16) | $-C_2H_5$ | $-CH_2-CH(CONH_2)-$ | 85/5 |
| AH-17 | (AH-17) | $-C_2H_5$ | $-CH_2-C(CH_3)(COO(CH_2)_2-N\langle O \rangle)-$ | 85/5 |
| AH-18 | (AH-18) | $-C_2H_5$ | $-CH_2-CH-$ 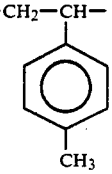 | 75/15 |
| AH-19 | (AH-19) | 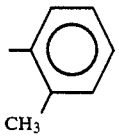 | $-CH_2-C(CH_3)(COOC_2H_5)-$ | 70/20 |
| AH-20 | (AH-20) | 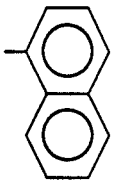 | $-CH_2-CH(COOC_2H_5)-$ | 70/20 |

EXAMPLE 1

A mixture of 40 g of Resin (A) shown below, 200 g of zinc oxide, 0.018 g of Methine Dye (I) shown below, 0.10 g of phthalic anhydride, and 300 g of toluene was dispersed in a ball mill for 2 hours to prepare a coating composition for a light-sensitive layer. The coating composition was coated on paper, which had been subjected to electrically conductive treatment, at a dry coverage of 18 g/m$^2$ with a wire bar and dried for 30 seconds at 110° C. Then, the coated material was allowed to stand in a dark place for 24 hours under the conditions of 20° C. and 65% RH to prepare an electrophotographic light-sensitive material.

Resin (A-1)

-continued

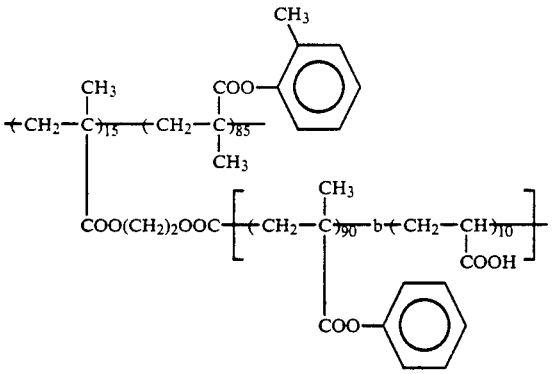

Mw: $3.8 \times 10^4$ (weight ratio)

Methine Dye (I):

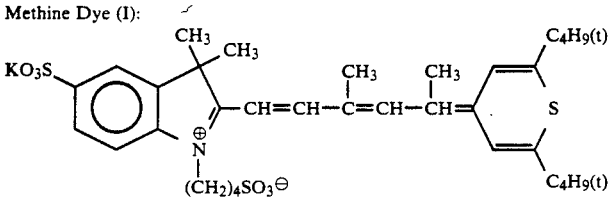

COMPARATIVE EXAMPLE A-1

An electrophotographic light-sensitive material was prepared according to the same procedure as Example 1 described above except that 40 g of Resin (R-1) for comparison shown below was used in place of 40 g of Resin (A-1).

Resin (R-1):

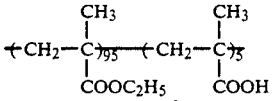

(weight ratio)

Mw: $8 \times 10^3$ (random copolymer)

COMPARATIVE EXAMPLE B-1

An electrophotographic light-sensitive material was prepared according to the same procedure as Example 1 described above except that 40 g of Resin (R-2) for comparison shown below was used in place of 40 g of Resin (A-1).

Resin (R-2):

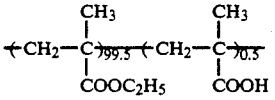

(weight ratio)

-continued

Mw: $1.8 \times 10^4$ (random copolymer)

COMPARATIVE EXAMPLE C-1

An electrophotographic light-sensitive material was prepared according to the same procedure as Example 1 described above except that 40 g of Resin (R-3) for comparison shown below (a charging ratio of ethyl methacrylate/$\beta$-mercaptopropionic acid was 95/5 by weight) was used in place of 40 g of Resin (A-1).

Resin (R-3):

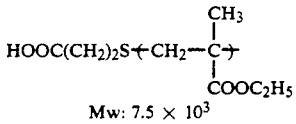

Mw: $7.5 \times 10^3$

The electrostatic characteristics and the image-forming performance under environmental conditions of 20° C. and 65% RH (Condition I) or 30° C. and 80% RH (Condition II) of each of the electrophotographic light-sensitive materials were determined.

The results obtained are shown in Table 5 below.

TABLE 5

| | | Example 1 | Comparative Example A-1 | Comparative Example B-1 | Comparative Example C-1 |
|---|---|---|---|---|---|
| Electrostatic*1 Characteristics | | | | | |
| $V_{10}$ (−V): | Condition I | 580 | 505 | 510 | 440 |
| | Condition II | 565 | 490 | 500 | 400 |
| DRR (%): | Condition I | 90 | 70 | 75 | 38 |
| | Condition II | 88 | 65 | 72 | 30 |
| $E_{1/10}$ (erg/cm$^2$) | Condition I | 26 | 43 | 35 | 100 |
| | Condition II | 24 | 40 | 33 | 150 |
| Image Forming*2 Performance | | | | | |
| | Condition I | Good | No Good | No Good | Very Poor |

TABLE 5-continued

| | Example 1 | Comparative Example A-1 | Comparative Example B-1 | Comparative Example C-1 |
|---|---|---|---|---|
| | | (Reduced DM) | (Reduced DM) | (Severe background fog, Reduced DM) |
| Condition II | Good | Poor (Reduced DM, Slight background fog) | No Good (Reduced DM, Slight scratches of fine lines and letters) | Very Poor (Indiscriminate images from background fog) |

The above evaluations were conducted as follows.

1) Electrostatic Characteristics:

Each light-sensitive material was charged by applying thereto corona discharge of -6 kV for 20 seconds using a paper analyzer (Paper Analyzer Type SP-428, manufactured by Kawaguchi Denki K.K.) in a dark place at a temperature of 20° C., 65% RH and then allowed to stand for 10 seconds. The surface potential $V_{10}$ was measured. Then, the sample was allowed to stand for 90 seconds in a dark place and then the potential $V_{100}$ was measured. The dark decay retention rate [DRR (%)], i.e., the percent retention of potential after decaying for 90 seconds in a dark place, was calculated from the following formula: DRR $(\%)=(V_{100}/V_{10})\times 100$ (%).

Also, the surface of the photoconductive layer was charged to −400 V by corona discharge, then irradiated by monochromatic light of a wavelength of 780 nm, the time required for decaying the surface potential ($V_{10}$) to 1/10 thereof, and the exposure amount $E_{1/10}$ (erg/cm$^2$) was calculated therefrom.

2) Image Forming Performance:

Each light-sensitive material was allowed to stand a whole day and night under the conditions described below. Then, each sample was charged to −5 kV, exposed by scanning with a gallium-aluminum-arsenic semiconductor laser (oscillation wavelength 750 nm) of 2.8 mW output as a light source at an exposure amount on the surface of 64 erg/cm$^2$, at a pitch of 25 μm, and a scanning speed of 300 m/sec., and developed using ELP-T (made by Fuji Photo Film Co., Ltd.) as a liquid developer followed by fixing. Then, the duplicated images (fog and image quality) were visually evaluated.

The environmental conditions at the image formation were 20° C. and 65% RH or 30° C. and 80% RH.

As is clear from the results shown in Table 5 above, the light-sensitive material according to the present invention exhibits excellent electrostatic characteristics and image forming performance in spite of the notable change of environmental conditions. On the contrary, the light-sensitive materials of Comparative Examples A-1 to C-1 show insufficient characteristics for practical use.

EXAMPLES 2 TO 4

Electrophotographic light-sensitive materials were prepared according to the same procedure as Example 1 described above except that 40 g of the resins shown in Table 6 were used in place of 40 g of Resin (A-1), respectively.

TABLE 6

| Example No. | Resin (A) | Chemical Structure | Mw |
|---|---|---|---|
| 2 | (A-2) | 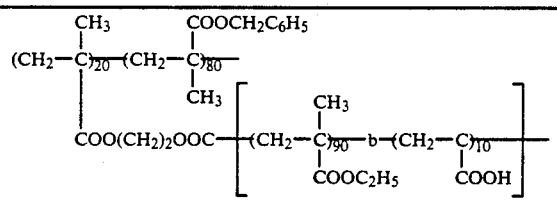 | $3.5\times 10^4$ |
| 3 | (A-3) | 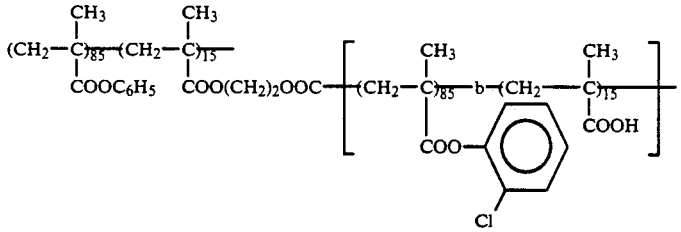 | $4.3\times 10^4$ |
| 4 | (A-4) | 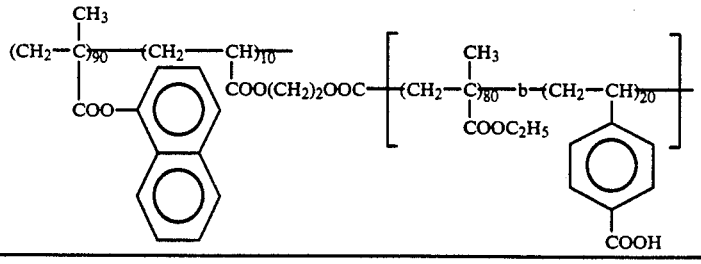 | $4.0\times 10^4$ |

As a result of the evaluations of these materials as described in Example 1, the excellent electrostatic characteristics and image forming performance similar to those in Example 1 were obtained.

EXAMPLE 5

A mixture of 6.0 g of Resin (AL-1) described above, 34.0 g of Resin (AH-1) described above, 200 g of zinc oxide, 0.018 g of Cyanine Dye (II) shown below, 0.10 g of phthalic anhydride, and 300 g of toluene was dispersed in a ball mill for 3 hours to prepare a coating composition for a light-sensitive layer. The coating composition was coated on paper, which had been subjected to electrically conductive treatment, with a wire bar at a dry coverage of 18 g/m$^2$, followed by drying at 110° C. for 30 seconds. The coated material was then allowed to stand in a dark place at 20° C. and 65% RH (relative humidity) for 24 hours to prepare an electrophotographic light-sensitive material.

Cyanine Dye (II):

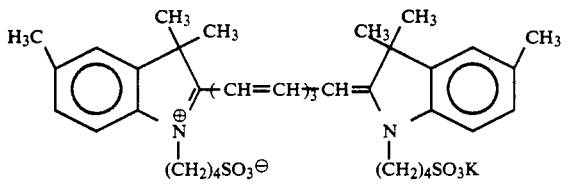

COMPARATIVE EXAMPLE D-1

An electrophotographic light sensitive material was prepared according to the same procedure as Example described above except that 6.0 g of Resin (R-1) described above and 34.0 g of Resin (R-2) described above were used in place of 6.0 g of Resin (AL-1) and 34.0 g of Resin (AH-1).

COMPARATIVE EXAMPLE E-1

An electrophotographic light-sensitive material was prepared according to the same procedure as Comparative Example D-1 described above except that 6.0 g of Resin (R-3) described above was used in place of 6.0 g of Resin (R-1).

COMPARATIVE EXAMPLE F-1

An electrophotographic light-sensitive material was prepared according to the same procedure as Example described above except that 40 g of Resin (R-4) shown below was used in place of 6.0 g of Resin (AL-1) and 34.0 g of Resin (AH-1).

Resin (R-4):

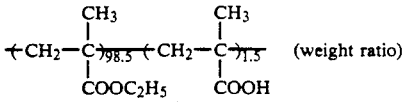

Mw: 4.3 × 10$^4$ (random copolymer)

Each of the light-sensitive materials obtained was evaluated for film properties in terms of surface smoothness and mechanical strength; electrostatic characteristics; image forming performance; and image forming performance under conditions of 30° C. and 80% RH.

The results obtained are shown in Table 7 below.

TABLE 7

| | Example 2 | Comparative Example D-1 | Comparative Example E-1 | Comparative Example F-1 |
|---|---|---|---|---|
| Smoothness of Photo-*3 conductive Layer (sec/cc) | 135 | 130 | 125 | 130 |
| Mechanical Strength of*4 Photoconductive Layer (%) | 92 | 93 | 90 | 96 |
| Electrostatic Characteristics | | | | |
| $V_{10}$ (−V) | 500 | 480 | 485 | 430 |
| DRR (%) | 88 | 65 | 70 | 36 |
| $E_{1/10}$ (erg/cm$^2$) | 19 | 45 | 38 | 83 |
| $E_{1/100}$*5 (erg/cm$^2$) | 35 | 88 | 73 | 200 or more |
| Image Forming Performance | | | | |
| I: (20° C., 65% RH) | Good | No Good (Reduced DM, Slight scratches of fine lines and letters) | No Good (Reduced DM) | Very Poor (Severe background fog, Reduced DM) |
| II: (30° C., 80% RH) | Good | Poor (Reduced DM, Slight background fog) | No Good (Reduced DM, Slight scratches of fine lines and letters) | Very Poor (Indiscriminate images from background fog) |
| Contact Angle with*6 Water (°) | 10 or less | 10 or less | 10 or less | 15 to 25 (widely scattered) |
| Printing Durability*7 (using a plate prepared under Condition II) | 10,000 or more | Slight background stains from the start of printing | Notable cut of letters from 3000th print | Background stains from the start of printing |

The evaluations described in Table 7 above were conducted as follows.

3) Smoothness of Photoconductive Layer:

The smoothness (sec/cc) of each light-sensitive material was measured using a Beck's smoothness test machine (manufactured by Kumagaya Riko K.K.) under an air volume condition of 1 cc.

4) Mechanical Strength of Photoconductive Layer:

The surface of each light-sensitive material was repeatedly rubbed 1,000 times with emery paper (#1000) under a load of 50 g/cm$^2$ using a Heidon 14 Model surface testing machine (manufactured by Shinto Kagaku K.K.). After removing abrasion dusts from the layer, the film retention (%) was determined from the weight loss of the photoconductive layer, which was referred to as the mechanical strength.

5) Electrostatic Characteristics $E_{1/100}$:

In a similar manner to the determination of $E_{1/10}$ described in *1) above, the exposure amount $E_{1/100}$ (erg/cm$^2$) was determined by measuring the time for decaying the surface potential ($V_{10}$) to 1/100 thereof.

6) Contact Angle with Water:

Each light-sensitive material was passed once through an etching processor using an oil-desensitizing solution ELP-EX (made by Fuji Photo Film Co., Ltd.) diluted to a 2-fold volume with distilled water to desensitize the surface of the photoconductive layer. Then, one drop of distilled water (2 μl) was placed on the surface, and the contact angle between the surface and the water drop formed thereon was measured using a goniometer.

7) Printing Durability:

Each light-sensitive material was subjected to the plate making under the same condition as described in 2) above to form a toner image, the sample was oil-desensitized under the same condition as in 6) described above, and the printing plate thus prepared was mounted on an offset printing machine (Oliver Model 52 manufactured by Sakurai Seisakusho K.K.) as an offset master plate following by printing. Then, the number of prints obtained without causing background stains on the non-image portions of prints and problems on the quality of the image portions was referred to as the printing durability. (The larger the number of prints, the better the printing durability.)

As is clear from the results shown in Table 7 above, the smoothness of the photoconductive layer was almost the same in each light-sensitive material. However, the electrostatic characteristics were excellent in the light-sensitive material according to the present invention, and, in particular, the photosensitivity in the $E_{1/100}$ value was greatly improved as compared with the comparative light-sensitive materials. This fact indicates that, in the comparative electrophotographic light-sensitive materials, the potential remaining at the areas corresponding to the non-image portions after light exposure is not lowered. When images are actually formed using the comparative light-sensitive materials, the remaining potential forms a background fog phenomenon at the non-image portions.

The image-forming performance was also excellent in the electrophotographic light-sensitive material according to the present invention. The light-sensitive materials of Comparative Examples D-1 and E-1 were much better than the light-sensitive material of Comparative Example F-1, but they were yet unsatisfactory under the image forming condition by the scanning exposure system using a low output semiconductor laser at a high speed.

Moreover, with respect to the contact angle with water when the light-sensitive materials were subjected to the oil-desensitizing treatment, although the light-sensitive material of Comparative Example F-1 exhibits the larger and scattered value, other light-sensitive materials showed as small as 10 degree or below which indicated that the surface of each sample was sufficiently rendered hydrophilic. However, when each printing plate precursor obtained by plate making of the light-sensitive material was oil-desensitized to prepare a printing plate followed by printing therewith, only the printing plate formed from the light-sensitive material according to the present invention can provide 10,000 prints of clear image free from background stains. On the contrary, in case of using the light-sensitive material of Comparative Example D-1 or E-1, background stains due to background fog on the printing plate precursor or cut of images occurred.

EXAMPLES 6 AND 7

A mixture of 6.5 g of Resin (AL-3) (Example 6) or 6.5 g of Resin (AL-8) (Example 7), 33.5 g of Resin (AH-2), 200 g of zinc oxide, 0.018 g of Cyanine Dye (III) shown below, 0.20 g of salicylic acid, and 300 g of toluene was dispersed in a ball mill for 3 hours to prepare a coating composition for a light-sensitive layer. The coating composition was coated on paper, which had been subjected to an electrically conductive treatment, by a wire bar at a dry coverage of 20 g/m$^2$, and dried for 30 seconds at 110° C. Then, the coated material was allowed to stand in a dark place for 24 hours under the conditions of 20° C. and 65% RH to prepare each electrophotographic light-sensitive material.

Cyanine Dye (III):

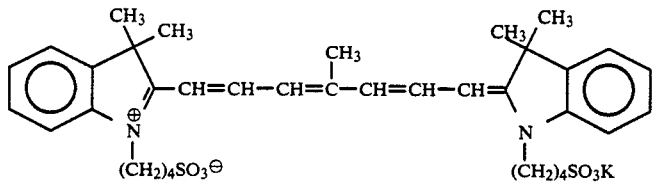

The smoothness, mechanical strength, and the electrostatic characteristics of each of the electrophotographic light-sensitive materials were measured by the same procedure as described in Examples 1 and 5.

Furthermore, each electrophotographic light-sensitive material was used as an offset master plate and, after subjecting to an oil-desensitizing treatment, printing was conducted.

The results obtained are shown in Table 8 below.

TABLE 8

| | Example 6 | Example 7 |
|---|---|---|
| Smoothness of Photoconductive Layer (sec/cc) | 135 | 140 |
| Mechanical Strength of Photoconductive Layer (%) | 96 | 97 |

TABLE 8-continued

| | Example 6 | Example 7 |
|---|---|---|
| Electrostatic Characteristics | | |
| $V_{10}$ (−V) | 550 | 610 |
| DRR (%) | 86 | 89 |
| $E_{1/10}$ (erg/cm$^2$) | 25 | 18 |
| $E_{1/100}$ (erg/cm$^2$) | 51 | 33 |
| Image-Forming Performance | | |
| I (20° C., 65%) | Good | Very Good |
| II (30° C., 80%) | Good | Very Good |
| Contact Angle with Water (°) | 10 or less | 10 or less |
| Printing Durability | 10,000 | 10,000 |

The evaluations were conducted in the same manner as in Table 7 above.

As is clear from the results shown in Table 8 above, each of the electrophotographic light-sensitive materials showed good electrophotographic characteristics. In particular, the light-sensitive material in Example 7 using the resin (AL) composed of the methacrylate component having the specific substituent further exhibited good photosensitivity and good dark decay retention rate.

Also, when each of the light-sensitive materials was used as an offset master plate precursor, the oil-desensitizing treatment with an oil-desensitizing solution sufficiently proceeded and the contact angle with water at the non-image portion was as small as 10 degree or below, which indicated that the non-image portions were sufficiently rendered hydrophilic. When each master plate was actually used for printing, no background stains of prints were observed.

EXAMPLES 8 TO 14

A mixture of 6.0 g of each of the resins (AL) shown in Table 9 below, 34.0 g of each of the resins (AH) shown in Table 9 below, 200 g of zinc oxide, 0.010 g of Cyanine Dye (IV) shown below, 0.20 g of maleic anhydride, and 300 g of toluene was dispersed in a ball mill for 3 hours to prepare a coating composition for a light-sensitive layer. The coating composition was coated on paper, which had been subjected to an electrically conductive treatment, by a wire bar at a dry coverage of 22 g/cm$^2$, and dried for 30 seconds at 110° C. Then, the coated material was allowed to stand in a dark place for 24 hours under the conditions of 20° C. and 65% RH to obtain each electrophotographic light-sensitive material.

Cyanine Dye (IV):

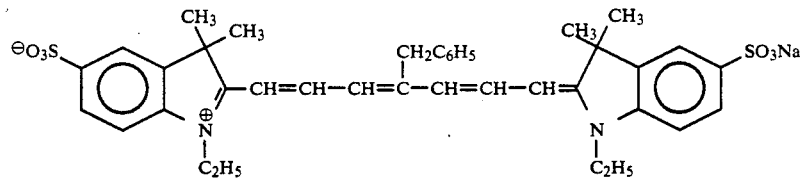

The electrostatic characteristics, image forming performance and printing durability of each of the electrophotographic light-sensitive materials were determined by the same procedure as described in Example 5.

The results obtained are shown in Table 9 below, in which the results with respect to the electrostatic characteristics and image forming performance are those obtained under the severe conditions of 30° C. and 80% RH.

TABLE 9

| Example No. | Resin (AL) | Resin (AH) | Electrostatic Characteristics $V_{10}$ (−V) | DRR (%) | $E_{1/10}$ (erg/cm$^2$) | Image Forming Performance | Printing Durability |
|---|---|---|---|---|---|---|---|
| 8 | L-9 | H-3 | 600 | 87 | 18 | Very Good | 10,000 |
| 9 | L-10 | H-5 | 565 | 85 | 23 | Very Good | 10,000 |
| 10 | L-11 | H-4 | 630 | 89 | 17 | Very Good | 10,000 |
| 11 | L-12 | H-7 | 565 | 88 | 20 | Very Good | 10,000 |
| 12 | L-14 | H-8 | 560 | 86 | 21 | Very Good | 10,000 |
| 13 | L-18 | H-15 | 610 | 89 | 18 | Very Good | 10,000 |
| 14 | L-24 | H-9 | 605 | 87 | 20 | Very Good | 10,000 |

Each of the electrophotographic light-sensitive materials according to the present invention exhibited good mechanical strength of the photoconductive layer and the good electrostatic characteristics, and the duplicated images actually formed had clear image quality free from background fog even under the high-temperature and high-humidity conditions (30° C. and 80% RH).

Furthermore, when each of the light-sensitive materials was used for printing as an offset master plate, 10,000 prints having good image quality could be obtained.

EXAMPLES 15 TO 22

A mixture of 6.5 g of each of the resins (AL) shown in Table 10 below, 34 g of each of the resins (AH) shown in Table 10 below, 200 g of zinc oxide, 0.02 g of Methine Dye (V) shown below, 0.15 g of phthalic anhydride, and 300 g of toluene was dispersed in a ball mill for 3 hours to prepare a coating composition for a light-sensitive layer. Then, according to the same procedure as described in Example 5, each electrophotographic light-sensitive material was prepared.

TABLE 10

Methine Dye (V):

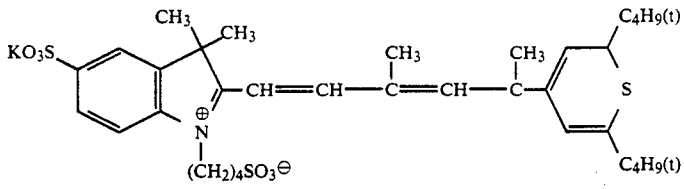

| Example No. | Resin (AL) | Resin (AH) |
|---|---|---|
| 15 | L-4 | H-4 |
| 16 | L-5 | H-6 |
| 17 | L-13 | H-7 |
| 18 | L-23 | H-4 |
| 19 | L-25 | H-5 |
| 20 | L-29 | H-8 |
| 21 | L-31 | H-14 |
| 22 | L-35 | H-20 |

As the results of the evaluation as described in Example 5, it can be seen that each of the light-sensitive materials according to the present invention is excellent in charging properties, dark charge retention rate, and photosensitivity, and provides clear duplicated images free from background fog even when processed under severe conditions of high temperature and high humidity (30° C. and 80% RH). Further, when these materials were employed as offset master plate precursors as described in Example 5, 10,000 prints of a clear image free from background stains were obtained respectively.

EXAMPLES 23 TO 24

A mixture of 6.5 g of Resin (AL-1) (Example 23) or Resin (AL-2) (Example 24), 33.5 g of Resin (AH-2), 200 g of zinc oxide, 0.02 g of uranine, 0.04 g of Rose Bengale, 0.03 g of bromophenol blue, 0.20 g of phthalic anhydride, and 300 g of toluene was dispersed in a ball mill for 2 hours to prepare a coating composition for a light-sensitive layer. The coating composition was coated on paper, which has been subjected to electrically conductive treatment, with a wire bar at a dry coverage of 20 g/m$^2$, and dried for one minute at 110° C. Then, the coated material was allowed to stand in a dark place for 24 hours under the conditions of 20° C. and 65% RH to prepare each electrophotographic light-sensitive material.

COMPARATIVE EXAMPLE G-1

An electrophotographic light-sensitive material was prepared in the same manner as in Example 23, except for using 6.5 g of Resin (R-3) described above and 33.5 g of Resin (R-2) described above in place of 6.5 g of Resin (AL-1) and 33.5 g of Resin (AH-2).

Each of the light-sensitive materials obtained was evaluated its characteristics in the same manner as in Example 5, except that the electrostatic characteristics and image forming performance were evaluated according to the following test methods.

8) Electrostatic Characteristics $E_{1/10}$ and $E_{1/100}$:

The surface of the photoconductive layer was charged to −400 V with corona discharge, then irradiated by visible light of the illuminance of 2.0 lux, the time required for decay of the surface potential ($V_{10}$) to 1/10 or 1/100 thereof, and the exposure amount $E_{1/10}$ or $E_{1/100}$ (lux.sec) was calculated therefrom.

9) Image Forming Performance:

Each electrophotographic light-sensitive material was allowed to stand a whole day and night under the environmental conditions of 20° C. and 65% RH (Condition I) or 30° C. and 80% RH (Condition II), the light-sensitive material was image exposed and developed by a full-automatic plate making machine (ELP-404V made by Fuji Photo Film Co., Ltd.) using ELP-T as a toner. The duplicated image thus obtained was visually evaluated for fog and image quality. The original used for the duplication was composed of cuttings of other originals pasted up thereon.

The results obtained are shown in Table 11 below.

TABLE 11

| | Example 23 | Example 24 | Comparative Example G-1 |
|---|---|---|---|
| Binder Resin | (AL-1)/(AH-2) | (AL-2)/(AH-2) | (R-3)/(R-2) |
| Smoothness of Photoconductive Layer (sec/cc) | 135 | 130 | 130 |
| Mechanical Strength of Photoconductive Layer (%) | 97 | 93 | |
| Electrostatic*8 Characteristics: | | | |
| $V_{10}$ (−V): | 550 | 610 | 540 |
| DRR (%): | 90 | 97 | 90 |
| $E_{1/10}$ (erg/cm$^2$): | 11.0 | 7.0 | 12.3 |
| $E_{1/100}$ (erg/cm$^2$): | 20.5 | 13.5 | 51 |
| Image-Forming Performance*9: | | | |
| Condition I | Good | Very Good | Poor (edge mark of cuttings) |

TABLE 11-continued

| | Example 23 | Example 24 | Comparative Example G-1 |
|---|---|---|---|
| Condition II | Good | Very Good | Poor (sever edge mark of cuttings) |
| Contact Angle with Water (°) | 10 or less | 10 or less | 10 or less |
| Printing Durability | 10,000 | 10,000 | Background stains due to edge mark of cutting from the start of printing |

From the results shown in Table 11 above, it can be seen that each light-sensitive material exhibits almost same properties with respect to the surface smoothness and mechanical strength of the photoconductive layer. However, on the electrostatic characteristics, the sample of Comparative Example G-1 has a lager value of $E_{1/100}$, particularly under the high temperature and high humidity conditions. On the contrary, the electrostatic characteristics of the light-sensitive material according to the present invention are good. Further, those of Example 24 using the resin (AL) having the specific substituent are very good. The value of $E_{1/100}$ is particularly small.

With respect to image-forming performance, the edge mark of cuttings pasted up was observed as background fog in the non-image areas in the sample of Comparative Example G-1. On the contrary, the samples according to the present invention provided clear duplicated images free from background fog.

Further, each of these samples was subjected to the oil-desensitizing treatment to prepare an offset printing plate and printing was conducted. The samples according to the present invention provided 10,000 prints of clear image without background stains. However, with the sample of Comparative Example G-1, the above described edge mark of cuttings pasted up was not removed with the oil-desensitizing treatment and the background stains occurred from the start of printing.

As can be seen from the above results, only the light-sensitive material according to the present invention can provide the excellent performance.

EXAMPLES 25 TO 36

Electrophotographic light-sensitive materials were prepared in the same manner as described in Example 23, except for replacing 6.5 g Resin (AL-1) with 6.5 g of each of Resins (AL) shown in Table 12 below and replacing 33.5 g of Resin (AH-2) with 33.5 g of each of Resins (AH) shown in Table 12 below.

TABLE 12

| Example No. | Resin (AL) | Resin (AH) |
|---|---|---|
| 25 | AL-3 | AH-1 |
| 26 | AL-4 | AH-2 |
| 27 | AL-5 | AH-3 |
| 28 | AL-7 | AH-7 |
| 29 | AL-15 | AH-14 |
| 30 | AL-17 | AH-11 |
| 31 | AL-18 | AH-17 |
| 32 | AL-19 | AH-18 |
| 33 | AL-23 | AH-4 |
| 34 | AL-24 | AH-5 |
| 35 | AL-26 | AH-8 |
| 36 | AL-35 | AH-9 |

As the results of the evaluation as described in Example 23, it can be seen that each of the light-sensitive materials according to the present invention is excellent in charging properties, dark charge retention rate, and photosensitivity, and provides clear duplicated images free from background fog and scratches of five lines even when processed under severe conditions of high temperature and high humidity (30° C. and 80% RH). Further, when these materials were employed as offset master plate precursors, 10,000 prints of a clear image free from background stains were obtained respectively.

EXAMPLE 37

A mixture of 6 g of Resin (AL-1), 30 g of Resin (B-1) shown below, 200 g of zinc oxide, 0.018 g of Cyanine Dye (III) described above, 0.15 g of salicylic acid, and 300 g of toluene was dispersed in a ball mill for 4 hours, and then 3 g of glutaric anhydride was added to the mixture followed by dispersing for 5 minutes to prepare a coating composition for a light-sensitive layer. The coating composition was coated on paper, which had been subjected to an electrically conductive treatment, by a wire bar at a dry coverage of 25 g/m$^2$, dried at 110° C. for 30 seconds, and heated at 120° C. for 2 hours. Then, the coated material was allowed to stand for 24 hours in a dark place under the conditions of 20° C. and 65% RH to obtain an electrophotographic light-sensitive material.

Resin (B-1):

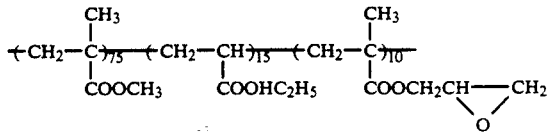

Mw: 5.3 × 10$^4$ (weight ratio)

Cyanine Dye (III):

-continued

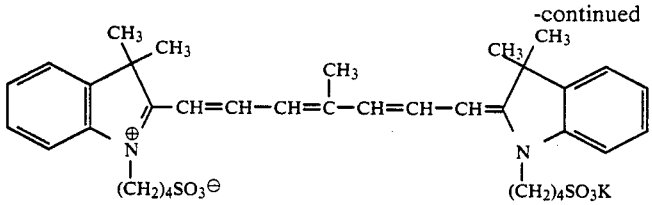

EXAMPLE 38

An electrophotographic light-sensitive material was prepared according to the same procedure as Example 37 except that 6 g of Resin (AL-2) was used in place of 6 g of Resin (AL-1).

COMPARATIVE EXAMPLE A-2

An electrophotographic light-sensitive material was prepared according to the same procedure as Example 37 except that 20 g of Resin (R-5) for comparison shown below was used in place of 6 g of Resin (Al-1).

Resin (R-5):

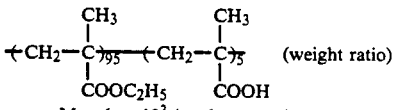

Mw: $6 \times 10^3$ (random copolymer)

COMPARATIVE EXAMPLE B-2

An electrophotographic light-sensitive material was prepared according to the same procedure as Example 37 except that 6 g of Resin (R-6) for comparison shown below was used in place of 6 g of Resin (AL-1).

(R-6):

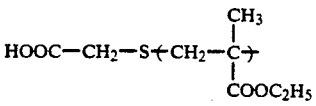

-continued

Mw: $8.0 \times 10^3$

On each electrophotographic light-sensitive material, the electrostatic characteristics and the image-forming performance under the environmental conditions of 20° C. and 65% RH (Condition I) or 30° C. and 80% RH (Condition II) were determined. The results are shown in Table 13 below.

TABLE 13

| | Example 37 | Example 38 | Comparative Example A-2 | Comparative Example B-2 |
|---|---|---|---|---|
| Electrostatic Characteristics*1) | | | | |
| $V_{10}$ (−V) | | | | |
| I: (20° C., 65% RH) | 520 | 630 | 410 | 440 |
| II: (30° C., 80% RH) | 500 | 615 | 375 | 420 |
| DRR (90 sec. value) (%) | | | | |
| I: (20° C., 65% RH) | 78 | 85 | 60 | 70 |
| II: (30° C., 80% RH) | 73 | 82 | 53 | 63 |
| $E_{1/10}$ (erg/cm$^2$) | | | | |
| I: (20° C., 65% RH) | 43 | 25 | 75 | 60 |
| II: (30° C., 80% RH) | 48 | 28 | 80 | 65 |
| $E_{1/100}$ (erg/cm$^2$) | | | | |
| I: (20° C., 65% RH) | 68 | 40 | 128 | 96 |
| II: (30° C., 80% RH) | 73 | 44 | 135 | 105 |
| Image Forming Performance*2) | | | | |
| I: (20° C., 65% RH) | Good | Very Good | Poor (Background fog, Reduced DM) | No Good (Reduced DM, scratches of fine lines) |
| II: (30° C., 80% RH) | Good | Very Good | Poor (Heavy background fog, scratches of fine lines) | No Good (Reduced DM, scratches of fine lines) |

The terms shown in Table 13 were evaluated as follows.

1): Electrostatic characteristics:

After applying corona discharge to each electrophotographic light-sensitive material for 20 seconds at −6 kV using a paper analyzer (Paper Analyzer Type SP-428 made by Kawaguchi Denki K.K.) in a dark place at 20° C. and 65% RH, the light-sensitive material was allowed to stand for 10 seconds and the surface potential $V_{10}$ was measured. Then, the light-sensitive material was allowed to stand in a dark place for 90 seconds and, thereafter, the surface potential $V_{100}$ was measured. The potential retentivity after decaying for 90 seconds, i.e., the dark decay retention rate [DRR (%)] was determined by the equation of $(V_{100}/V_{10}) \times 100$ (%).

Also, after charging the surface of the photoconductive layer to −400 volts by corona discharge, the surface of the photoconductive layer was irradiated by gallium-aluminum-arsenic semiconductor laser (oscillation wavelength 780 nm), the time required to decay the surface potential ($V_{10}$) to 1/10 was measured, and from the value, the exposure amount $E_{1/10}$ (erg/cm$^2$) was calculated therefrom.

Further, in the same manner as described above the time required to decay the surface potential ($V_{10}$) to 1/100 was measured, and from the value, the exposure amount $E_{1/100}$ (erg/cm$^2$) was calculated.

The environmental conditions at the measurement was 20° C. and 65% RH (Condition I) or 30° C. and 80% RH (Condition II).

2): Image-forming performance:

After allowing to stand each electrophotographic light-sensitive material a whole day and night under the environmental conditions of 20° C. and 65% RH (Condition I) or 30° C. and 80% RH (Condition II), each light-sensitive material was charged to −6 kV, and after scanning the surface of the light-sensitive material using a gallium-aluminum-arsenic semiconductor laser (oscillation wavelength 780 nm) as the light source at a pitch of 25 μm and a scanning speed of 300 meters/-second under the illuminance of 50 erg/cm$^2$, the light-sensitive material was developed using a liquid developer (ELP-T made by Fuji Photo Film Co., Ltd.) and fixed. Then, the duplicated images (fog and image quality) were visually evaluated.

As shown in Table 13 above, each of the electrophotographic light-sensitive material according to the present invention had good electrostatic characteristics, and the clear duplicated images having good image quality without background fog were obtained.

On the other hand, in the electrophotographic light-sensitive materials in Comparative Examples A-2 and B-2, the initial potential ($V_{10}$) and the photosensitivity ($E_{1/10}$ and $E_{1/100}$) were lowered, and the density (DM) of the duplicated images was lowered, whereby fine lines and letters were blurred and also background fog was formed.

In particular, the $E_{1/100}$ value of the light-sensitive material according to the present invention is quite different from that of the light-sensitive material for comparison.

The value of $E_{1/100}$ indicates an electrical potential remaining in the non-image areas after exposure at the practice of image formation. The smaller this value, the less the background stains in the non-image areas. More specifically, it is requested that the remaining potential is decreased to −10V or less. Therefore, an amount of exposure necessary to make the remaining potential below −10V is an important factor. In the scanning exposure system using a semiconductor laser beam, it is quite important to make the remaining potential below −10V by a small exposure amount in view of a design for an optical system of a duplicator (such as cost of the device, and accuracy of the optical system).

The above-described results indicate that, only when the binder resin according to the present invention is used, the electrophotographic light-sensitive materials having satisfactory electrostatic characteristics are obtained. Furthermore, in the case of using the binder resin according to the present invention, it has been noted that the electrophotographic light-sensitive material in Example 38 using the resin (AL) containing methacrylate component having the specific substituent exhibits better electrostatic characteristics than the electrophotographic light-sensitive material in Example 37 and, in particular, the former case is more excellent in the semiconductor laser light scanning exposure system.

EXAMPLE 39

A mixture of 5.4 g of Resin (AL-19), 30.6 g of Resin (B-2) shown below, 200 g of zinc oxide, 0.018 g of Cyanine Dye (V) shown below, and 300 g of toluene was dispersed in a ball mill for 4 hours and, after further adding thereto 2.5 g of 1,3-diisocycyanurate, the mixture was further dispersed for 5 minutes in a ball mill to prepare a coating composition for a light-sensitive layer. The coating composition was coated on paper, which had been subjected to an electrically conductive treatment, by a wire bar at a dry coverage of 22 g/m$^2$, 100° C. for 30 seconds and then, heated to 120° C. for 1.5 hours. The coated material was allowed to stand in a dark place for 24 hours under the conditions of 20° C. and 65% RH to prepare an electrophotographic light-sensitive material.

Resin (B-2):

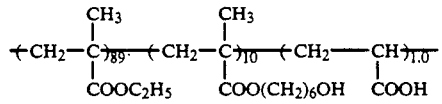

Mw: 3.8 × 10$^4$ (weight ratio)

Cyanine Dye (VI):

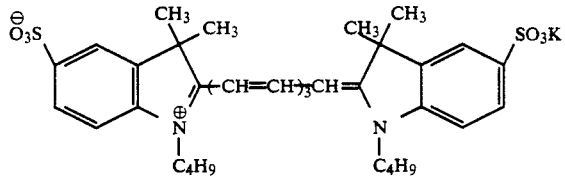

With the light-sensitive material thus prepared, the film properties in terms of surface smoothness and mechanical strength, and the electrostatic characteristics, image-forming performance and printing durability under the environmental conditions of 20° C. and 65% RH or 30° C. and 80% RH were determined.

The results obtained are shown in Table 14 below.

TABLE 14

| | Example 39 |
|---|---|
| Smoothness of Photoconductive Layer*3) (sec/cc) | 380 |
| Mechanical Strength of Photoconductive Layer*4) (%) | 95 |
| Electrostatic Characteristics | |
| $V_{10}$ (−V) | |
| I: (20° C., 65% RH) | 630 |
| II: (30° C., 80% RH) | 615 |
| DRR (90 sec. value) (%) | |
| I: (20° C., 65% RH) | 85 |
| II: (30° C., 80% RH) | 82 |
| $E_{1/10}$ (erg/cm$^2$) | |
| I: (20° C., 65% RH) | 26 |
| II: (30° C., 80% RH) | 30 |
| $E_{1/100}$ (erg/cm$^2$) | |
| I: (20° C., 65% RH) | 39 |
| II: (30° C., 80% RH) | 43 |
| Image-Forming Performance | |
| I: (20° C., 65% RH) | Very Good |
| II: (30° C., 80% RH) | Very Good |
| Contact Angle with Water*5) (°) | 10 or less |
| Printing Durability*6) | 10,000 |

The evaluations described in Table 14 were conducted as follows.

3): Smoothness of Photoconductive Layer:

The smoothness (sec/cc) of the electrophotographic light-sensitive material was measured using a Back's smoothness test machine (manufactured by Kumagaya Riko K.K.) under an air volume condition of 1 cc.

4):Mechanical Strength of Photoconductive Layer:

The surface of the light-sensitive material was repeatedly (500 times) rubbed with emery paper (#1000) under a load of 70 g/cm$^2$ using a Heidon 14 Model surface testing machine (manufactured by Shinto Kagaku K.K.). After removing abrasion dusts from the layer, the film retention (%) was determined from the weight loss of the photoconductive layer, which was referred to as the mechanical strength.

5) Contact Angle with Water:

After the photoconductive layer of the electrophotographic light-sensitive material was subjected to an oil-desensitizing treatment by passing once through an etching processor using a solution formed by diluting an oil-desensitizing solution ELP-EX (made by Fuji Photo Film Co., Ltd.) to a 2-fold volume with distilled water, a water drop of 2 $\mu$l of distilled water was placed on the surface and the contact angle with the water drop formed was measured with a goniometer.

6): Printing Durability:

The light-sensitive material was subjected to plate making in the same manner as the image-forming performance in the above-described 2) to form a toner image and then subjected an oil-desensitizing treatment under the same condition as in 5) above. The printing plate thus prepared was mounted on an offset printing machine (Oliver 52 Type manufactured by Sakurai Seisakusho) as an offset master plate followed by printing. The number of prints obtained without causing background stains at the non-image portions and problems on the image quality of the image portions of the prints was referred to as the printing durability. (The larger the number of prints, the better the printing durability.)

As shown in Table 14 above, the electrophotographic light-sensitive material according to the present invention has the good smoothness, mechanical strength of the photoconductive layer and the good electrostatic characteristics, and provides the clear duplicated images without background fog. This is presumed to be obtained by that the binder resin is sufficiently adsorbed onto particles of the photoconductive substance and the binder resin coats the surface of the particles.

Also, when the light-sensitive material is used as an offset master plate precursor, an oil-desensitizing treatment with an oil-desensitizing solution sufficiently proceeded and the contact angle between the non-image portion and a water drop was as small as less than 0 degree, which indicated the non-image portion was sufficiently rendered hydrophilic. When the plate was actually used for printing, no background stains was observed on the prints obtained and 10,000 prints having a clear image quality were obtained.

The above results indicate that the film strength is greatly improved by the action of the resin (B) or the combination of the resin (B) and the crosslinking agent without damaging the action of the resin (A).

EXAMPLE 40 TO 47

Each of the electrophotographic light-sensitive materials was prepared according to the same procedure as described in Example 39 except that each of the resins and each of the crosslinking agents shown in Table 15 below were used in place of 5.4 g of Resin (AL-19), 30.6 g of Resin (B-2), and 2.5 g of 1,3-xylylenediisocyanate as the crosslinking agent, and also 0.020 g of Cyanine Dye (VII) shown below was used in place of Cyanine Dye (VI).

Cyanine Dye (VII):

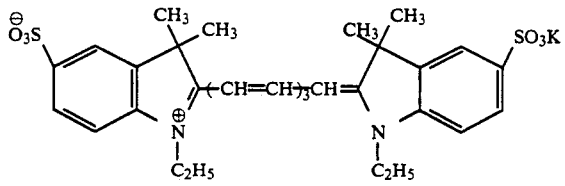

Characteristics of each of the electrophotographic light-sensitive materials were measured in the same manner as in Example 39, and the results obtained are shown in Table 15 below. In Table 15, the electrostatic characteristics measured under the environmental conditions of 30° C. and 80% RH are shown.

TABLE 15
| Example | Resin (AL) 10 g | Resin (B) | 30 g | Crosslinking Agent | | Electrostatic Characteristics (30° C., 80% RH) $V_{10}$ (−V) | DRR (%) | $E_{1/100}$ (erg/cm$^2$) |
|---|---|---|---|---|---|---|---|---|
| 40 | (AL-2) | 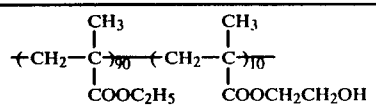 (B-3) | Mw 38,000 | 1,3-Xylylenediisocyanate | 1.5 g | 610 | 80 | 46 |
| 41 | (AL-13) | 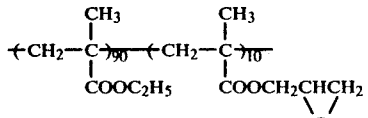 (B-4) | Mw 40,000 | 1,6-Hexamethylenediamine | 1.3 g | 570 | 81 | 45 |
| 42 | (AL-4) | 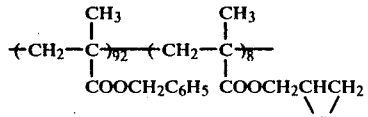 (B-5) | Mw 41,000 | Terephthalic Acid | 1.5 g | 550 | 75 | 53 |
| 43 | (AL-8) | 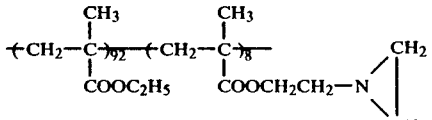 (B-6) | Mw 38,000 | 1,4-Tetramethylenediamine | 1.2 g | 630 | 86 | 43 |
| 44 | (AL-12) | 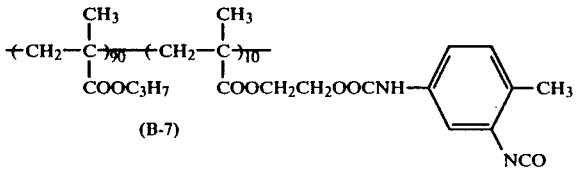 (B-7) | Mw 37,000 | Polyethylene Glycol | 1.2 g | 540 | 79 | 48 |
| 45 | (AL-24) | " | " | Polypropylene Glycol | 1.2 g | 580 | 83 | 43 |
| 46 | (AL-31) | 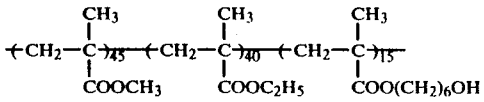 (B-8) | Mw 42,000 | 1,6-Hexamethylene Diisocyanate | 2 g | 590 | 83 | 46 |

TABLE 15-continued

| Example | Resin (AL) 10 g | Resin (B) | 30 g | Crosslinking Agent | | Electrostatic Characteristics (30° C., 80% RH) $V_{10}$ (−V) | DRR (%) | $E_{1/100}$ (erg/cm$^2$) |
|---|---|---|---|---|---|---|---|---|
| 47 | (AL-35) | $\leftarrow CH_2-\underset{\underset{COOC_2H_5}{\mid}}{\overset{\overset{CH_3}{\mid}}{C}}\rightarrow_{80}\leftarrow CH_2-\underset{\underset{COOCH_2CH_2COOCH=CH_2}{\mid}}{\overset{\overset{CH_3}{\mid}}{C}}\rightarrow_{20}$ (B-9) | Mw 55,000 | Ethylene Glycol Dimethacrylate | 2 g | 605 | 84 | 44 |

As shown in Table 15, each of the electrophotographic light-sensitive materials according to the present invention was excellent in the charging property, dark charge retention rate, and photosensitivity and provided clear duplicated images without the formation of background fog and the formation of cut of fine lines even under severe conditions (30° C., 80% RH).

Also, when each of the light-sensitive materials was used for printing as an offset master plate, more than 10,000 prints having clear images without background stains could be obtained.

EXAMPLES 48 TO 51

A mixture of 6 g of each of the resins (AL) shown in Table 16 below, 18 g of each of Group X of the resins (B) shown in Table 16, 200 g of zinc oxide, 0.018 g of Cyanine Dye (III) described above, and 300 g of toluene was dispersed in a ball mill for 3 hours. Then, 12 g of each of Group Y of the resins (B) shown in Table 16 was added thereto and the resulting mixture was dispersed for 10 minutes in a ball mill to obtain a coating composition for a light-sensitive layer.

The coating composition was coated on paper, which had been subjected to an electrically conductive treatment, by a wire bar at a dry coverage of 20 g/m$^2$, heated to 100° C. for 15 seconds, and then heated to 120° C. for 2 hours. The coated material was allowed to stand in a dark place for 24 hours under the conditions of 20° C. and 65% RH to prepare each of the electrophotographic light-sensitive materials.

TABLE 16
| Example | Resin (AL) | Resin (B) | Group X | | Resin (B) | Group Y | |
|---|---|---|---|---|---|---|---|
| 48 | (AL-10) | 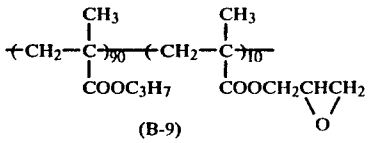 (B-9) | | Mw 42,000 | 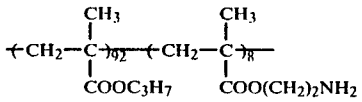 (B-10) | | Mw 38,000 |
| 49 | (AL-11) | 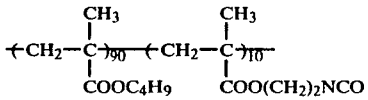 (B-11) | | Mw 45,000 | " | | " |
| 50 | (AL-20) | 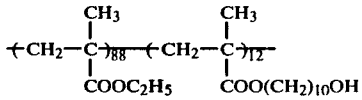 (B-12) | | Mw 38,000 | 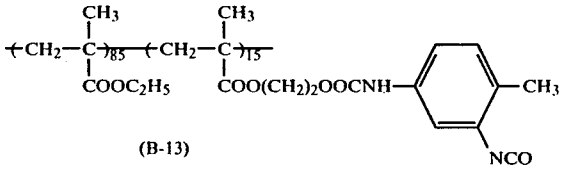 (B-13) | | Mw 46,000 |
| 51 | (AL-26) | (B-10) | | | 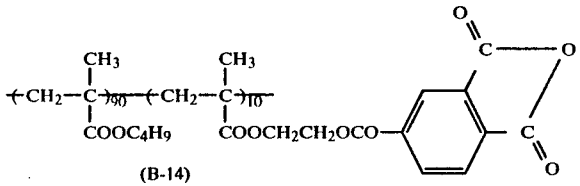 (B-14) | | Mw 33,000 |

Each of the electrophotographic light-sensitive materials according to the present invention was excellent in the charging property, dark charge retention rate, and photosensitivity, and provided, clear duplicated images having no background fog even under severe high temperature and high humidity conditions (30° C., 80% RH).

Furthermore, each light-sensitive material was used for printing as an offset master plate, 10,000 prints having clear images were obtained.

EXAMPLE 52

A mixture of 6 g of Resin (AL-15), 18 g of Resin (B-15) shown below, 200 g of zinc oxide, 0.50 g of Rose Bengale, 0.25 g of tetrabromophenol blue, 0.30 g of uranine, and 240 g of toluene was dispersed in a ball mill for 4 hours, and, after further adding thereto 12 g of Resin (B-15) shown below, the resulting mixture was dispersed in a ball mill for 5 minutes to prepare a coating composition for a light-sensitive layer.

The coating composition was then coated on paper, which had been subjected to an electrically conductive treatment, by a wire bar at a dry coverage of 20 g /m$^2$, heated to 110° C. for 30 seconds, and then heated to 120° C. for 2 hours. The coated material was allowed to stand in a dark place for 24 hours under the conditions of 20° C. and 65% RH to obtain an electrophotographic light-sensitive material.

Resin (B-15):

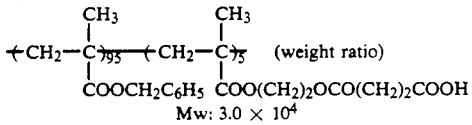

Characteristics of the light-sensitive material were measured in the same manner as in Example 37 except the electrostatic characteristics and image forming performance, and the results obtained were as follows.

Smoothness of Photoconductive Layer: 430 (sec/cc)

Mechanical Strength of Photoconductive Layer: 97 (%)

| Electrostatic characteristics | $V_{10}$ (V) | DRR (%) | $E_{1/10}$ (lux · sec) |
|---|---|---|---|
| I (20° C., 65% RH) | 580 | 92 | 10.8 |
| II (30° C., 80% RH) | 560 | 89 | 11.5 |
| Image Forming Performance: | | Good duplicated images were obtained under both the conditions of 20° C. and 65% RH and 30° C. and 80% RH. | |
| Printing Durability: | | 10,000 prints having good image quality were obtained. | |

As described above, the electrophotographic light-sensitive material according to the present invention had excellent electrophotographic characteristics and exhibited a good printing durability.

The evaluation of the electrostatic characteristics and the image forming performance were conducted as follows.

Electrostatic Characteristics:

After applying corona discharge onto a electrophotographic light-sensitive material using a paper analyzer (Paper Analyzer Type SP-428 made by Kawaguchi Denki K.K.) at −6 kV for 20 seconds in a dark place under the conditions of 20° C. and 65% RH, the light-sensitive material was allowed to stand for 10 seconds and the surface potential $V_{10}$ was measured. Then, the light-sensitive material was allowed to stand in a dark place for 60 seconds, and thereafter the surface potential $V_{70}$ was measured. The retentivity of potential, that is, the dark decay retention rate [DRR (%)] was determined by the equation of $(V_{70}/V_{10})\times 100$ (%).

Also, after charging the surface of the photoconductive layer to −400 volts by corona discharge, the surface of the photoconductive layer was irradiated by visible light of 2.0 lux, the time required to decay the surface potential ($V_{10}$) to 1/10 thereof was determined and the exposure amount $E_{1/10}$ (lux second) was calculated therefrom.

Image-forming Performance:

The electrophotographic light-sensitive material was imagewise exposed and developed by a full automatic plate making machine (ELP 404V made by Fuji Photo Film Co., Ltd.) using a liquid developer (ELP-T made by Fuji Photo Film Co., Ltd.) to form toner images.

EXAMPLES 53 TO 54

A mixture of 7 g of Resin (Al-3) or Resin (AL-21), 29 g of each of Resins (B) shown in Table 17 below, 200 g of zinc oxide, 0.02 g of uraine, 0.04 g of Rose Bengale, 0.03 g of bromophenol blue, and 300 g of toluene was dispersed in a ball mill for 4 hours to prepare a coating composition for a light-sensitive layer. The coating composition was coated on paper, which had been subjected to an electrically conductive treatment, by a wire bar at a dry coverage of 25 g /m$^2$, dried for one minute at 110° C., and thereafter the layer was indicated with a high-pressure mercury lamp for 3 minutes. The coated material was allowed to stand for 24 hours under the conditions of 20° C. and 65% RH to prepare each electrophotographic light-sensitive material.

The characteristics of the electrophotographic light-sensitive materials are shown in Table 18 below.

TABLE 17

| Example | Resin (A) | Resin (B) |
|---|---|---|
| 53 | (AL-3) | 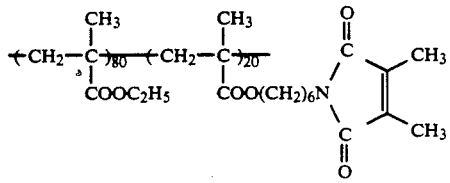 |

(B-16) Mw 5.4 × 10$^4$

TABLE 17-continued

| Example | Resin (A) | Resin (B) |
|---|---|---|
| 54 | (AL-21) | 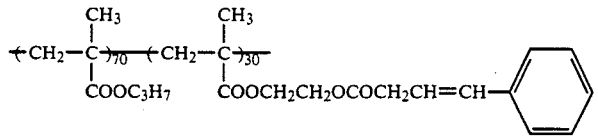 (B-17) Mw: $5.4 \times 10^4$ |

TABLE 18

| Example | Smoothness (sec/cc) | Mechanical Strength (%) | $V_{10}$ (−V) | DRR (%) | $E_{1/10}$ (lux · sec) | Printing Durability |
|---|---|---|---|---|---|---|
| 53 | 400 | 95 | 560 | 90 | 10.8 | 9,000 |
| 54 | 380 | 90 | 575 | 94 | 9.2 | 8,500 |

The electrophotographic light-sensitive materials according to the present invention were excellent in the charging property, dark charge retention rate, and photosensitivity, and provided clear duplicated images having no background fog even under severe conditions of high temperature and high humidity (30° C., 80% RH).

Furthermore, each light-sensitive material was used for printing as an offset master plate, 8,500 to 9,000 prints having clear images were obtained.

EXAMPLES 55 TO 63

A mixture of 5.4 g of each of the resins (AL) shown in Table 19 below, 30.6 g g of each of the resins (B) shown in the Table 19 below, 200 g of zinc oxide, 0.05 g of Rose Bengale, 0.03 g of tetrabromophenol blue, 0.02 g of uranine, and 240 g of toluene was dispersed in a ball mill for 4 hours and, after adding thereto each of the crosslinking agents shown in the Table 1 below in the amount shown in the table, the resulting mixture was further dispersed in a ball mill for 5 minutes to prepare a coating composition for a light-sensitive layer. The coating composition was coated on paper, which had been subjected to electrically conductive treatment, by a wire bar at a dry coverage of 20 g /m$^2$, heated at 110° C. for 30 seconds, and then heated at 120° C. for 2 hours. The coated paper was allowed to stand in a dark place for 24 hours under the conditions of 20° C. and 65% RH to prepare each of the electrophotographic light-sensitive materials.

TABLE 19

| Example | Resin (AL) | Resin (B) | Crosslinking Agent (amount) |
|---|---|---|---|
| 55 | (AL-1) | (B-1) | Glutaconic acid (4 g) |
| 56 | (AL-2) | (B-2) | 1,3-Xylylenediisocyanate (3 g) |
| 57 | (AL-3) | (B-6) | Ethylene glycol (1.5 g) |
| 58 | (AL-5) | (B-8) | Ethylene glycol diacrylate (3 g) |
| 59 | (AL-11) | (B-3) | Succinic acid (3.8 g) |
| 60 | (AL-12) | (B-1) | Succinic acid (0 g) |
| 61 | (AL-16) | (B-11) | Succinic acid (0 g) |
| 62 | (AL-20) | (B-8) | 1,6-Hexanediisocyanate (3 g) |
| 63 | (AL-21) | (B-3) | Gluconic acid (3.8 g) |

Each of the electrophotographic light-sensitive materials according to the present invention was excellent in the charging property, dark charging retention rate, and photosensitivity, and provide clear duplicated images having no background fog even under severe conditions of high temperature and high humidity (30° C., 80% RH).

Furthermore, when each light-sensitive material was used for printing as an offset master plate, 8,000 prints having clear image quality were obtained.

EXAMPLE 64

A mixture of 0.5 g of Resin (AL-1), 33.5 g of poly(ethylmethacrylate) (Mw: $3.2 \times 10^5$), i.e., resin (C-1), 200 g of zinc oxide, 0.018 g of Cyandine Dye (II) described above, 0.10 g of phthalic anhydride, and 300 g of toluene was dispersed in a ball mill for 3 hours to prepare a coating composition for a light-sensitive layer. The coating composition was coated on paper, which had been subjected to electrically conductive treatment, at a dry coverage of 18 g /m$^2$ with a wire bar and dried for 30 seconds at 110° C. Then, the coated material was allowed to stand in a dark place for 24 hours under the conditions of 20° C. and 65% RH to prepare an electrophotographic light-sensitive material.

COMPARATIVE EXAMPLE A-3

An electrophotographic light-sensitive material was prepared according to the same procedure as Example 64 described above except that 6.5 g of Resin (R-1) for comparison described above was used in place of 6.5 g of Resin (AL-1).

COMPARATIVE EXAMPLE B-3

An electrophotographic light-sensitive material was prepared according to the same procedure as Example 64 described above except that 6.5 g of Resin (R-3) for comparison described above (a charging ratio of ethyl methacrylate/β-mercaptopropionic acid was 95/5 by weight) was used in place of 6.5 g of Resin (AL-1).

COMPARATIVE EXAMPLE C-3

An electrophotographic light-sensitive material was prepared according to the same procedure as Example 1 described above except that 40 g of Resin (R-4) for comparison described above was used in place of 6.5 g of Resin (AL-1) and 33.5 g of Resin (C-1).

Each of the light-sensitive materials obtained was evaluated for film properties in terms of surface smoothness and mechanical strength; electrostatic characteristics; image forming performance; and image forming performance under conditions of 30° C. and 80% RH.

The results obtained are shown in Table 20.

TABLE 20

| | Example 64 | Comparative Example A-3 | Comparative Example B-3 | Comparative Example C-3 |
|---|---|---|---|---|
| Smoothness of Photo-*1 conductive Layer (sec/cc) | 135 | 130 | 125 | 130 |
| Mechanical Strength of*2 Photoconductive Layer (%) | 92 | 93 | 90 | 96 |
| Electrostatic*3 Characteristics | | | | |
| $V_{10}$ (−V) | 500 | 500 | 505 | 450 |
| DRR (%) | 88 | 65 | 70 | 40 |
| $E_{1/10}$ (erg/cm$^2$) | 19 | 45 | 38 | 105 |
| $E_{1/100}$*5 (erg/cm$^2$) | 35 | 88 | 73 | 200 or more |
| Image Forming*4 Performance | | | | |
| I: (20° C., 65% RH) | Good | No Good (Reduced DM, Slight scratches of fine lines and letters) | No Good (Reduced DM) | Very Poor (Severe background fog, Reduced DM) |
| II: (30° C., 80% RH) | Good | Poor (Reduced DM, Slight background fog) | No Good (Reduced DM, Slight scratches of fine lines and letters) | Very Poor (Indiscriminative images from background fog) |
| Contact Angle with*5 Water (°) | 10 or less | 10 or less | 10 or less | 15 to 25 (widely scattered) |
| Printing Durability*6 (using a plate prepared under Condition II) | 8,000 | Slight background stains from the start of printing | Notable cut of letters from 3000th print | Background stains from the start of printing |

The evaluations described in Table 20 above were conducted as follows.

1) Smoothness of Photoconductive Layer:

The smoothness (sec/cc) of each light-sensitive material was measured using a Beck's smoothness test machine (manufactured by Kumagaya Riko K.K.) under an air volume condition of 1 cc.

2) Mechanical Strength of Photoconductive Layer:

The surface of each light-sensitive material was repeatedly rubbed 1,000 times with emery paper (#1000) under a load of 50 g/cm$^2$ using a Heidon 14 Model surface testing machine (manufactured by Shinto Kagaku K.K.). After removing abrasion dusts from the layer, the film retention (%) was determined from the weight loss of the photoconductive layer, which was referred to as the mechanical strength.

3) Electrostatic Characteristics:

Each light-sensitive material was charged by applying thereto corona discharge of −6 kV for 20 seconds using a paper analyzer (Paper Analyzer Type SP-428, manufactured by Kawaguchi Denki K.K.) in a dark place at a temperature of 20° C., 65% RH and then allowed to stand for 10 seconds. The surface potential $V_{10}$ was measured. Then, the sample was allowed to stand for 90 seconds in a dark place and the potential $V_{100}$ was measured. The dark decay retention rate [DRR (%)], i.e., the percent retention of potential after decaying for 90 seconds in a dark place, was calculated from the following formula: DRR (%)$=(V_{100}/V_{10})\times 100$ (%).

Also, the surface of the photoconductive layer was charged to −400 V by corona discharge, then irradiated by monochromatic light of a wavelength of 780 nm, the time required for decaying the surface potential ($V_{10}$) to 1/10 thereof, and the exposure amount $E_{1/100}$ (erg/cm$^2$) was calculated therefrom.

Further, in a similar manner to the determination of $E_{1/10}$ described above, the exposure amount $E_{1/100}$ (erg/cm$^2$) was determined by measuring the time for decaying the surface potential ($V_{10}$) to 1/100 thereof.

4) Image Forming Performance:

Each light-sensitive material was allowed to stand a whole day and night under the conditions described below. Then, each sample was charged to −5 kV, exposed by scanning with a gallium-aluminum-arsenic semiconductor laser (oscillation wavelength 750 nm) of 2.8 mW output as a light source at an exposure amount on the surface of 64 erg/cm$^2$, at a pitch of 25 μm, and a scanning speed of 300 m/sec., and developed using ELP-T (made by Fuji Photo Film Co., Ltd.) as a liquid developer followed by fixing. Then, the duplicated images (fog and image quality) were visually evaluated.

The environmental conditions at the image formation were 20° C. and 65% RH (Condition I) or 30° C. and 80% RH (Condition II).

5) Contact Angle with Water:

Each light-sensitive material was passed once through an etching processor using an oil-desensitizing solution ELP-EX (made by Fuji Photo Film Co., Ltd.) diluted to a 2-fold volume with distilled water to desensitize the surface of the photoconductive layer. Then, one drop of distilled water (2 μl) was placed on the surface, and the contact angle between the surface and the water drop formed thereon was measured using a goniometer.

6) Printing Durability:

Each light-sensitive material was subjected to the plate making under the same condition as described in 4) above to form a toner image, the sample was oil-desensitized under the same condition as in 5) described above, and the printing plate thus prepared was mounted on an offset printing machine (Oliver Model 52 manufactured by Sakurai Seisakusho K.K.) as an offset master plate following by printing. Then, the number of prints obtained without causing background stains on the non-image portions of prints and problems on the quality of the image portions was referred to as the printing durability. (The larger the number of prints, the better the printing durability.)

As is clear from the results shown in Table 20 above, the smoothness of the photoconductive layer was almost the same in each light-sensitive material. However, the electrostatic characteristics were excellent in the light-sensitive material according to the present invention, and, in particular, the photosensitivity in the $E_{1/100}$ value was greatly improved as compared with the comparative light-sensitive materials. This fact indicates that, in the comparative electrophotographic light-sensitive materials, the potential remaining at the areas corresponding to the non-image portions after light exposure is not lowered. When images are actually formed using the comparative light-sensitive materials, the remaining potential forms a background fog phenomenon at the non-image portions.

The image-forming performance was also excellent in the electrophotographic light-sensitive material according to the present invention. The light-sensitive materials of Comparative Examples A-3 and B-3 were much better than the light-sensitive material of Comparative Example C-3, but they were yet unsatisfactory under the image forming condition by the scanning exposure system using a low output semiconductor laser at a high speed.

Moreover, with respect to the contact angle with water when the light-sensitive materials were subjected to the oil-desensitizing treatment, although the light-sensitive material of Comparative Example C-3 exhibits the larger and scattered value, other light-sensitive materials showed as small as 10 degree or below which indicated that the surface of each sample was sufficiently rendered hydrophilic. However, when each printing plate precursor obtained by plate making of the light-sensitive material was oil-desensitized to prepare a printing plate followed by printing therewith, only the printing plate formed from the light-sensitive material according to the present invention can provide 8,000 prints of clear image free from background stains. On the contrary, in case of using the light-sensitive material of Comparative Example A-3 or B-3, background stains due to background fog on the printing plate precursor or cut of images occurred.

EXAMPLES 65 AND 66

A mixture of 7.5 g of Resin (AL-2) (Example 65) or 7.5 g of Resin (AL-3) (Example 66), 32.5 g of poly(-butylmethacrylate) (Mw: $3.6\times10^5$), i.e., Resin (C-2), 200 g of zinc oxide, 0.018 g of Cyanine Dye (III) described above, 0.15 g of maleic anhydride, and 300 g of toluene was dispersed in a ball mill for 3 hours to prepare a coating composition for a light-sensitive layer. The coating composition was coated on paper, which had been subjected to an electrically conductive treatment, by a wire bar at a dry coverage of 20 g /m$^2$, and dried for 30 seconds at 100° C. Then, the coated material was allowed to stand in a dark place for 24 hours under the conditions cf 20° C. and 65% RH to prepare each electrophotographic light-sensitive material.

The smoothness, mechanical strength, and the electrostatic characteristics of each of the electrophotographic light-sensitive materials were measured by the same procedure as described in Example 64.

Furthermore, each electrophotographic light-sensitive material was used as an offset master plate precursor and, after subjecting to an oil-desensitizing treatment, printing was conducted.

The results obtained are shown in Table 21 below.

TABLE 21

| | Example 65 | Example 66 |
|---|---|---|
| Smoothness of Photoconductive Layer (sec/cc) | 130 | 135 |
| Mechanical Strength of Photoconductive Layer (%) | 92 | 91 |
| Electrostatic Characteristics | | |
| $V_{10}$ (−V) | 540 | 605 |
| DRR (%) | 78 | 87 |
| $E_{1/10}$ (erg/cm$^2$) | 38 | 20 |
| $E_{1/100}$ (erg/cm$^2$) | 53 | 32 |
| Image-Forming Performance | | |
| I (20° C., 65%) | Good | Very Good |
| II (30° C., 80%) | Good | Very Good |
| Contact Angle with Water (°) | 10 or less | 10 or less |
| Printing Durability | 8,000 | 8,000 |

The evaluations were conducted in the same manner as in Table 20 above.

As is clear from the results shown in Table 21 above, each of the electrophotographic light-sensitive materials showed good electrophotographic characteristics. In particular, the light-sensitive material in Example 66 using the resin (AL) composed of the methacrylate component having the specific substituent exhibited particularly good photosensitivity and dark decay retention rate.

Also, when each of the light-sensitive materials was used as an offset master plate precursor, the oil-desensitizing treatment with an oil-desensitizing solution sufficiently proceeded and the contact angle with water at the non-image portion was as small as 10 degree or below, which indicated that the non-image portions were sufficiently rendered hydrophilic. When each master plate was actually used for printing, no background stains of prints were observed.

EXAMPLES 67 TO 72

A mixture of 6.0 g of each of Resins (AL) shown in Table 22 below, 34 g of each of Resins (C) shown in Table 22 below, 200 g of zinc oxide, 0.016 g of Cyanine Dye (IV) described above, 0.20 g of salicylic acid, and 300 g of toluene was dispersed in a ball mill for 3 hours to prepare a coating composition for a light-sensitive layer. The coating composition was coated on paper, which had been subjected to an electrically conductive treatment, by a wire bar at a dry coverage of 22 g/cm$^2$, and dried for 30 seconds at 110° C. Then, the coated material was allowed to stand in a dark place for 24 hours under the conditions of 20° C. and 65% RH to prepare each electrophotographic light-sensitive material.

The electrostatic characteristics, image forming performance and printing durability of each of the electrophotographic light-sensitive materials were determined by the same procedure as described in Example 64.

The results obtained are shown in Table 22 below, in which the results with respect to the electrostatic characteristics and image forming performance are those obtained under the severe conditions of 30° C. and 80% RH.

TABLE 22

| Example No. | Resin (AL) | Resin (C) (weight composition ratio) | Electrostatic Characteristics $V_{10}$ (−V) | DRR (%) | $E_{1/10}$ (erg/cm$^2$) | Image Forming Performance | Printing Durability |
|---|---|---|---|---|---|---|---|
| 67 | AL-8 | C-3: Poly(methylmethacrylate) Mw $1 \times 10^5$ | 610 | 89 | 20 | Good | 7,500 |
| 68 | AL-9 | C-4: Poly(styrene/ethylmethacrylate) (30/70) Mw $2 \times 10^5$ | 600 | 87 | 23 | " | 8,000 |
| 69 | AL-10 | C-5: Poly(ethylcrotonate) Mw $3 \times 10^5$ | 560 | 84 | 28 | " | " |
| 70 | AL-11 | C-6: Polyvinyl butyral Mw $1 \times 10^5$ | 585 | 88 | 30 | " | " |
| 71 | AL-12 | C-7: Polyvinyl acetate Mw $2.3 \times 10^5$ | 570 | 85 | 30 | " | " |
| 72 | AL-13 | C-8: Poly(benzyl methacrylate) Mw $2.4 \times 10^5$ | 580 | 58 | 21 | " | " |

Each of the electrophotographic light-sensitive materials according to the present invention exhibited good mechanical strength of the photoconductive layer and the good electrostatic characteristics, and the duplicated images actually formed had clear image quality free from background fog even under the high-temperature and high-humidity conditions (30° C. and 80% RH).

Furthermore, when each of the light-sensitive materials was used for printing as an offset master plate, 7,500 to 8,000 prints having good image quality could be obtained.

EXAMPLES 73 TO 82

A mixture of 6 g of each of Resin (AL) shown in Table 24 below, 34 g of each of Resins (D) shown in Table 23 below, 0.02 g of heptamethinecyanine dye (VIII) shown below, 0.15 g of phthalic anhydride, and 300 g of toluene was dispersed in a ball mill for 3 hours to prepare a coating composition for a light-sensitive layer. Then, according to the same procedure as Example 64 using each coating composition thus prepared, each electrophotographic light-sensitive material was prepared.

Heptamethinecyanine Dye (VIII):

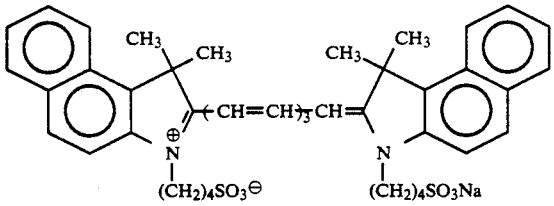

TABLE 23

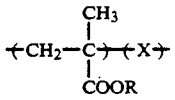

(The numeral shown in the table denotes a weight composition ratio)

| Resin in (D) | R | −X− | | Weight Average Molecular Weight (× $10^4$) |
|---|---|---|---|---|
| D-1 | $-C_2H_5$ 96 | 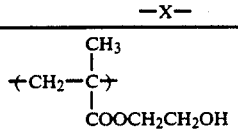 | 4 | 12 |

TABLE 23-continued

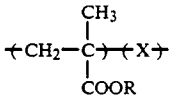

(The numeral shown in the table denotes a weight composition ratio)

| Resin in (D) | R | −X− | | Weight Average Molecular Weight (× $10^4$) |
|---|---|---|---|---|
| D-2 | $-C_2H_5$ 95 | 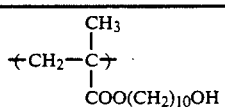 | 5 | 9.5 |
| D-3 | $-C_4H_9$ 98 | 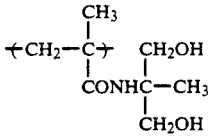 | 2 | 10 |
| D-4 | $-C_4H_9$ 97 | 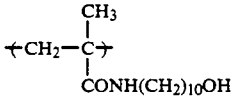 | 3 | 11.5 |
| D-5 | $-C_4H_9$ 96 | 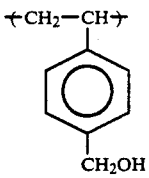 | 4 | 20 |
| D-6 | $-C_2H_5$ 95 | 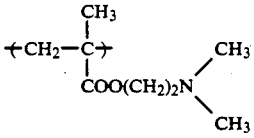 | 5 | 8.8 |
| D-7 | $-C_3H_7$ 95 | 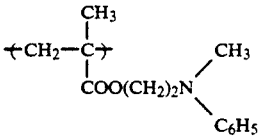 | 5 | 9.5 |

TABLE 23-continued

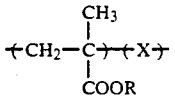

(The numeral shown in the table denotes a weight composition ratio)

| Resin in (D) | R | —X— | | Weight Average Molecular Weight (× $10^4$) |
|---|---|---|---|---|
| D-8 | $-C_4H_9$ 96 | 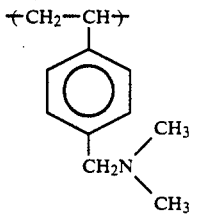 | | 10.5 |
| D-9 | $-C_2H_5$ 97 | 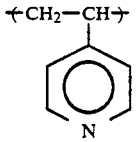 | 3 | 10.5 |
| D-10 | $-C_4H_9$ 95 | 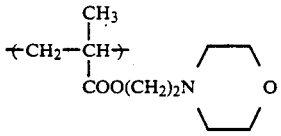 | 5 | 13 |

Each of the electrophotographic light-sensitive materials was determined for the electrostatic characteristics using a paper analyzer as described in Example 64. In this case, however, a gallium-aluminum-arsenic semiconductor laser (oscillation wave length 830 nm) was used as a light source.

The results obtained are shown in Table 24 below.

TABLE 24

| Example | Resin (AL) | Resin (D) | $V_{10}$ (−V) | DRR | $E_{1/10}$ (erg/cm$^2$) | Image Forming Performance (30° C., 80% RH) | Printing Durability |
|---|---|---|---|---|---|---|---|
| 73 | AL-11 | D-1 | 590 | 87 | 21 | Good | 8000 prints |
| 74 | AL-14 | D-2 | 565 | 85 | 24 | " | " |
| 75 | AL-18 | D-3 | 600 | 88 | 19 | " | 9000 prints |
| 76 | AL-19 | D-4 | 585 | 87 | 20 | " | " |
| 77 | AL-20 | D-5 | 595 | 88 | 18 | " | 8000 prints |
| 78 | AL-21 | D-6 | 585 | 89 | 19 | " | " |
| 79 | AL-24 | D-7 | 575 | 87 | 21 | " | " |
| 80 | AL-25 | D-8 | 570 | 86 | 24 | " | " |
| 81 | AL-27 | D-9 | 590 | 88 | 20 | " | " |
| 82 | AL-29 | D-10 | 560 | 85 | 25 | " | " |

Each of the electrophotographic light-sensitive materials according to the present invention was excellent in the charging property, dark decay retention rate and photosensitivity, and provided clear duplicated images without the formation of background fog even under severe conditions of high temperature and high humidity (30° C., 80%RH).

EXAMPLES 83 TO 94

A mixture of 7 g of Resin (AL-20), 33 g of each of Resins (E) shown in Table 25 below, 0.018 g of Cyanine dye (II) described above, 0.15 g of maleic anhydride, 200 g of zinc oxide, and 300 g of toluene was dispersed in a ball mill for 3 hours to prepare a coating composition for a light-sensitive layer. Then, according to the same procedure as in Example 64 using each coating composition, each electrophotographic light-sensitive material was prepared.

TABLE 25

Resin (E)

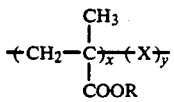

(x and y each denotes a weight composition ratio)

| Example | Resin (E) | R, x | —X— | y | Weight Average Molecular Weight (×$10^5$) |
|---|---|---|---|---|---|
| 83 | E-1 | $-C_2H_5$ 99.5 | 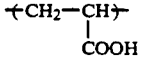 | 0.5 | 1.8 |
| 84 | E-2 | $-C_2H_5$ 99.5 | 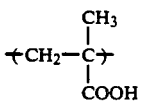 | 0.5 | 2.0 |

TABLE 25-continued
Resin (E)
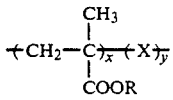
(x and y each denotes a weight composition ratio)
| Example | Resin (E) | R, x | —X— | y | Weight Average Molecular Weight ($\times 10^5$) |
|---|---|---|---|---|---|
| 85 | E-3 | $-C_2H_5$ 99.2 | 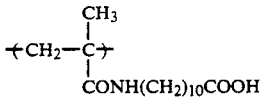 | 0.8 | 2.1 |
| 86 | E-4 | $-C_4H_9$ 99.7 | 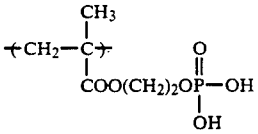 | 0.3 | 2.5 |
| 87 | E-5 | $-C_4H_9$ 99.7 | 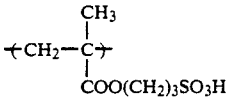 | 0.3 | 1.5 |
| 88 | E-6 | $-C_2H_5$ 99.5 | 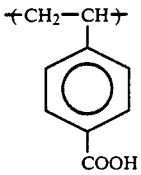 | 0.5 | 1.1 |
| 89 | E-7 | $-CH_2C_6H_5$ 99.4 | 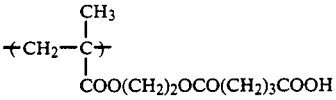 | 0.6 | 2.1 |
| 90 | E-8 | $-C_3H_7$ 99.4 | 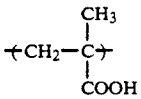 | 0.6 | 2.2 |
| 91 | E-9 | $-C_4H_9$ 99.5 | 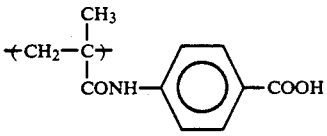 | 0.5 | 2.0 |
| 92 | E-10 | $-C_3H_7$ 99.7 | 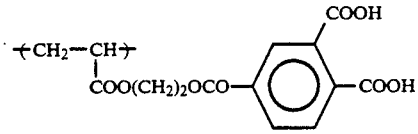 | 0.3 | 2.1 |
| 93 | E-11 | $-C_2H_5$ 99.7 | 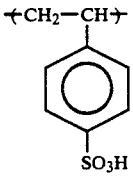 | 0.3 | 1.6 |

TABLE 25-continued

Resin (E)

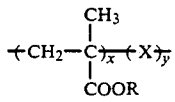

(x and y each denotes a weight composition ratio)

| Example | Resin (E) | R, x | —X— | y | Weight Average Molecular Weight ($\times 10^5$) |
|---|---|---|---|---|---|
| 94 | E-12 | $-C_2H_5$ 99.4 | $\leftarrow CH_2-CH\rightarrow$ (COO(CH₂)₂COOH) | 0.6 | 2.2 |

Each of the electrophotographic light-sensitive materials according to the present invention was excellent in the charging property, dark charge retention rate and photosensitivity, and provided clear duplicated images having neither the formation of background fog and the occurrence of each of fine lines even under severe conditions of high temperature and high humidity (30° C., 80% RH).

Furthermore, a printing plate was prepared from each light-sensitive material in the same manner as described in Example 64 and, when the printing plate was used as an offset master plate, 10,000 prints of clear image quality having no background stains were obtained.

EXAMPLES 95 TO 96

A mixture of 8 g of Resin (AL-3) (Example 95) or Resin (AL-19) (Example 96), 32 g of Resin (C-2), 200 g of zinc oxide, 0.02 g of uranine, 0.04 g of Rose Bengale, 0.03 g of bromophenol blue, 0.20 g of phthalic anhydride, and 300 g of toluene was dispersed in a ball mill for 2 hours to prepare a coating composition for a light-sensitive layer. The coating composition was coated on paper subjected to electrically conductive treatment, with a wire bar at a dry coverage of 20 g /m², and dried for one minute at 110° C. Then, the coated material was allowed to stand in a dark place for 24 hours under the conditions of 20° C. and 65% RH to prepare each electrophotographic light-sensitive material.

COMPARATIVE EXAMPLE D-3

An electrophotographic light-sensitive material was prepared in the same manner as in Example 95, except for using 8 g of Resin (R-3) for comparison described above in place of 8 g of Resin (AL-3).

Each of the light-sensitive materials obtained in Examples 95 and 96 and Comparative Example D-3 was evaluated in the same manner as in Example 64, except that the electrostatic characteristics and image forming performance were evaluated according to the following test methods.

7) Electrostatic Characteristics $E_{1/10}$ and $E_{1/100}$

The surface of the photoconductive layer was charged to −400 V with corona discharge, then irradiated by visible light of the illuminance of 2.0 lux, the time required for decay of the surface potential ($V_{10}$) to 1/10 or 1/100 thereof, and the exposure amount $E_{1/10}$ or $E_{1/100}$ (lux·sec) was calculated therefrom.

8) Image Forming Performance:

Each electrophotographic light-sensitive material was allowed to stand a whole day and night under the environmental conditions of 20° C. and 65% RH (Condition I) or 30° C. and 80% RH (Condition II), the light-sensitive material was image exposed and developed by a full-automatic plate making machine (ELP-404V made by Fuji Photo Film Co., Ltd.) using ELP-T as a toner. The duplicated image thus obtained was visually evaluated for fog and image quality. The original used for the duplication was composed of cuttings of other originals pasted up thereon.

The results obtained are shown in Table 26 below.

TABLE 26

| | Example 95 | Example 96 | Comparative Example D-3 |
|---|---|---|---|
| Binder Resin | (Al-3)/(C-2) | (AL-19)/(C-2) | (R-3)/(C-2) |
| Smoothness of Photoconductive Layer (sec/cc) | 125 | 130 | 130 |
| Mechanical Strength of Photoconductive Layer (%) | 92 | 92 | 90 |
| Electrostatic*7 Characteristics: | | | |
| $V_{10}$ (−V): | 550 | 610 | 540 |
| DRR (%): | 90 | 95 | 90 |
| $E_{1/10}$ (erg/cm²): | 11.0 | 8.5 | 12.3 |
| $E_{1/100}$ (erg/cm²): | 20.0 | 16.7 | 51 |
| Image-Forming Performance*8: | | | |
| Condition I | Good | Very Good | Poor (edge mark of cuttings) |
| Condition II | Good | Very Good | Poor (severe edge mark of cuttings) |
| Contact Angle | 10 or less | 10 or less | 10 or less |

TABLE 26-continued

| | Example 95 | Example 96 | Comparative Example D-3 |
|---|---|---|---|
| With Water (°) Printing Durability: | 8,000 | 8,000 | Background stains due to edge mark of cuttings from the start of printing |

From the results shown in Table 26 above, it can be seen that each light-sensitive material exhibits almost same properties with respect to the surface smoothness and mechanical strength of the photoconductive layer. However, on the electrostatic characteristics, the sample of Comparative Example D-3 has a larger value of photosensitivity $E_{1/100}$, particularly under the high temperature and high humidity conditions. On the contrary, the electrostatic characteristics of the light-sensitive materials according to the present invention are good. Further, those of Example 96 using the resin (AL) having the specific substituent are very good. The value of $E_{1/100}$ is particularly small.

With respect to image-forming performance, the edge mark of cuttings pasted up was observed as background fog in the non-image areas in the sample of Comparative Example D-3. On the contrary, the samples according to the present invention provided clear duplicated images free from background fog.

Further, each of these samples was subjected to the oil-desensitizing treatment to prepare an offset printing plate and printing was conducted. The samples according to the present invention provided 8,000 prints of clear image without background stains. However, with the sample of Comparative Example D-3, the above described edge mark of cuttings pasted up was not removed with the oil-desensitizing treatment and the background stains on the prints occurred from the start of printing.

As can be seen from the above results, only the light-sensitive material according to the present invention can provide the excellent performance.

EXAMPLES 97 TO 102

An electrophotographic light-sensitive material was prepared in the same manner as described in Example 95, except for replacing 8 g of Resin (AL-3) with 6.5 g of each of Resins (AL) shown in Table 27 below, and replacing 32 g of Resin (C-2) with 33.5 g of each of Resins (C) to (E) shown in Table 27 below.

TABLE 27

Resins (C) to (E)

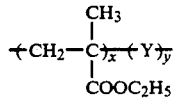

The weight average molecular weights of Resins (C) to (E) were from $1 \times 10^5$ to $3 \times 10^5$.

| Example | Resin (AL) | x/y (weight ratio) | —Y— |
|---|---|---|---|
| 97 | (AL-3) | 100/0 | — |
| 98 | (AL-5) | 96/4 | 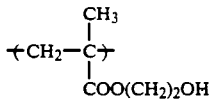 |
| 99 | (AL-6) | 95/5 | 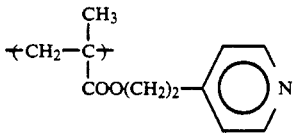 |
| 100 | (AL-7) | 99.6/0.4 | 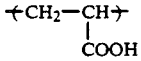 |
| 101 | (AL-24) | 99.7/0.3 | 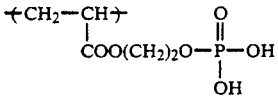 |
| 102 | (AL-29) | 99.7/0.3 | 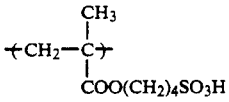 |

EXAMPLES 103 to 105

An electrophotographic light-sensitive material was prepared in the same manner as described in Example 95 except for replacing 8 g of Resin (AL-3) with 6.5 g of each of Resins (AL) shown in Table 28 below, and replacing 32 g of Resin (C-2) with 6.5 g of each of Resins (E) shown in Table 28 below.

TABLE 28

| Example | Resin (AL) | Resin (E) |
|---|---|---|
| 103 | (AL-26) | Dianal L-186 (methacrylic copolymer) (made by Mitsubishi Rayon Co., Ltd.) |
| 104 | (AL-28) | 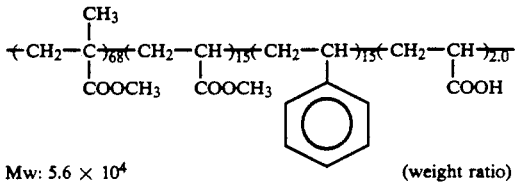 Mw: $5.6 \times 10^4$ (weight ratio) |

TABLE 28-continued

| Example | Resin (AL) | Resin (E) |
|---|---|---|
| 105 | (AL-30) | $\leftarrow CH_2-\underset{\underset{COOC_2H_5}{\mid}}{\overset{\overset{CH_3}{\mid}}{C}}\rightarrow_{88.5}\leftarrow CH_2-\underset{\underset{COO(CH_2)_2OH}{\mid}}{\overset{\overset{CH_3}{\mid}}{C}}\rightarrow_{10}\leftarrow CH_2-\underset{\underset{COOH}{\mid}}{\overset{\overset{CH_3}{\mid}}{C}}\rightarrow_{1.5}$ Mw: $6.3 \times 10^4$ (weight ratio) |

Each of the electrophotographic light-sensitive materials in Examples 97 to 105 according to the present invention was excellent in the strength of the photoconductive layer and the electrostatic characteristics, and provided clear duplicated images having no background fog even under high temperature and high humidity conditions (30° C., 80% RH). Furthermore, when the plate prepared from the light-sensitive material was used for printing as an offset master plate, 10,000 prints having good image quality were obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having provided thereon a photoconductive layer containing an inorganic photoconductive substance and a binder resin, wherein the binder resin contains at least one graft type copolymer containing, as a copolymerizable component, at least one mono-functional macromonomer (M) having a weight average molecular weight of from $1\times10^3$ to $2\times10^4$ and comprising an AB block copolymer being composed of an A block comprising at least one polymerizable component containing at least one acidic group selected from $-PO_3H_2$, $-COOH$, $-SO_3H$, a phenolic hydroxyl group,

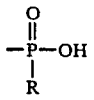

(wherein R represents a hydrocarbon group or —OR' (wherein R' represents a hydrocarbon group)) and a cyclic acid anhydride-containing group, and a B block containing at least one polymerizable component represented by the general formula (I) described below and having a polymerizable double bond group bonded to the terminal of the main chain of the B block polymer

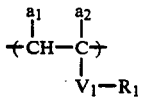

(I)

wherein $a_1$ and $a_2$ each represents a hydrogen atom, a halogen atom, a cyano group, a hydrocarbon group, $-COOZ_2$ or $-COOZ_2$ bonded bia a hydrocarbon group (wherein $Z_2$ represents a hydrogen atom or a hydrocarbon group); $V_1$ represents —COO—, —OCO—, $CH_{2l_1}OCO$—, $CH_{2l_2}COO$— (wherein $l_1$ and $l_2$ each represents an integer of from 1 to 3), —O—, $-SO_2-$, —CO—,

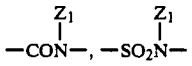

(wherein $Z_1$ represent a hydrogen atom or a hydrocarbon group), —CONHCOO—, —CONHCONH—, or

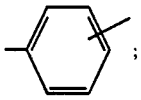

and $R_1$ represents a hydrocarbon group, provided that when $V_1$ represents

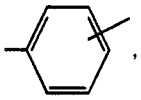

$R_1$ represents a hydrogen atom or a hydrocarbon group.

2. An electrophotographic light-sensitive material as claimed in claim 1, wherein the graft type copolymer contains, as a component copolymerizable with the macromonomer (M), at least one monomer represented by the following general formula (II):

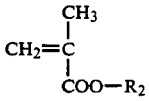

wherein $R_2$ represents a hydrocarbon group.

3. An electrophotographic light-sensitive material as claimed in claim 1, wherein the graft type copolymer contains, as a component copolymerizable with the macromonomer (M), a monomer represented by the following general formula (IIa) or (IIb):

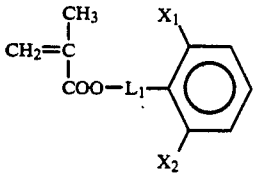

(IIa)

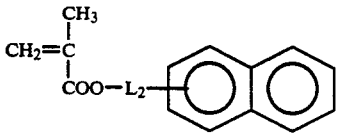

(IIb)

wherein $X_1$ and $X_2$ each, independently, represents a hydrogen atom, a hydrocarbon group having from 1 to 10 carbon atoms, a chlorine atom, a bromine atom, —$COZ_3$ or —$COOZ_3$ (wherein $Z_3$ represents a hydrocarbon group having from 1 to 10 carbon atoms); and $L_1$ and $L_2$ each represents a single bond or a linkage group having from 1 to 4 linking atoms, each connecting —COO— and the benzene ring in an amount of not less than 30% by weight.

4. An electrophotographic light-sensitive material as claimed in claim 1, wherein the graft type copolymer has a weight average molecular weight of from $1\times10^3$ to $5\times10^5$.

5. An electrophotographic light-sensitive material as claimed in claim 1, wherein said at least one graft type copolymer is a graft type copolymer (AL) having a weight average molecular weight of from $1\times10^3$ to $2\times10^4$ and containing from 1 to 30% by weight of the acidic group-containing component and said binder resin further contains a graft type copolymer (AH) having a weight average molecular weight of from $3\times10^4$ to $5\times10^5$ and containing from 0.1 to 10% by weight of the acidic group-containing component.

6. An electrophotographic light-sensitive material as claimed in claim 1, wherein the graft type copolymer has a weight average molecular weight of from $1\times10^3$ to $2\times10^4$ and further contains a copolymerizable component containing a heat- and/or photo-curable functional group in an amount of from 1 to 30% by weight.

7. An electrophotographic light-sensitive material as claimed in claim 1, wherein the graft type copolymer has a weight average molecular weight of from $1\times10^3$ to $2\times10^4$ and wherein the binder resin further contains a heat- and/or photo-curable resin.

8. An electrophotographic light-sensitive material as claimed in claim 1, wherein the graft type copolymer has a weight average molecular weight of from $1\times10^3$ to $2\times10^4$ and wherein the binder resin further contains a crosslinking agent.

9. An electrophotographic light-sensitive material as claimed in claim 1, wherein the graft type copolymer has a weight average molecular weight of from $1\times10^3$ to $2\times10^4$ and said binder resin further contains a high molecular weight resin (C) which has a weight average molecular weight of from $5\times10^4$ to $5\times10^5$ and does not contain —$PO_3H_2$, —COOH, —$SO_3H$, —OH,

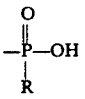

(wherein R represents a hydrocarbon group or —OR′ (wherein R′ represents a hydrocarbon group)), a cyclic acid anhydride-containing group, or a basic group.

10. An electrophotographic light-sensitive material as claimed in claim 1, wherein the graft type copolymer has a weight average molecular weight of from $1\times10^3$ to $2\times10^4$ and said binder resin further contains a high molecular weight resin (D) which has a weight average molecular weight of from $5\times10^4$ to $5\times10^5$ and contains from 0.1 to 15% by weight of a copolymerizable component containing at least one kind of substituent selected from —OH and a basic group.

11. An electrophotographic light-sensitive material as claimed in claim 1, wherein the graft type copolymer has a weight average molecular weight of from $1\times10^3$ to $2\times10^4$ and said binder resin further contains a high molecular weight resin (E) which has a weight average molecular weight of from $5\times10^4$ to $5\times10^5$ and contains a copolymerizable component containing an acidic group at a content of not more than 50% of the content of the acidic group contained in the graft type copolymer or a resin which has a weight average molecular weight of from $5\times10^4$ to $5\times10^5$ and contains a copolymerizable component containing at least one kind of an acidic group which is selected from —$PO_3H_2$, —$SO_3H$, —COOH, and

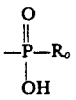

(wherein $R_o$ represents a hydrocarbon group or —$OR_o'$ (wherein $R_o'$ represents a hydrocarbon group)), and has a larger pKa than the pKa of the acidic group contained in the graft type copolymer.

* * * * *